US010859950B2

(12) United States Patent
Ino et al.

(10) Patent No.: US 10,859,950 B2
(45) Date of Patent: Dec. 8, 2020

(54) IMAGE FORMING APPARATUS

(71) Applicant: CANON KABUSHIKI KAISHA, Tokyo (JP)

(72) Inventors: Kazushi Ino, Suntou-gun (JP); Hiroyuki Yamazaki, Mishima (JP); Hiroshi Kawamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/811,340

(22) Filed: Mar. 6, 2020

(65) Prior Publication Data

US 2020/0285175 A1 Sep. 10, 2020

(30) Foreign Application Priority Data

Mar. 7, 2019 (JP) ..... 2019-041859

(51) Int. Cl.
*G03G 15/01* (2006.01)
*G03G 15/16* (2006.01)

(52) U.S. Cl.
CPC ..... *G03G 15/1615* (2013.01)

(58) Field of Classification Search
CPC ..... G03G 15/01; G03G 15/0131; G03G 15/0189; G03G 15/1615; G03G 15/6561; G03G 21/1647; G03G 2215/00059; G03G 2215/0158; G03G 2215/1661
USPC ..... 399/38–40, 297–303
See application file for complete search history.

(56) References Cited

U.S. PATENT DOCUMENTS

| | | | | |
|---|---|---|---|---|
| 4,803,515 | A | 2/1989 | Hoshino et al. | |
| 6,823,158 | B2 | 11/2004 | Yamada et al. | |
| 8,521,046 | B2 * | 8/2013 | Sugiyama | G03G 15/50 399/49 |
| 9,081,344 | B2 * | 7/2015 | Birumachi | G03G 15/1615 |
| 9,384,433 | B2 * | 7/2016 | Kitamura | G03G 15/1615 |
| 10,152,001 | B2 * | 12/2018 | Kumagai | G03G 15/5058 |

FOREIGN PATENT DOCUMENTS

| | | |
|---|---|---|
| JP | 63-011967 A | 1/1988 |
| JP | 2003-177591 A | 6/2003 |

* cited by examiner

*Primary Examiner* — Hoan H Tran
(74) *Attorney, Agent, or Firm* — Venable LLP

(57) ABSTRACT

An image forming apparatus includes an intermediary transfer belt, first to third image bearing members, a driving member, and first and second drive transmission members, and includes first to third transfer positions. A first inter-transfer-position distance between the first and second transfer positions and a second inter-transfer-position distance between the second and third transfer positions are different from each other. The first inter-transfer-position distance is set at "N×A" and the second inter-transfer-position distance is set at "N×A±N×A/i", where N is an integer of rotations of the driving member during to movement of the belt in the first inter-transfer-position distance, A is a distance of movement of the belt when the driving member rotates through one full circumference, and i is a transmission ratio between the first and second drive transmission members.

30 Claims, 22 Drawing Sheets

| | FIRST EMB. | COMP. EX. |
|---|---|---|
| $L_{YM'}$ $L_{MC}$ (mm) | 90 | 90 |
| $L_{CK}$ (mm) | 99 | 99 |
| A (mm) | 90 | 90 |
| Z1 | 150 | 150 |
| Z2 | 15 | 25 |
| i (Z1/Z2) | 10 | 6 |
| N (TIMES) | 1 | 1 |

Fig.4

| | |
|---|---|
| $L_{YM'}$ $L_{MC}$ (mm) | 90 |
| $L_{CK}$ (mm) | 99 |
| A (mm) | 45 |
| Z1 | 150 |
| Z3 | 30 |
| Z2 | 15 |
| i1 (Z1/Z3) | 5 |
| i2 (Z3/Z2) | 2 |
| N (TIMES) | 2 |

Fig.9

| | |
|---|---|
| $L_{YM'}$ $L_{MC}$ (mm) | 90 |
| $L_{CK}$ (mm) | 81 |
| A (mm) | 90 |
| Z1 | 150 |
| Z2 | 15 |
| i (Z1/Z2) | 10 |
| N (TIMES) | 1 |

Fig.12

| | |
|---|---|
| $L_{YM'}$ $L_{MC}$ (mm) | 90 |
| $L_{CK}$ (mm) | 99 |
| A (mm) | 90 |
| Z1 | 150 |
| Z2 | 15 |
| i1 (Z1/Z2) | 10 |
| N (TIMES) | 1 |

Fig.16

| | |
|---|---|
| $L_{YM'}$ $L_{MC}$ (mm) | 90 |
| $L_{CK}$ (mm) | 99 |
| A (mm) | 90 |
| Z4 | 150 |
| Z5 | 15 |
| i3 (Z4/Z5) | 10 |
| N (TIMES) | 1 |

Fig.19

| | |
|---|---|
| $L_{YM'}$ $L_{MC}$ (mm) | 90 |
| $L_{CK}$ (mm) | 99 |
| A (mm) | 90 |
| D46 (mm) | 75 |
| D47 (mm) | 7.5 |
| i6 (D46/D47) | 10 |
| N (TIMES) | 1 |

Fig.22

IMAGE FORMING APPARATUS

FIELD OF THE INVENTION AND RELATED ART

The present invention relates to an image forming apparatus such as a copying machine or a printer.

Conventionally, as the image forming apparatus of an electrophotographic type, there is an image forming apparatus of a tandem type for forming a full-color image. The image forming apparatus of the tandem type includes a plurality of image forming portions. For this reason, due to causes such as mechanical accuracy, speed non-uniformity or the like of a plurality of photosensitive drums, a transfer belt and a feeding belt occurring for each of colors at different times in some cases, color images do not coincide with each other when the color images are superposed and thus color misregistration occurs.

The color misregistration includes two types consisting of steady color misregistration and unsteady color misregistration. The steady color misregistration occurs due to a deviation or the like of assembling positions of laser scanners or the like for the respective colors. The unsteady color misregistration occurs due to a rotation speed fluctuation or the like of the photosensitive drums and a driving roller or the like for the transfer belt and the feeding belt.

In order to suppress the unsteady color misregistration, there is a need to prevent a frequency fluctuation component of a driving portion for the photosensitive drums, the transfer belt and the feeding belt from generating on an image. Therefore, a constitution in which a plurality of photosensitive drums are driven by a common driving source and are arranged so that a time interval in which a transfer belt passes through transfer positions adjacent to each other is an integral multiple of a drive non-uniformity period of the driving source has been known (Japanese Laid-Open Patent Application (JP-A) Sho 63-011967).

On the other hand, a constitution in which a plurality of photosensitive members are provided with intervals each being an integral multiple of an outer peripheral length (circumference) of a driving roller for driving a transfer belt or a sheet feeding belt and in which at least one photosensitive member interval is different from another photosensitive member interval has been known (JP-A 2003-177591). By this constitution, color misregistration due to speed non-uniformity of the transfer belt or the sheet feeding belt is prevented.

However, a problem such that the photosensitive drums are disposed so that the time interval is the integral multiple of the drive non-uniformity period of the driving roller and therefore a degree of freedom of arrangement of the respective photosensitive drums is suppressed, and a problem such that arrangement of the respective photosensitive members is restricted to the interval of the integral multiple of the outer peripheral length of the driving roller and therefore a degree of freedom of arrangement of the respective photosensitive members is suppressed arose.

SUMMARY OF THE INVENTION

The present invention has solved the above problems, and a principal object of the present invention is to provide an image forming apparatus capable of increasing a degree of freedom of an inter-transfer-position distance (interval) with less color misregistration by a simple constitution.

According to an aspect of the present invention, there is provided an image forming apparatus comprising an intermediary transfer belt; a first image bearing member provided opposed to the intermediary transfer belt; a second image bearing member provided opposed to the intermediary transfer belt; a third image bearing member provided opposed to the intermediary transfer belt; a rotatable driving member configured to rotationally drive the intermediary transfer belt; a first drive transmission member configured to rotate the rotatable driving member; and a second drive transmission member provided upstream of the first drive transmission member with respect to a drive transmission direction and configured to transmit a rotational driving force from a driving source to the first drive transmission member, wherein the image forming apparatus includes a first transfer position where the first image bearing member opposes the intermediary transfer belt, a second transfer position where the second image bearing member opposes the intermediary transfer belt, and a third transfer position where the third image bearing member opposes the intermediary transfer belt, wherein a first inter-transfer-position distance between the first transfer position and the second transfer position which are adjacent to each other along the intermediary transfer belt and a second inter-transfer-position distance between the second transfer position and the third transfer position which are adjacent to each other along the intermediary transfer belt are different from each other, and wherein a positional deviation between transfer images transferred onto the intermediary transfer belt at the first transfer position, the second transfer position and the third transfer position is prevented by setting the first inter-transfer-position distance at "$N \times A$" and setting the second inter-transfer-position distance at "$N \times A \pm N \times A/i$", where N is an integer of rotations of the rotatable driving member during movement of a predetermined position of the intermediary transfer belt in the first inter-transfer-position distance, A is a distance of movement of the predetermined position of the intermediary transfer belt when the rotatable driving member rotates one-full circumference, and i is a transmission ratio between the first drive transmission member and the second drive transmission member.

Further features of the present invention will become apparent from the following description of exemplary embodiments with reference to the attached drawings.

Figure 2:
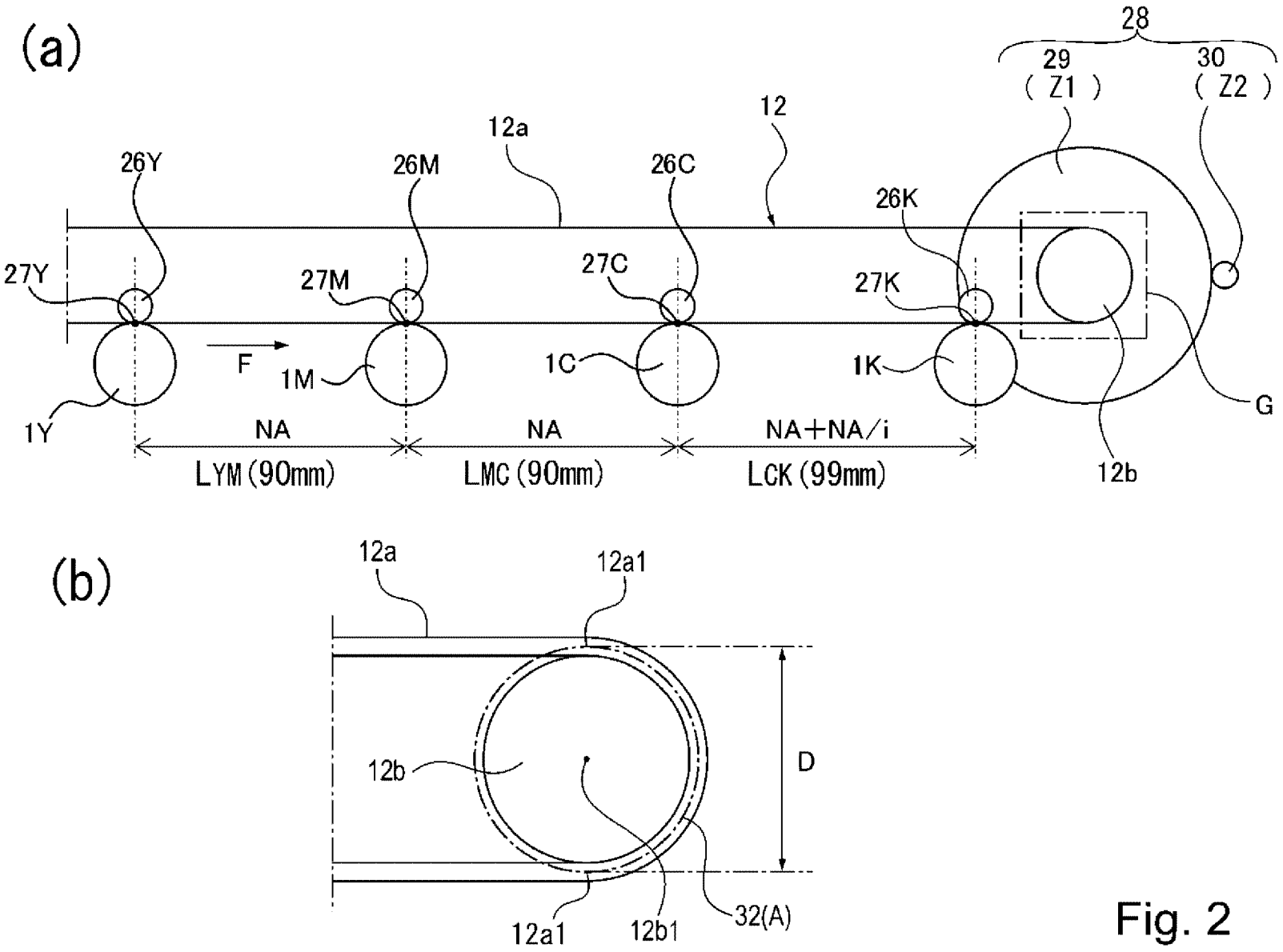

Part (a) of FIG. 2 is a sectional view showing a structure of a drive transmission device for the intermediary transfer belt in a first embodiment, and part (b) of FIG. 2 is an enlarged view of a portion G shown in part (a) of FIG. 2.

Figure 3:
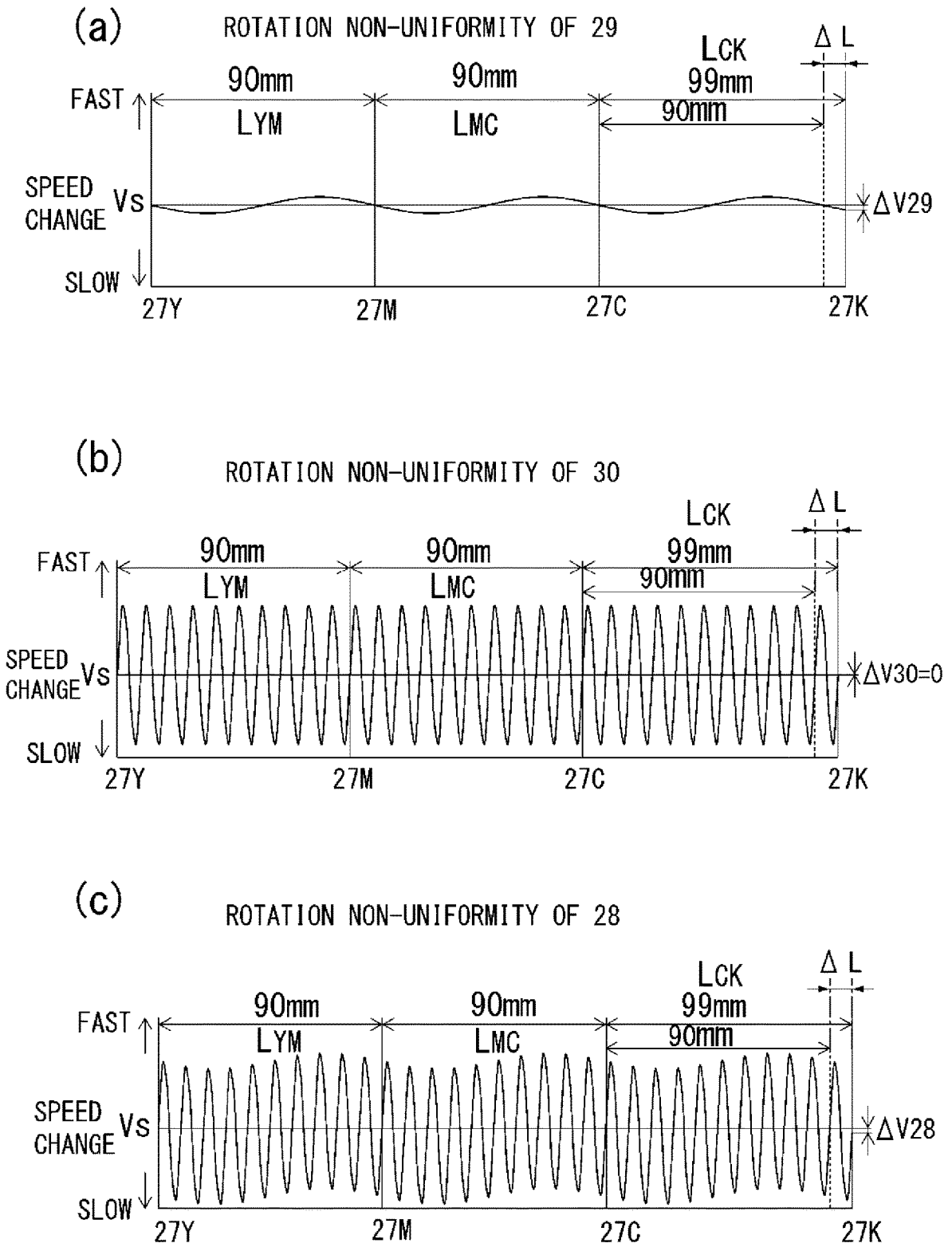

Part (a) of FIG. 3 is an illustration of a relationship between rotation non-uniformity of a driving roller gear alone and each transfer position in the first embodiment, part (b) of FIG. 3 is an illustration of a relationship between rotation non-uniformity of a motor gear alone and each transfer position in the first embodiment, and part (c) of FIG. 3 is an illustration of a relationship between rotation non-uniformity of an entire drive transmission device and each transfer position in the first embodiment.

FIG. 4 is a view showing a difference between the first embodiment and a comparison example in terms of inter-transfer-position distances between colors, a distance of movement of a predetermined position of a center of the intermediary transfer belt with respect to a thickness direction when a driving roller rotates one-full circumference, the number of teeth of the driving roller, the number of teeth of the motor gear, a transmission ratio and the number of rotations (revolutions) of the driving roller during movement of the intermediary transfer belt in the inter-transfer-position distance.

Figure 5:
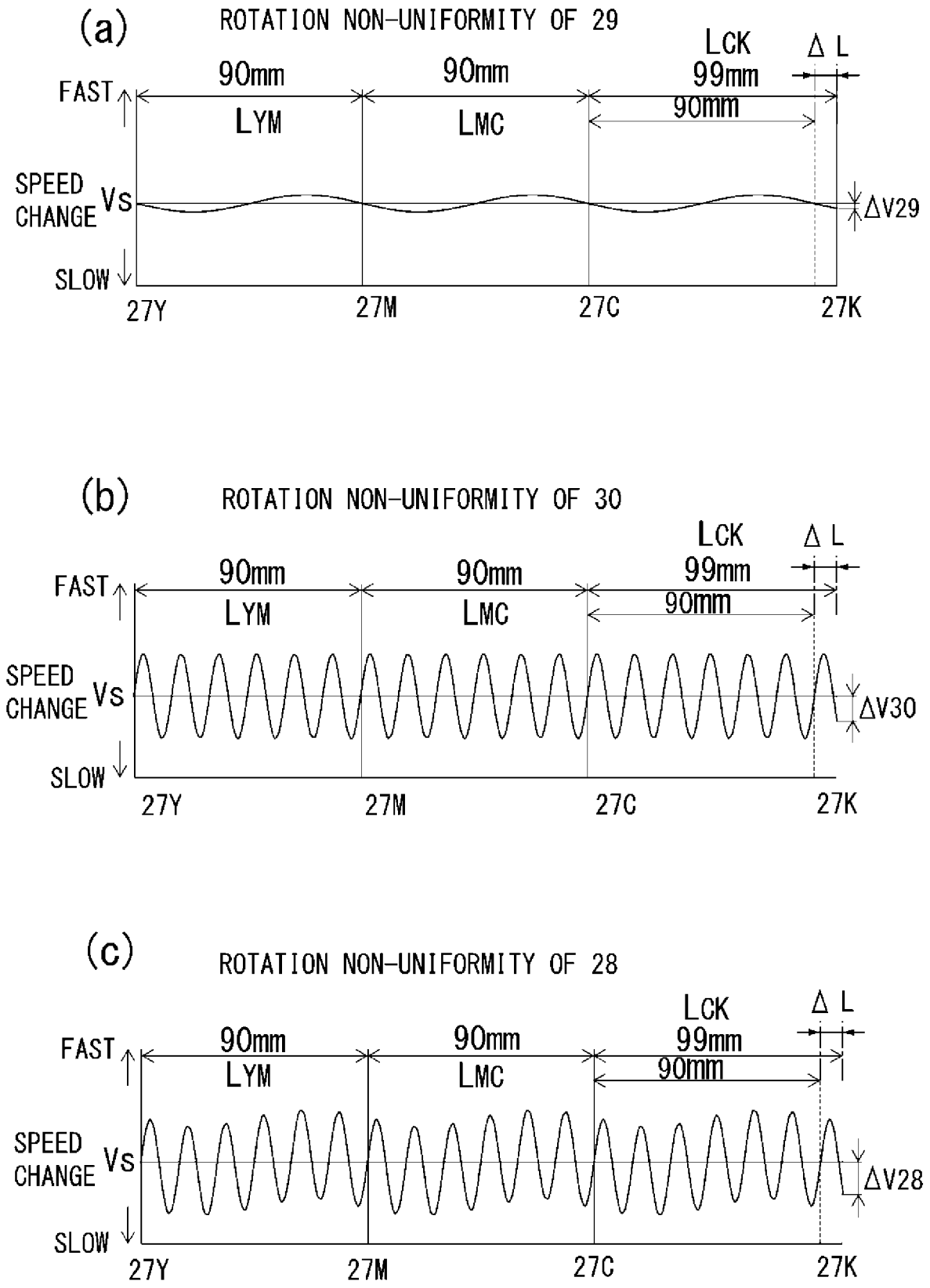

Part (a) of FIG. 5 is an illustration of a relationship between rotation non-uniformity of a driving roller gear alone and each transfer position in the comparison example, part (b) of FIG. 5 is an illustration of a relationship between rotation non-uniformity of a motor gear alone and each transfer position in the comparison example, and part (c) of FIG. 5 is an illustration of a relationship between rotation non-uniformity of an entire drive transmission device and each transfer position in the comparison example.

Figure 6:
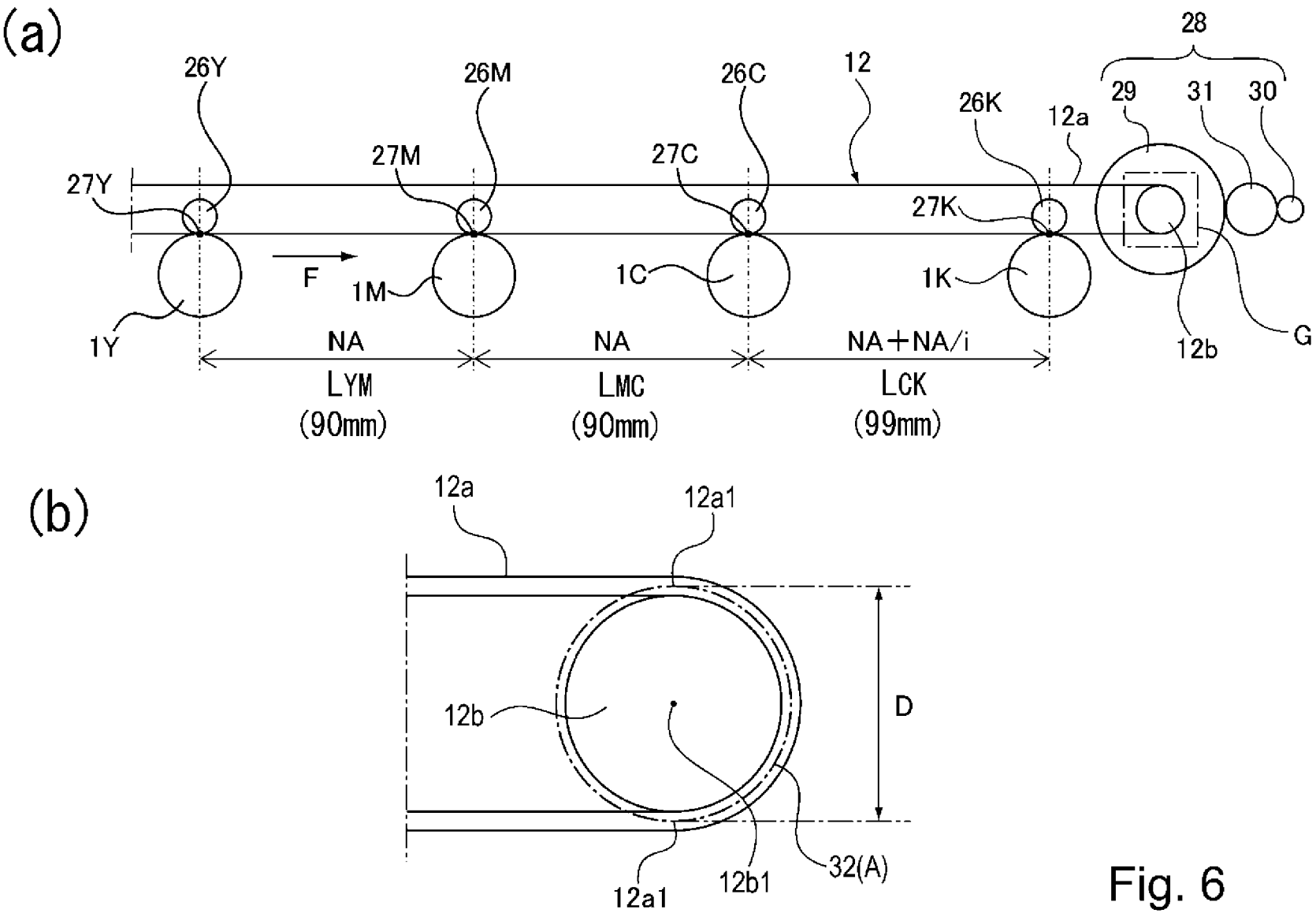

Part (a) of FIG. 6 is a sectional view showing a structure of a drive transmission device for the intermediary transfer belt in a second embodiment, and part (b) of FIG. 6 is an enlarged view of a portion G shown in part (a) of FIG. 6.

Figure 7:
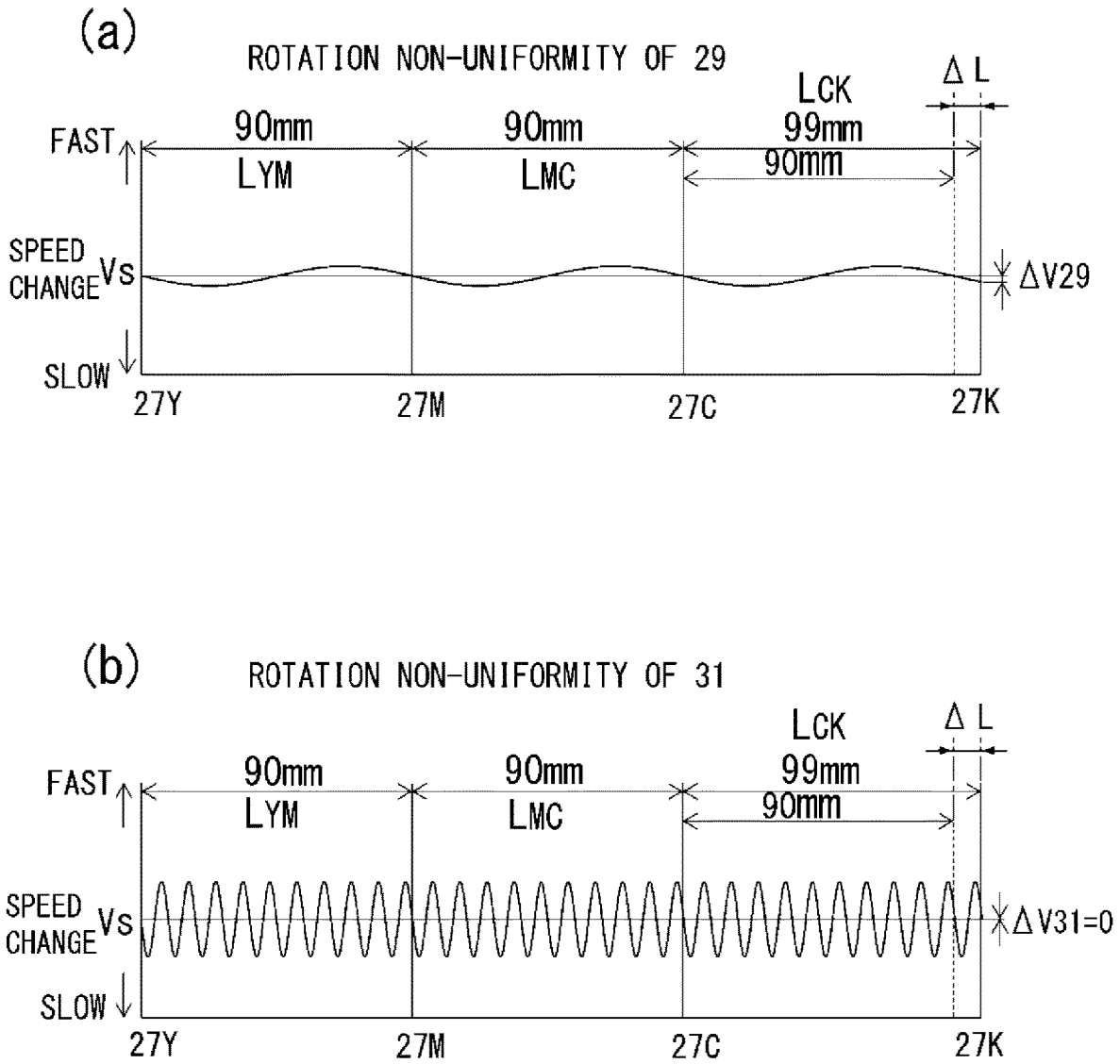

Part (a) of FIG. 7 is an illustration of a relationship between rotation non-uniformity of a driving roller gear alone and each transfer position in the second embodiment, and part (b) of FIG. 7 is an illustration of a relationship between rotation non-uniformity of a driving roller pre-stage gear alone and each transfer position in the second embodiment.

Figure 8:
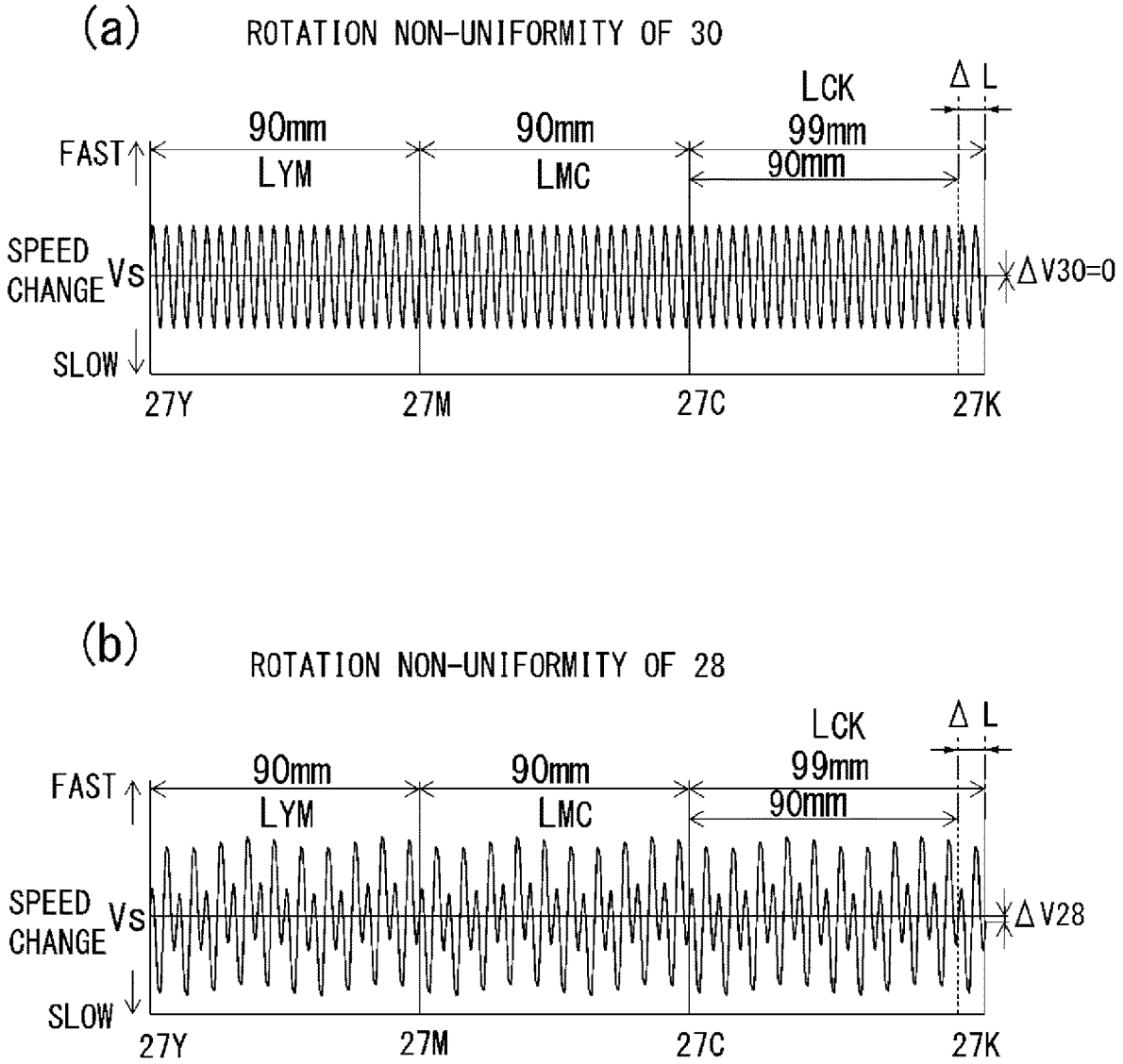

Part (a) of FIG. 8 is an illustration of a relationship between rotation non-uniformity of a motor gear alone and each transfer position in the second embodiment, and part (b) of FIG. 8 is an illustration of a relationship between rotation non-uniformity of an entire drive transmission device and each transfer position in the second embodiment.

FIG. 9 is a view showing inter-transfer-position distances between colors, a distance of movement of a predetermined position of a center of the intermediary transfer belt with respect to a thickness direction when a driving roller rotates one-full circumference, the number of teeth of the driving roller, the number of teeth of the driving roller pre-stage gear, the number of teeth of the motor gear, transmission ratios and the number of rotations of the driving roller during movement of the intermediary transfer belt in the inter-transfer-position distance in the second embodiment.

Figure 10:
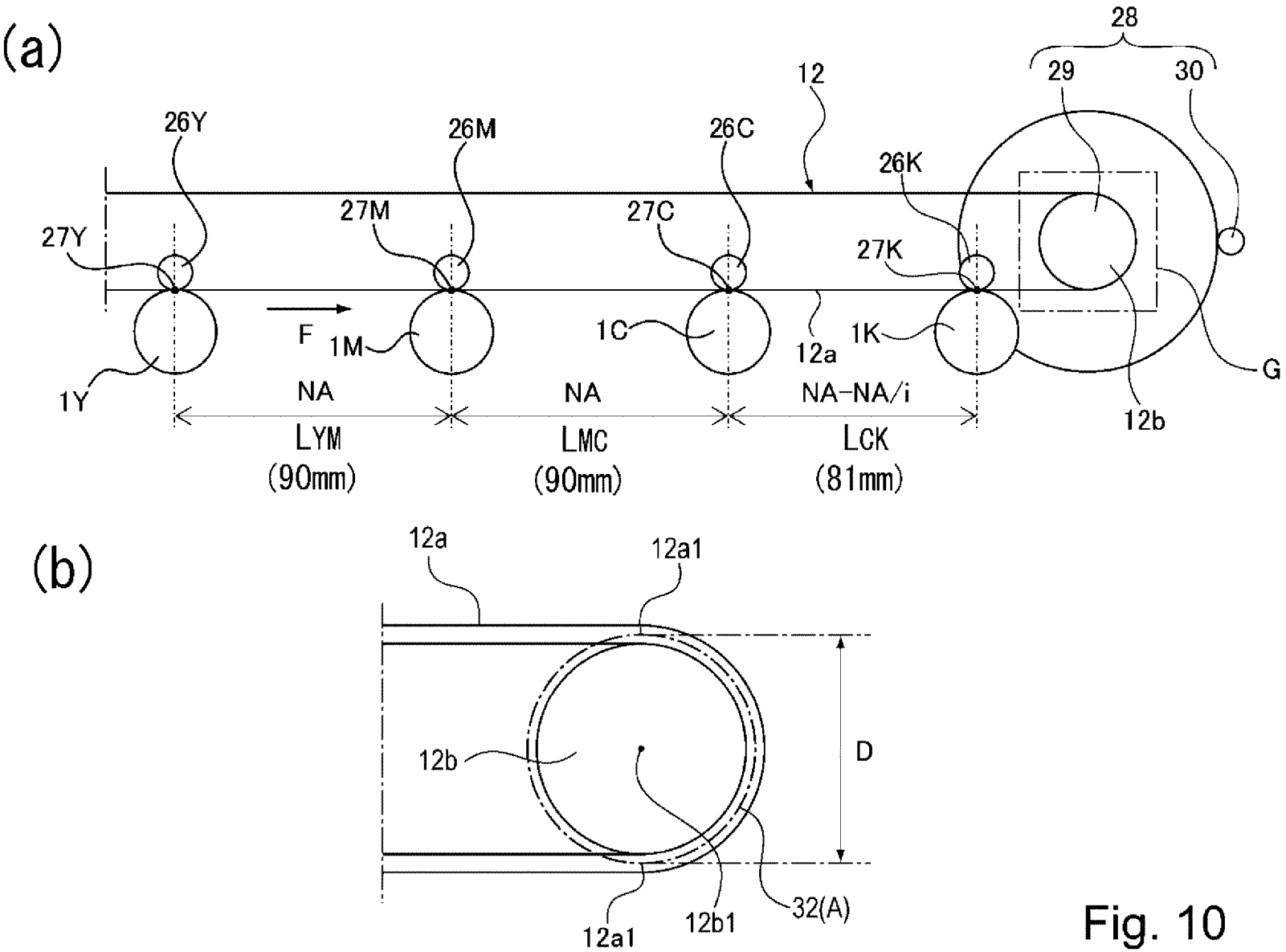

Part (a) of FIG. 10 is a sectional view showing a structure of a drive transmission device for the intermediary transfer belt in a third embodiment, and part (b) of FIG. 10 is an enlarged view of a portion G shown in part (a) of FIG. 10.

Figure 11:
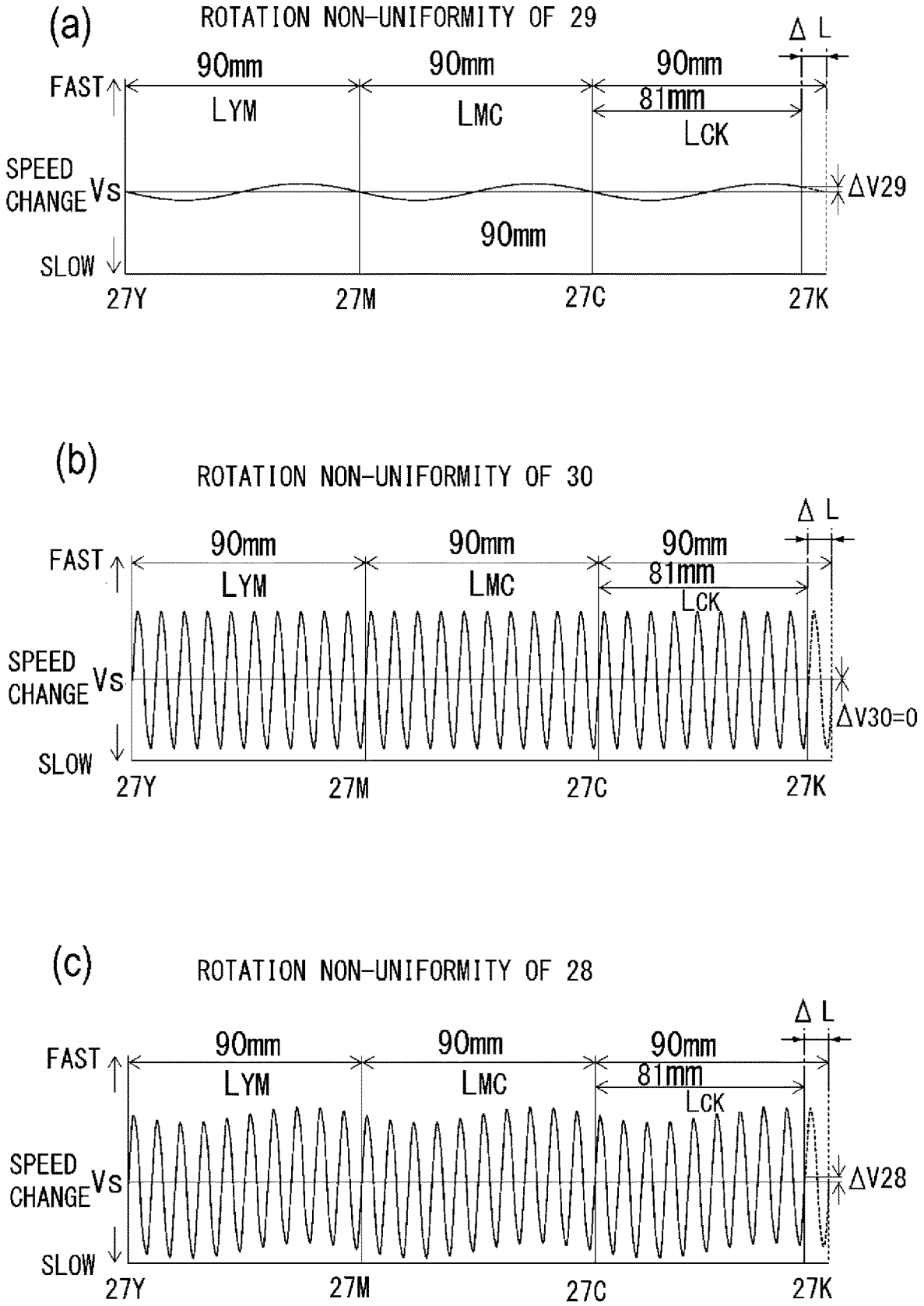

Part (a) of FIG. 11 is an illustration of a relationship between rotation non-uniformity of a driving roller gear alone and each transfer position in the third embodiment, part (b) of FIG. 11 is an illustration of a relationship between rotation non-uniformity of a motor gear alone and each transfer position in the third embodiment, and part (c) of FIG. 11 is an illustration of a relationship between rotation non-uniformity of an entire drive transmission device and each transfer position in the third embodiment.

FIG. 12 is a view showing inter-transfer-position distances between colors, a distance of movement of a predetermined position of a center of the intermediary transfer belt with respect to a thickness direction when a driving roller rotates one-full circumference, the number of teeth of the driving roller, the number of teeth of the motor gear, a transmission ratio and the number of rotations of the driving roller during movement of the intermediary transfer belt in the inter-transfer-position distance in the third embodiment.

Figure 13:
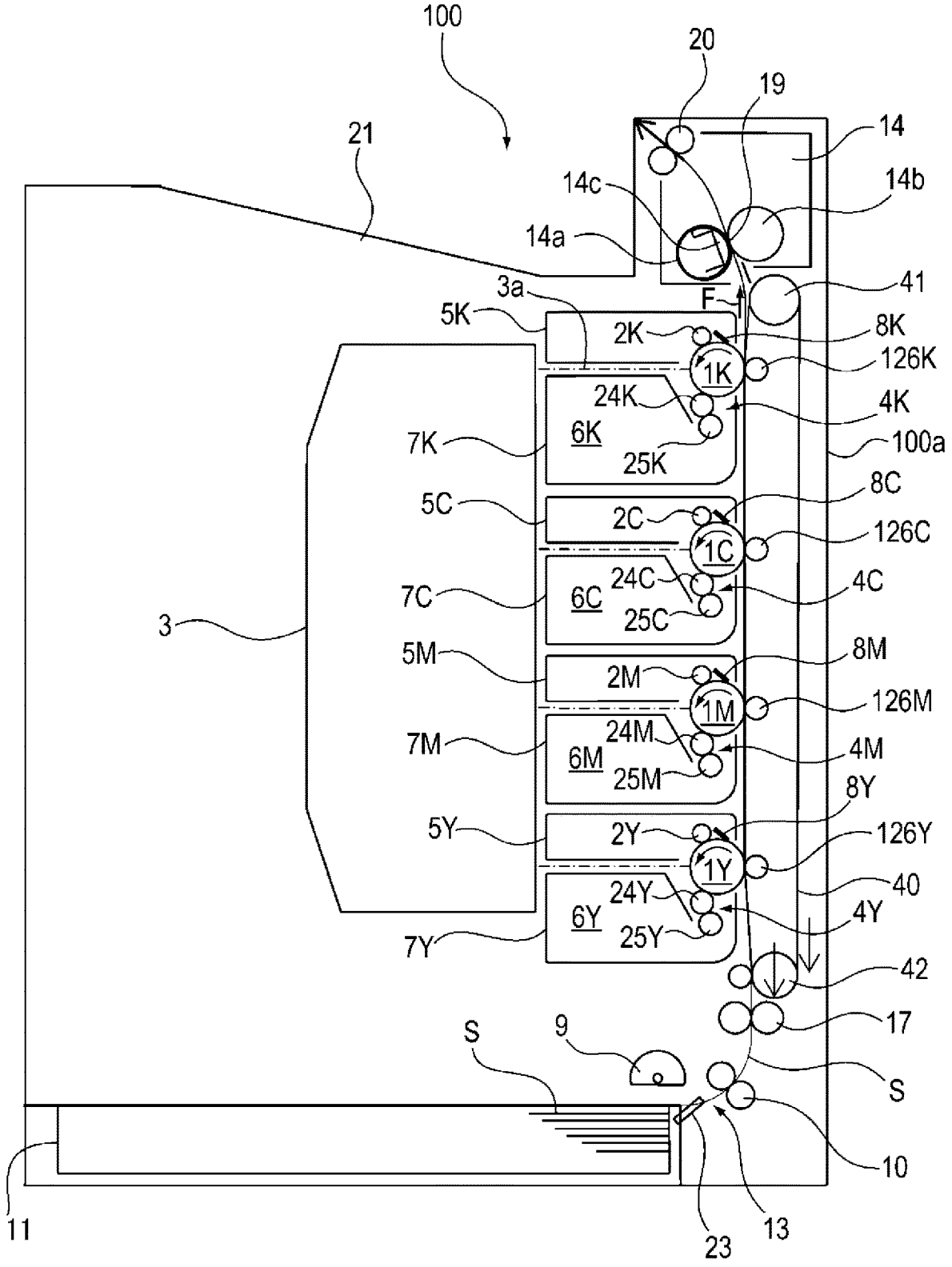

FIG. 13 is a sectional view showing a structure of an image forming apparatus provided with an electrostatic attraction belt.

Figure 14:
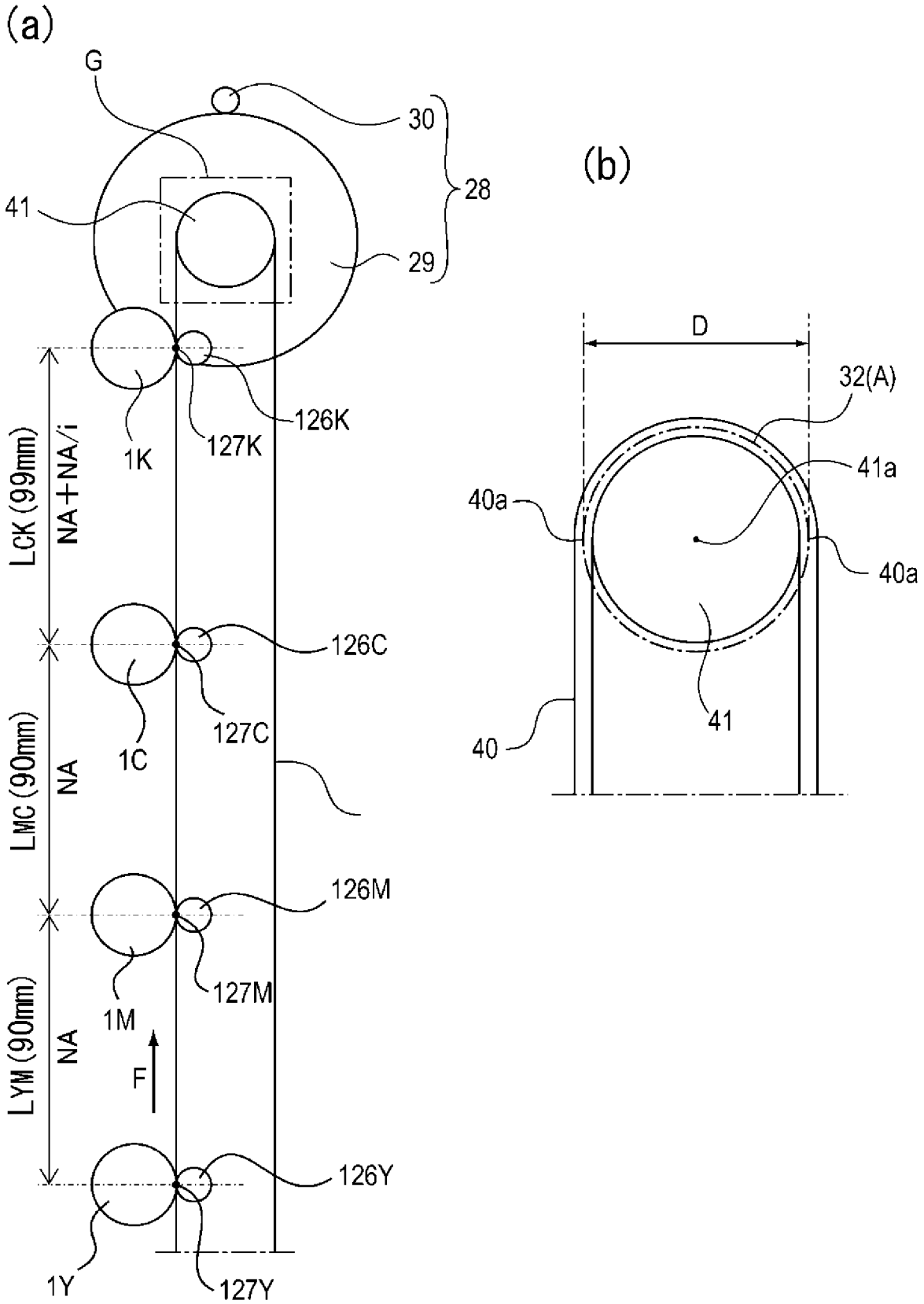

Part (a) of FIG. 14 is a sectional view showing a structure of a drive transmission device for the electrostatic attraction belt in a fourth embodiment, and part (b) of FIG. 14 is an enlarged view of a portion G shown in part (a) of FIG. 14.

Figure 15:
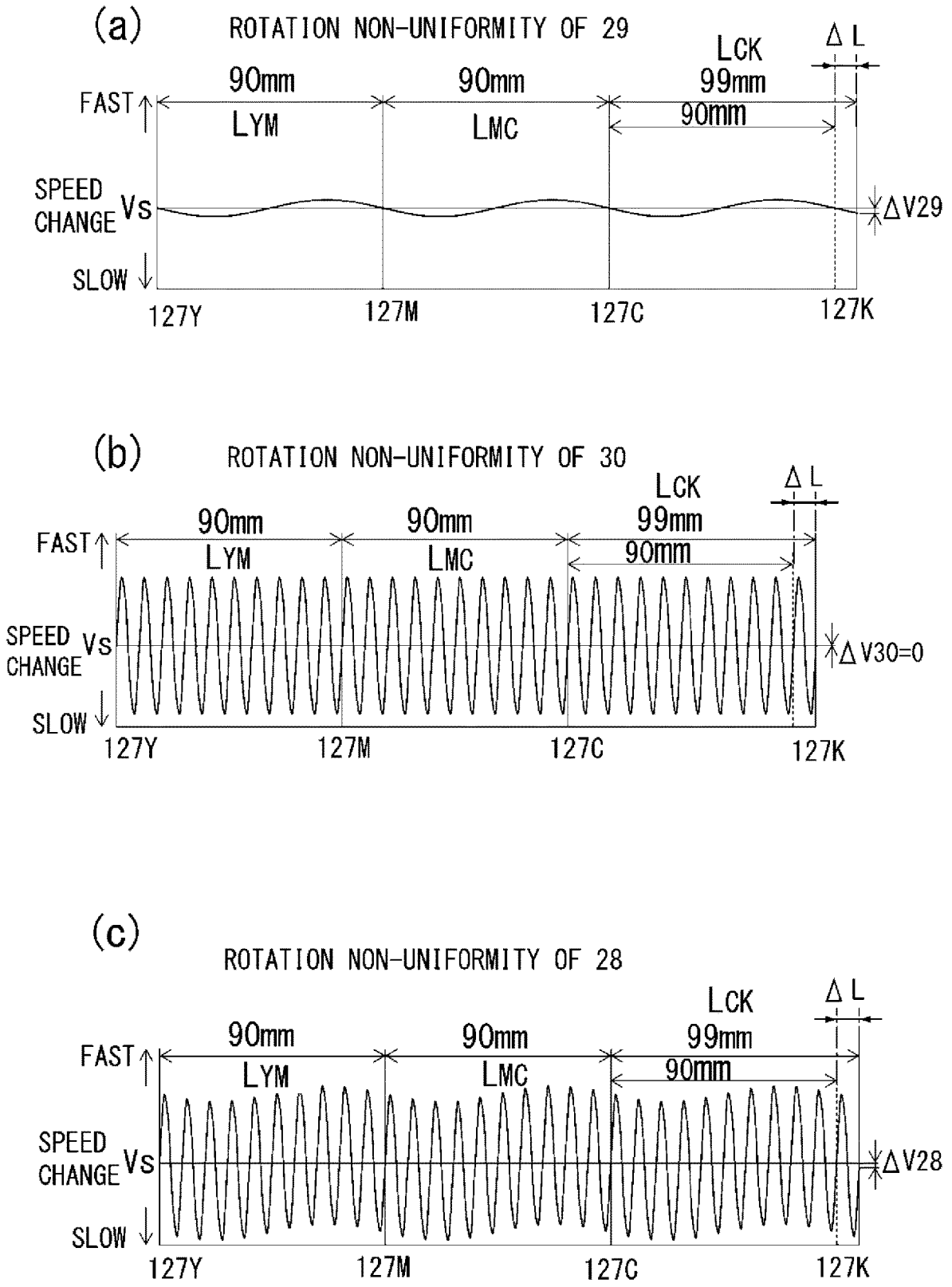

Part (a) of FIG. 15 is an illustration of a relationship between rotation non-uniformity of a driving roller gear alone and each transfer position in the fourth embodiment, part (b) of FIG. 5 is an illustration of a relationship between rotation non-uniformity of a motor gear alone and each transfer position in the fourth embodiment, and part (c) of FIG. 15 is an illustration of a relationship between rotation non-uniformity of an entire drive transmission device and each transfer position in the fourth embodiment.

FIG. 16 is a view showing inter-transfer-position distances between colors, a distance of movement of a predetermined position of a center of the electrostatic attraction belt with respect to a thickness direction when a driving roller rotates one-full circumference, the number of teeth of the driving roller, the number of teeth of the motor gear, a transmission ratio and the number of rotations of the driving roller during movement of the electrostatic attraction belt in the inter-transfer-position distance in the fourth embodiment.

Figure 17:
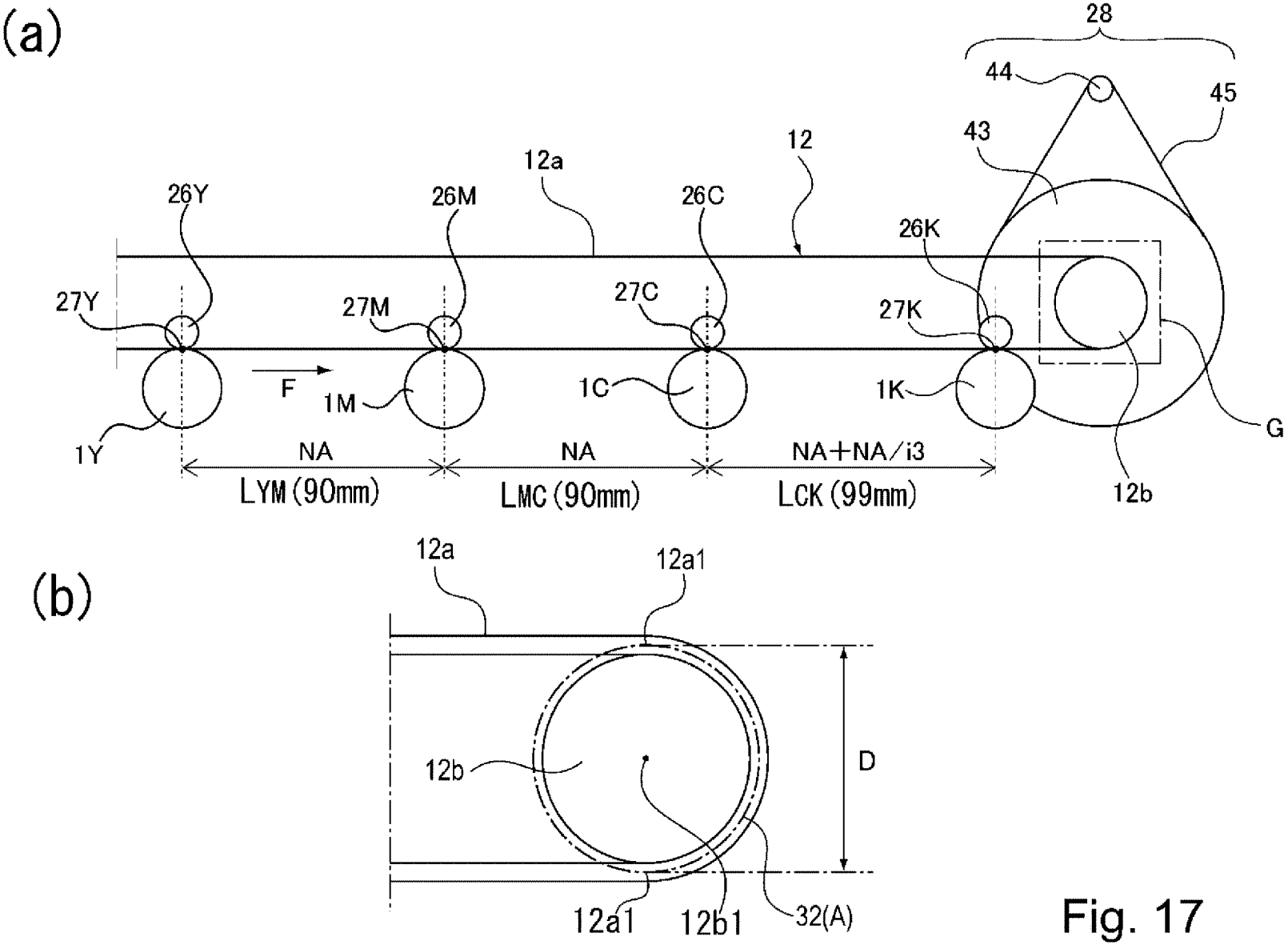

Part (a) of FIG. 17 is a sectional view showing a structure of a drive transmission device for the intermediary transfer belt in a fifth embodiment, and part (b) of FIG. 17 is an enlarged view of a portion G shown in part (a) of FIG. 17.

Figure 18:
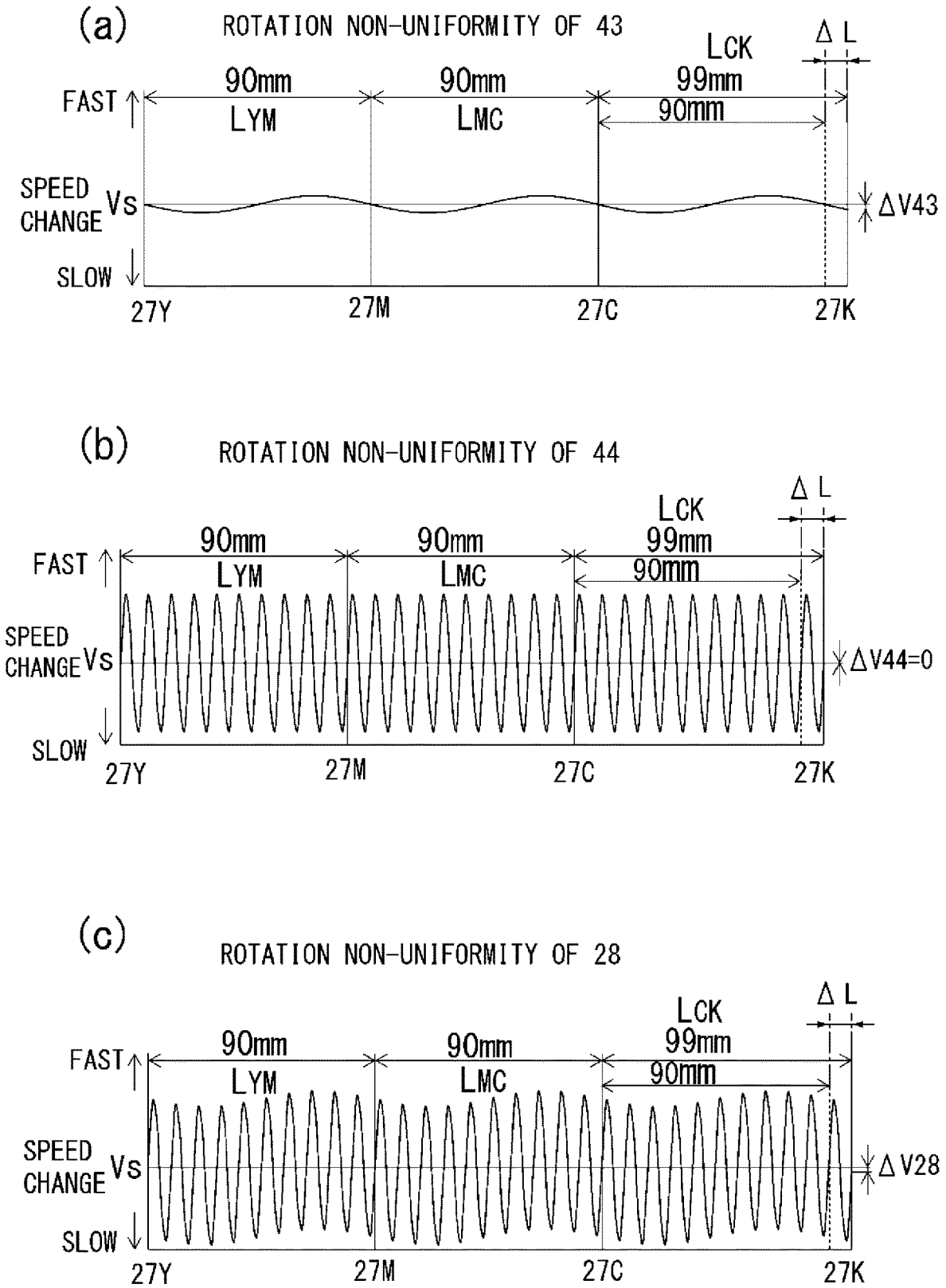

Part (a) of FIG. 18 is an illustration of a relationship between rotation non-uniformity of a driving roller pulley alone and each transfer position in the fifth embodiment, part (b) of FIG. 18 is an illustration of a relationship between rotation non-uniformity of a motor pulley alone and each transfer position in the fifth embodiment, and part (c) of FIG. 18 is an illustration of a relationship between rotation non-uniformity of an entire drive transmission device and each transfer position in the fifth embodiment.

FIG. 19 is a view showing inter-transfer-position distances between colors, a distance of movement of a predetermined position of a center of the intermediary transfer belt with respect to a thickness direction when a driving roller rotates one-full circumference, the number of teeth of the driving roller pulley, the number of teeth of the motor pulley, a transmission ratio and the number of rotations of the driving roller during movement of the intermediary transfer belt in the inter-transfer-position distance in the fifth embodiment.

Figure 20:
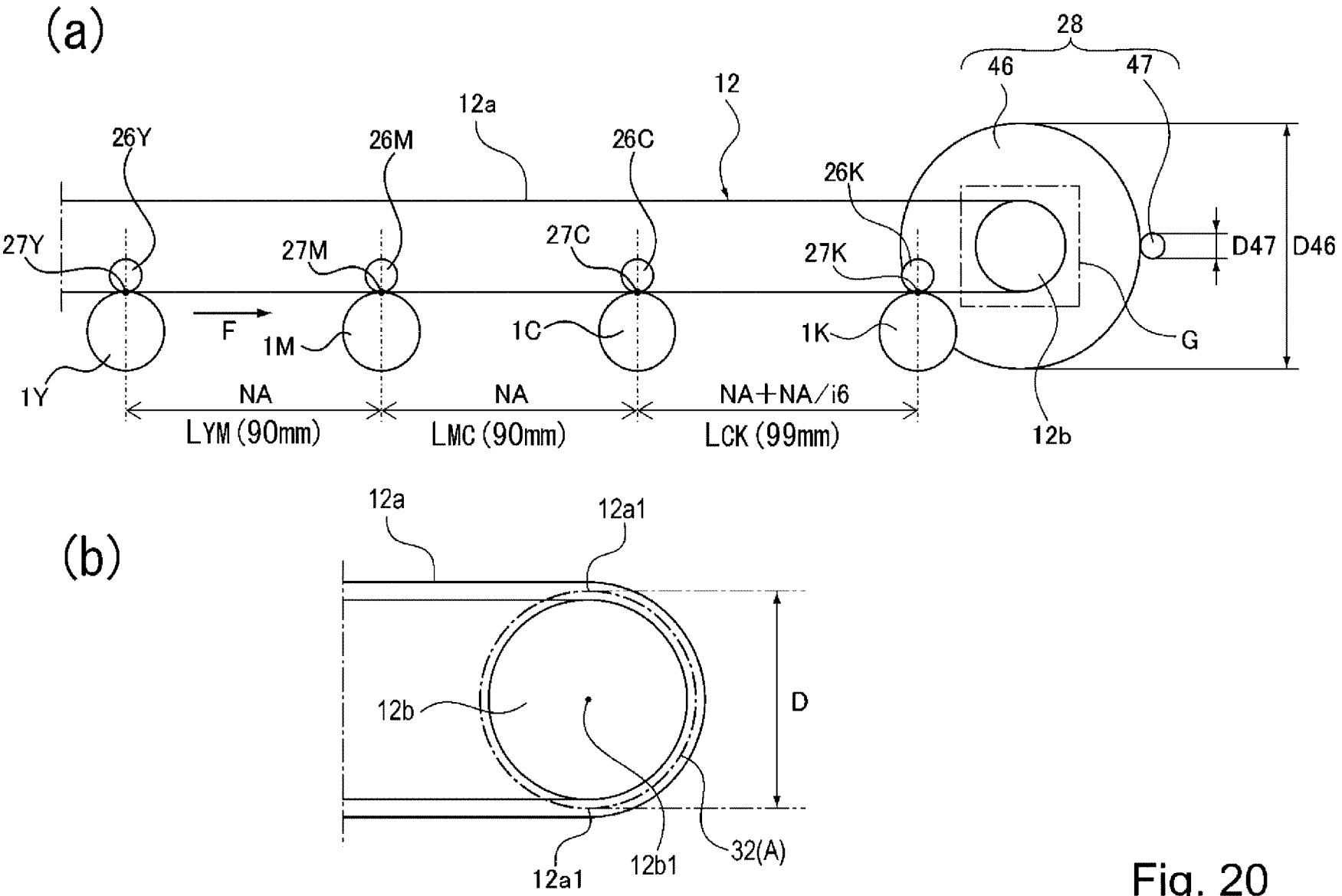

Part (a) of FIG. 20 is a sectional view showing a structure of a drive transmission device for the intermediary transfer belt in a sixth embodiment, and part (b) of FIG. 20 is an enlarged view of a portion G shown in part (a) of FIG. 20.

Figure 21:
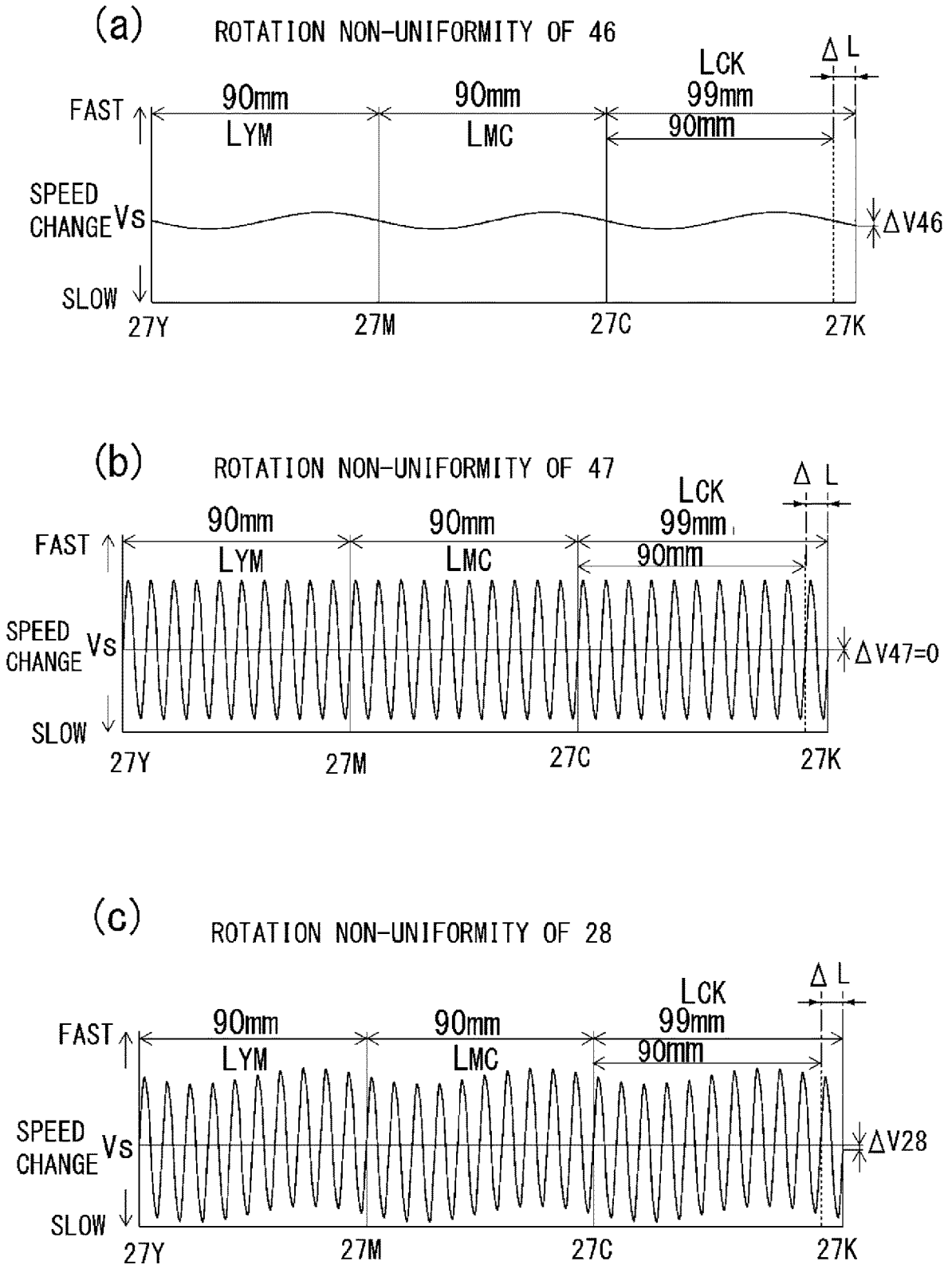

Part (a) of FIG. 21 is an illustration of a relationship between rotation non-uniformity of a rotatable roller alone for a driving roller gear and each transfer position in the sixth embodiment, part (b) of FIG. 21 is an illustration of a relationship between rotation non-uniformity of a motor roller alone and each transfer position in the sixth embodiment, and part (c) of FIG. 21 is an illustration of a relationship between rotation non-uniformity of an entire drive transmission device and each transfer position in the sixth embodiment.

FIG. 22 is a view showing inter-transfer-position distances between colors, a distance of movement of a predetermined position of a center of the intermediary transfer belt with respect to a thickness direction when a driving roller rotates one-full circumference, an outer diameter of the rotatable roller for the driving roller, an outer diameter of the motor roller, a transmission ratio and the number of rotations of the driving roller during movement of the intermediary transfer belt in the inter-transfer-position distance in the sixth embodiment.

DESCRIPTION OF EMBODIMENTS

Embodiments of an image forming apparatus according to the present invention will be described with reference to the drawings.

First Embodiment

A structure of an image forming apparatus 100 according to the present invention in a first embodiment will be described with reference to FIGS. 1 to 5.

<Image Forming Apparatus>

Figure 1:
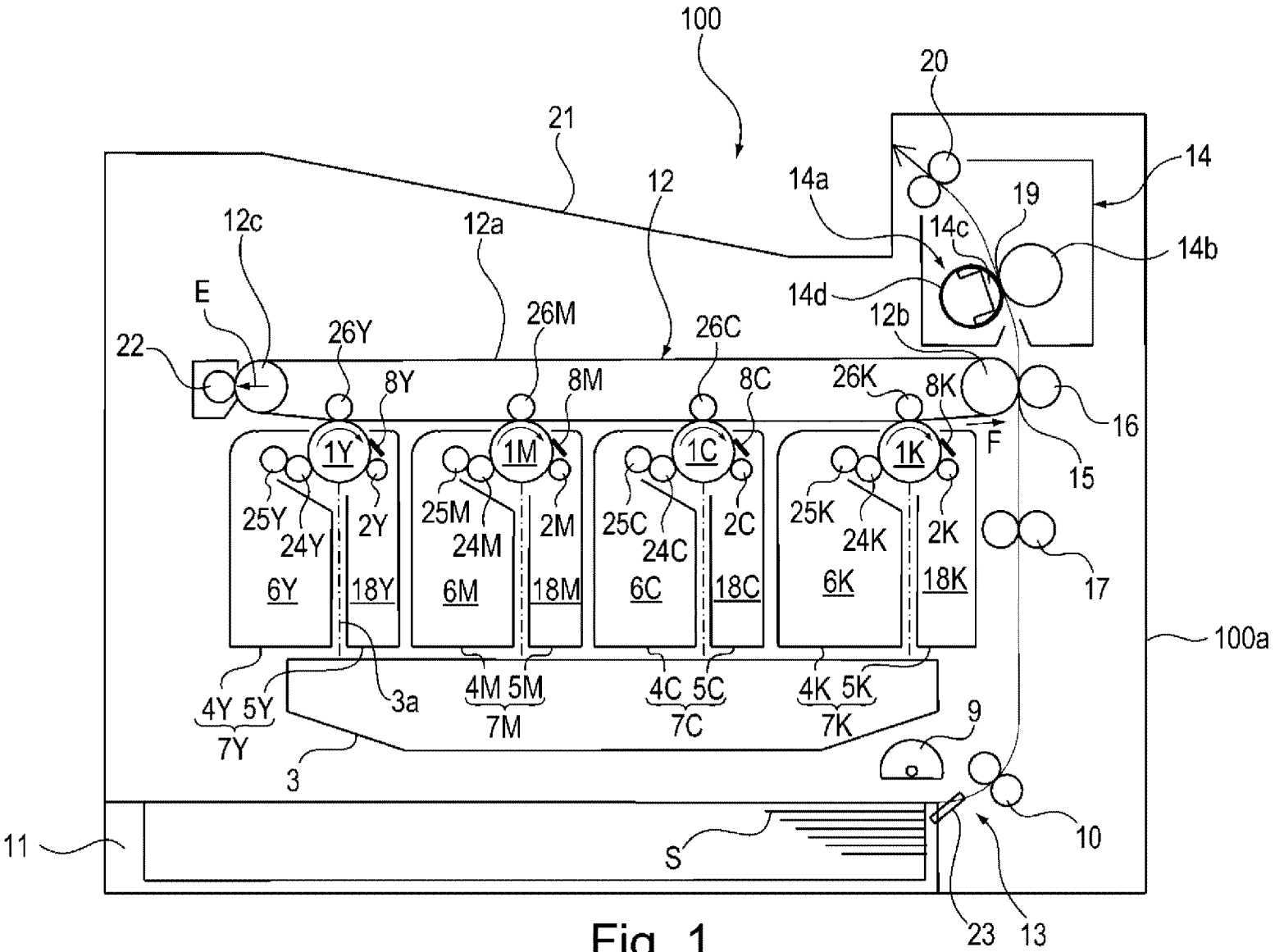
FIG. 1 is a sectional view showing a structure of an image form provided with an intermediary transfer belt.

The structure of the image forming apparatus 100 including an intermediary transfer belt 12*a* will be described. FIG. 1 is a sectional view showing the structure of the image forming apparatus 100 including the intermediary transfer belt 12*a*. The image forming apparatus 100 is an example of a color laser printer. The image forming apparatus 100 shown in FIG. 1 includes four (plurality of) photosensitive drums 1Y, 1M, 1C and 1K as image bearing members corresponding to colors of yellow (Y), magenta (M), cyan (C) and black (K), respectively. Incidentally, for convenience of explanation, description is made using the photosensitive drum 1 representing the photosensitive drums 1Y, 1M, 1C and 1K in some cases. This is true for other image forming process means.

Each photosensitive drum 1 is rotationally driven in a clockwise direction of FIG. 1. At a periphery of the photosensitive drum 1, in the order along the clockwise direction of FIG. 1, a charging roller 2 as a charging means for electrically charging a surface of the photosensitive drum 1 uniformly and a laser scanner 3 as an exposure means for forming an electrostatic latent image on the surface of the photosensitive drum 1 by irradiating the uniformly charged surface of the photosensitive drum 1 with laser light 3*a* on the basis of image information of the associated color are provided.

Further, at the periphery of the photosensitive drum 1, a developing unit as a developing means for visualizing (developing) the electrostatic latent image into a toner image as a developer image by depositing toner as a developer on the electrostatic latent image formed on the surface of the photosensitive drum 1, and a primary transfer roller 26 as a primary transfer means for primary transferring the toner image, formed on the photosensitive drum 1, onto an outer peripheral surface of the intermediary transfer belt 12*a* as an intermediary transfer member are provided. The intermediary transfer belt 12*a* is constituted as a belt for transferring the toner image as the developer image from the surface of the photosensitive drum 1 as the image bearing member onto a recording material S such as paper.

Further, at the periphery of the photosensitive drum 1, a cleaning blade 8 as a cleaning means for removing residual toner remaining on the surface of the photosensitive drum 1 after the primary transfer is provided. The residual toner removed by the cleaning blade 8 is collected by a residual toner container 18 provided in a cleaning unit 5.

The photosensitive drum 1, the charging roller 2, the developing unit 4 and the cleaning blade 8 are integrally assembled into a cartridge as a process cartridge 7. The process cartridge is constituted so as to be mountable in and dismountable from an apparatus main assembly 100*a* of the image forming apparatus 100. The process cartridge 7 is constituted by the developing unit 4 and the cleaning unit 5.

The four process cartridges 7 have the substantially same structure but are different from each other in that images are formed with toners of respective colors of yellow Y, magenta M, cyan C and black K. Further, a toner container 6K provided in the developing unit 4K of the process cartridge 7K for the black K is subjected to printing of a text image in many instances. For this reason, the toner container 6K is larger than toner containers 6Y, 6M, 6C provided in the developing units 4Y, 4M and 4C of the process cartridges 7Y, 7M and 7K for yellow Y, magenta Y, magenta M and cyan C, respectively. As a result, the toner in a large volume can be accommodated in the toner container 6K for the black K, so that there is no need to frequently exchange only the process cartridge 7K for the black K.

Each developing unit 4 includes a developing roller 24, a developer application roller 25 and the toner container 6. On the other hand, each cleaning unit 5 includes the photosensitive drum 1, the charging roller 2, the cleaning blade 8 and the residual toner container 18.

The photosensitive drum 1 is prepared by coating an organic photoconductor (OPC) layer containing an OPC (organic photo-semiconductor) on an outer peripheral surface of an aluminum cylinder. The photosensitive drum 1 is rotatably supported by flanges at opposite end portions thereof. To one end portion, a driving force from a motor as an unshown driving source is transmitted, whereby the photosensitive drum 1 is rotationally driven in the clockwise direction of FIG. 1. The laser scanner 3 is disposed vertically below the process cartridge 7 and exposes to light the uniformly charged surface of the photosensitive drum 1 on the basis of an image signal.

The developing unit 4 includes the toner container in which the toner of the associated color is accommodated. The developing roller 24 as a developer carrying member opposes the surface of the photosensitive drum 1 and is rotationally driven by an unshown driving portion. Then, by an unshown developing bias voltage source, a developing bias voltage is applied to the developing roller 24. As a result, the toner of the associated color carried on the surface of the developing roller 24 is supplied to the electrostatic latent image formed on the surface of the photosensitive drum 1, so that the electrostatic latent image is developed as the toner image.

The surface of the photosensitive drum 1 is, after being electrically charged to a predetermined negative potential by the charging roller 2, irradiated with the laser light 3*a* emitted from the laser scanner 3, so that the electrostatic latent image is formed. On this electrostatic latent image, toner of the negative polarity is deposited by reverse development by the developing roller 24 of the developing unit 4, so that the toner image of the associated color is formed.

<Intermediary Transfer Unit>

The intermediary transfer unit 12 includes the intermediary transfer belt 12*a* which is an endless belt. The intermediary transfer unit 12 further includes a driving roller 12*b* as a rotatable driving member for rotationally driving the intermediary transfer belt 12*a* and a tension roller 12*c* as a rotatable tension member for generating tension in the intermediary transfer belt 12*a* for generating a frictional force between the driving roller 12*b* and the intermediary transfer belt 12*a*.

The intermediary transfer belt 12*a* is rotatably stretched in an arrow F direction of FIG. 1 by the driving roller 12*b* as the rotatable driving member and the tension roller 12*c* as the rotatable tension member. The driving roller 12*b* as the rotatable driving member transmits a rotational driving force to the intermediary transfer belt 12*a*. The tension roller 12*c* applies tension to the intermediary transfer belt 12*a* in an arrow E direction of FIG. 1.

The photosensitive drums 1Y, 1M, 1C and 1K are provided opposed to an outer peripheral surface of the intermediary transfer belt 12*a*. The photosensitive drums 1Y and 1M are constituted as first and second image bearing members. The photosensitive drums 1M and 1C are also constituted as first and second image bearing members. The photosensitive drums 1C and 1K are constituted as second and third image bearing members.

Here, the photosensitive drum 1M shown in part (a) of FIG. 2 is the first image bearing member. The photosensitive drum 1C is the second image bearing member. The photosensitive drum 1K is the third image bearing member. Incidentally, an arrangement order of the photosensitive drums of the respective colors is not limited thereto, but may also be appropriately changed.

On an inner peripheral surface side of the intermediary transfer belt 12*a*, the primary transfer rollers 26 are provided opposed to the photosensitive drums 1, respectively. Each of primary transfer positions 27 is formed by an outer peripheral surface of the intermediary transfer belt 12*a* and the surface of the associate photosensitive drum 1. The primary transfer positions 27Y and 27M are constituted as first and second transfer positions. The primary transfer positions 27M and 27C are also constituted as the first and second transfer positions. The primary transfer positions 27C and 27K are constituted as second and third transfer positions. Here, the primary transfer position 27M shown in part (a) of FIG. 2 is the first transfer position. The primary transfer position 27C is the second transfer position. The primary transfer position 27K is the third transfer position.

To each of the primary transfer rollers 26, a primary transfer bias is applied from an unshown primary transfer bias voltage source. Each photosensitive drum 1 is rotated in the clockwise direction of FIG. 1, and the intermediary transfer belt 12*a* is rotated in the arrow F direction of FIG. 1, and further, the primary transfer bias of a positive polarity is applied to each primary transfer roller 26.

As a result, the toner images formed on the surfaces of the photosensitive drums 1 are primary-transferred from the photosensitive drums 1 onto the outer peripheral surface of the intermediary transfer belt 12*a* successively from the toner image formed on the photosensitive drum 1Y for the yellow Y. Then, in a state in which the four color toner images are superposed, the toner images are fed to a secondary transfer portion 15 formed by a nip between the outer peripheral surface of the intermediary transfer belt 12*a* and the secondary transfer roller 16 as a secondary transfer means.

At a lower portion of the image forming apparatus 100, a feeding portion 13 for feeding the recording material S is provided. At the feeding portion 13, a feeding cassette 11 for accommodating the recording material S is provided. The feeding cassette 11 is constituted so as to be capable of being pulled toward the front side of FIG. 1 and thus demounted from the apparatus main assembly 100*a*, and thereafter, the recording material S is set in the feeding cassette 11 and then the feeding cassette 11 is inserted into the apparatus main assembly 100*a* of the image forming apparatus 100, so that supply of the recording material S is completed.

The recording material S accommodated in the feeding cassette 11 is press-contacted to and fed by the feeding belt 9 and is separated one by one and to fed by a separation pad 23. Thereafter, a leading end of the recording material S is nipped and fed by a feeding roller pair 10 and is abutted against a nip of a registration roller pair 17 which is at rest, so that oblique movement of the recording material S is corrected.

Thereafter, synchronism with timing at which the recording material S is nipped and fed by the registration roller pair 17 to the secondary transfer portion 15 in a leading end of the toner image carried on the outer peripheral surface of the intermediary transfer belt 12*a* reaches the secondary transfer portion 15. From an unshown secondary transfer bias voltage source, a secondary transfer bias is applied to the secondary transfer roller 16, so that at the secondary transfer portion 15, the toner images superposed on the outer peripheral surface of the intermediary transfer belt 12*a* are collectively secondary-transferred onto the recording material S. Residual toner remaining on the outer peripheral surface of the intermediary transfer belt 12*a* after the secondary transfer is removed by a cleaner 22 as a cleaning means. The removed residual toner passes through an unshown residual toner feeding path and is collected in an unshown residual toner collecting container provided on a rear side of the image forming apparatus 100.

On a side downstream of the secondary transfer portion 15, a fixing device 14 as a fixing means is provided. The fixing device 14 thermally fixes the toner images, secondary transferred on the recording material S under application of heat and pressure. The fixing device 14 includes a heating unit 14*a* and a pressing roller 14*b*. The heating unit 14*a* includes a cylindrical fixing belt 14*d* rotatable around an outer periphery of a guiding member 14*c*. The guiding member 14*c* is provided with an unshown heater as a heating source at a position opposing the fixing belt 14*d*. The pressing roller 14*b* has elasticity and forms a fixing nip 19 with a predetermined pressure and a predetermined width in cooperation with the unshown heater provided to the guiding member 14*c* through the fixing belt 14*d*.

The pressing roller 14*b* is rotationally driven in the clockwise direction of FIG. 1 by an unshown motor as a driving source. As a result, the fixing belt 14*d* is rotated in the counterclockwise direction of FIG. 1 by the pressing roller 14*b*. Then, the fixing belt 14*d* is heated by the unshown heater provided to the guiding member 14*c*.

In a state in which the fixing nip 19 is heated to a predetermined temperature and is temperature-controlled, the recording material S on which the unfixed toner image is formed reaches the fixing nip 19. At this time, the recording material S is guided into the fixing nip 19 while the unfix toner image side opposes the fixing belt 14*d* side. Then, in the fixing nip 19, the recording material S is nipped and fed by the fixing belt 14*d* and the pressing roller 14*b* in a state in which the unfixed toner image is in intimate contact with the outer peripheral surface of the fixing belt 14*d*.

In a process in which the recording material S is nipped and fed together with the fixing belt 14*d* through the fixing nip 19, the unfixed toner image is heated by heat of the unshown heater provided to the guiding member 14*c* and is thermally fixed on the recording material S. The recording material S on which the toner image is thermally fixed is nipped and fed by a discharging roller pair 20 and thus is discharged onto a discharge tray 21.

<Drive Transmission Device of Intermediary Transfer Unit>

Next, a structure of a drive transmission device 28 of the intermediary transfer unit 12 will be described using FIG. 2. Part (a) of FIG. 2 is a sectional view showing the structure of the drive transmission device 28 of the intermediary transfer unit 12, and part (b) of FIG. 2 is an enlarged view of a part G shown in part (a) of FIG. 2. The drive transmission device 28 shown in FIG. 2 includes the driving roller 12*b* as the rotatable driving member for rotatably stretching the intermediary transfer belt 12*a* and includes a driving roller gear 29 as a first drive transmission member provided coaxially and integrally with the driving roller 12*b*.

Further, the drive transmission device 28 includes a motor gear 30 as a second drive transmission member provided integrally on a drive shaft of an unshown motor as a driving source. The motor gear 30 as the second drive transmission member is provided upstream (on a motor side) of the driving roller 29 in order to transmit a rotational driving force from the unshown motor as the driving source to the driving roller gear 29 as the first drive transmission member with respect to a drive transmission direction.

Each of the driving roller gear 29 as the first drive transmission member and the motor gear 30 as the second drive transmission member is constituted by a gear. The driving roller gear 29 is engaged with the motor gear 30, and a rotational driving force from the unshown motor as the driving source is transmitted from the motor gear 30 to the driving roller gear 29, so that the driving roller 12*b* is rotated. The driving roller gear 29 as the first drive transmission member rotates the driving roller 12*b* as the rotatable driving member. Here, the number of teeth of the driving roller gear 29 is Z1. Further, the number of teeth of the motor gear 30 is Z2. For that reason, a transmission ratio i between the driving roller gear 29 and the motor gear 30 is represented by the following formula 1.

$$i=Z1/Z2 \quad \text{(formula 1)}$$

There are a plurality of primary transfer positions 27 where the photosensitive drums as the plurality of image bearing members oppose the intermediary transfer belt 12*a*. Here, as shown in part (a) of FIG. 2, a first inter-transfer-position distance (interval) between the primary transfer position 27Y for the yellow Y and the primary transfer position 27M for the magenta M which are provided adjacent to each other along the intermediary transfer belt 12*a* is referred to as an inter-transfer-position distance (interval) $L_{YM}$.

Further, as shown in part (a) of FIG. 2, the primary transfer position 27M for the magenta M as the first transfer position provided adjacent to the primary transfer position 27Y along the intermediary transfer belt 12*a* is considered. Further, the primary transfer position 27C for the cyan C as the second transfer position is considered. The first inter-transfer-position distance between the primary transfer position 27M and the primary transfer position 27C is referred to as an inter-transfer-position distance $L_{MC}$. Further, the second inter-transfer-position distance between the primary transfer position 27C for the cyan C as the second transfer position provided adjacent to the primary transfer position 27M along the intermediary transfer belt 12*a* and the primary transfer position 27K for the black K as a third transfer position is referred to as an inter-transfer-position distance $L_{CK}$.

In this embodiment, the inter-transfer-position distance $L_{YM}$ and the inter-transfer-position distance $L_{MC}$ are the first inter-transfer-position distances. The inter-transfer-position distance $L_{YM}$ and the inter-transfer-position distance $L_{MC}$ are set at the same inter-transfer-position distance. Further, in this embodiment, the inter-transfer-position distance $L_{CK}$ is the second inter-transfer-position distance. Further, in this embodiment, the inter-transfer-position distance $L_{CK}$ is the second inter-transfer-position distance. The first inter-transfer-position distance and the second inter-transfer-position distance are the inter-transfer-position distances different from each other.

A constitution in which the driving roller 12*b* is rotated through N full circumferences (N: integer) during movement of a predetermined position on the intermediary transfer belt 12*a* in the inter-transfer-position distance $L_{YM}$ or $L_{MC}$ will be described. Here, rotation of the driving roller 12*b* through the N full circumferences means rotation of the driving roller gear 12*b* in a distance corresponding to an angle of rotation of 360° (which is an angle corresponding to one-full circumference of the driving roller 12*b*)×N times (N: integer (integral number)). A distance of movement of a predetermined position of a center 12*a*1 of the intermediary transfer belt 12*a* with respect to a thickness direction when the driving roller 12*b* as the rotatable driving member rotates through one-full circumference is A. In this embodiment, a circumference of a circle 32 indicated by a chain line in part (b) of FIG. 2 is the distance A.

The number of rotations (revolutions) of the driving roller 12*b* during movement of the predetermined position of the intermediary transfer belt 12*a* in the inter-transfer-position distance $L_{YM}$ or $L_{MC}$ as the first inter-transfer-position distance is N (N: integer). At this time, the inter-transfer-position distances $L_{YM}$ and $L_{MC}$ are set to satisfy a relationship of the following formula 2.

$$L_{YM}=L_{MC}=N\times A \quad \text{(formula 2)}$$

The transmission ratio i (=Z1/Z2) between the driving roller gear 29 as the first drive transmission member and the motor gear 30 as the second drive transmission member will be considered. Then, the inter-transfer-position distance $L_{CK}$ as the second inter-transfer-position distance is set at a relationship of the following formula 3.

$$L_{CK}=N\times A\pm N\times A/i \quad \text{(formula 3)}$$

As described above, the inter-transfer-position distances $L_{YM}$ and $L_{MC}$ as the first inter-transfer-position distances and the inter-transfer-position distance $L_{CK}$ as the second inter-transfer-position distance are set. Further, the transmission ratio i (=Z1/Z2) between the driving roller gear 29 as the first drive transmission member and the motor gear 30 as the second drive transmission member is set. As a result, even in a constitution in which the inter-transfer-position distances L among the primary transfer positions 27 for the respective colors which are adjacent to each other along the intermediary transfer belt 12*a* are different from each other, color misregistration of entirety of the image forming apparatus 100 can be suppressed.

A mechanism for suppressing the color misregistration of the entirety of the image forming apparatus 100 by setting specific numerical values in the drive transmission device 28 for driving the intermediary transfer belt 12*a* will be described using FIG. 2. Each of the inter-transfer-position distances $L_{YM}$ and $L_{MC}$ as the first inter-transfer-position distances shown in part (a) of FIG. 2 is set at 90 mm. On the other hand, the inter-transfer-position distance $L_{CK}$ as the second inter-transfer-position distance is set at 99 mm. In this embodiment, an example, in which of the different inter-transfer-position distances L, the inter-transfer-position distances for which the number of equal inter-transfer-position distances L is large are set at the first inter-transfer-position distance L1, and the inter-transfer-position distance for which the number of equal inter-transfer-position distances L is small is set at the second inter-transfer-position distance L2, is described.

A diameter of the driving roller 12*b* in this embodiment is 28.5479 mm, and a thickness of the intermediary transfer belt 12*a* is set at 0.1 mm. In a state in which the intermediary transfer belt 12*a* is stretched on the outer peripheral surface of the driving roller 12*b*, a diameter D of the intermediary transfer belt 12*a* with respect to a thickness direction at opposite center positions 12*a*1 between which the diameter passes through a center 12*a*1 will be considered. This diameter D is represented by the following formula 4 by using the diameter (28.5479 mm) of the driving roller 12*b* and 0.1 mm which is twice one-half (½) of 0.1 mm which is the thickness of the intermediary transfer belt 12*a*.

$$D=28.5479+0.1\text{ mm}=28.6429\text{ mm} \quad \text{(formula 4)}$$

Here, a surface A of movement of a predetermined position of the center 12*a*1 of the intermediary transfer belt 12*a* with respect to the thickness direction when the driving roller 12*b* as the rotatable driving member rotates through one-full circumference is represented by the following formula 5.

$$A=28.6479\text{ mm}\times\pi\times\text{one rotation}\approx 90\text{ mm} \quad \text{(formula 5)}$$

Here, the distance A of movement of the predetermined position of the center 12 of the intermediary transfer belt 12*a* with respect to the thickness direction when the driving roller 12*b* as the rotatable driving member rotates through one-full circumference will be considered. The distance A corresponds to a peripheral (circumferential) length of the circle 32 which is drawn along the thickness center 12*a*1 of the intermediary transfer belt 12*a* wound around the driving roller 12*b* and which has a center coinciding with the rotation center 12*b*1 of the driving roller 12*b*. The driving roller 12*b* rotates through one-full circumference during movement of the predetermined position on the intermediary transfer belt 12*a*, rotating in an arrow F direction of part (a) of FIG. 2, from the primary transfer position 27Y for the yellow Y to the primary transfer position 27M for the magenta M. Similarly, the driving roller 12*b* rotates through one-full circumference during movement of the predetermined position on the intermediary transfer belt 12*a* from the primary transfer position 27M for the magenta M to the primary transfer position 27C for the cyan C.

On the other hand, the inter-transfer-position distance $L_{CK}$ as the second inter-transfer-position distance is set at 99 mm. For this reason, during movement of the predetermined position of the intermediary transfer belt 12*a*, rotating in the arrow F direction of part (a) of FIG. 2, from the primary transfer position 27C for the cyan C to the primary transfer position 27K for the black K, the driving roller 12*b* rotates through 1.1 full circumference (=99 mm/90 mm).

Here, the number of teeth Z1 of the driving roller gear 29 provided in the drive transmission device 28 is set at 150 teeth, and the number of teeth Z2 of the motor gear 30 is set at 15 teeth. For this reason, the transmission ratio i (=Z1/Z2) of the drive transmission device 28 is 10 (=150 teeth/15 teeth).

As described above, during movement of the predetermined position on the intermediary transfer belt 12*a* in each of the inter-transfer-position distance $L_{YM}$ or $L_M$C, the driving roller gear 29 rotatable integrally with the driving roller 12*b* rotates through 1-full circumference. The motor gear 30 engaging with the driving roller gear 29 is set at "10" in terms of the transmission ratio i. For this reason, when the driving roller gear 29 rotates through 1-full circumference, the motor gear 30 rotates through 10-full circumferences.

Further, during movement of the predetermined position on the intermediary transfer belt 12*a* in the inter-transfer-position distance $L_{CK}$ (99 mm), each of the driving roller 12*b* and the driving roller gear 29 rotates through 1.1-full circumferences, and the motor gear 30 rotates through 11-full circumferences (1.1-full circumferences×10). At this time, the motor gear 30 rotates the integral number of times. Thus, the motor gear 30 rotates an integral number of times.

<Rotation Non-Uniformity of Drive Transmission Device>

Next, rotation non-uniformity of the drive transmission device 28 will be described using FIG. 3. Part (a) of FIG. 3 is an illustration of a relationship between rotation non-uniformity of the driving roller gear 29 alone and each primary transfer position 27 in this embodiment. It is assumed that the motor gear 30 shown in FIG. 2 is ideally constituted, rotation of the unshown motor provided to the motor gear 30 is also ideally made, the driving roller 12*b* is ideally constituted with no eccentricity, and other constituent elements are also ideally constituted. At this time, a graph shown in part (a) of FIG. 3 shows a rotational speed fluctuation of the center 12*a*1 of the intermediary transfer belt 12*a* with respect to the thickness direction when only the driving roller gear 29 is eccentric. Vs as the ordinate shows an ideal predetermined speed of the center 12*a*1 of the intermediary transfer belt 12*a* with respect to the thickness direction.

A rotational speed fluctuation difference ΔV29 indicated in part (a) of FIG. 3 is a rotational speed fluctuation difference of the center 12*a*1 of the intermediary transfer belt 12*a* with respect to the thickness direction at the primary transfer position 27K for the black K when only the driving roller gear 29 is eccentric in an eccentric amount of 33 μm. At this time, the driving roller gear 29 does not rotate an integral number of times, and therefore, the rotational speed fluctuation difference 429 occurs.

Part (b) of FIG. 3 is an illustration of a relationship between rotation non-uniformity of the motor gear 30 alone and each primary transfer position 27 in this embodiment. It is assumed that the driving roller gear 29 shown in FIG. 2 is ideally constituted, rotation of the unshown motor provided to the motor gear 30 is also ideally made, the driving roller 12*b* is ideally constituted with no eccentricity, and other constituent elements are also ideally constituted. At this time, a graph shown in part (b) of FIG. 3 shows rotational speed fluctuation of the center 12*a*1 of the intermediary transfer belt 12*a* with respect to the thickness direction when only the motor gear 30 is eccentric in an eccentric amount of 30 μm.

As shown in part (a) of FIG. 2, a radius of the driving roller 29 is larger than a radius of the motor gear 30. When the radius of the gear is large, a rotational speed fluctuation of the gear is small.

Here, a rotational speed fluctuation of the center 12*a*1 of the intermediary transfer belt 12*a* with respect to the thickness direction when only the driving roller gear 29 shown in part (a) of FIG. 3 is eccentric will be considered. Further, the rotational speed fluctuation of the center 12*a*1 of the intermediary transfer belt 12*a*1 with respect to the thickness direction when only the driving roller gear 29 shown in part (a) of FIG. 3 is eccentric will be considered. The rotational speed fluctuation of the driving roller gear 29 shown in part (a) of FIG. 3 is smaller than the rotational speed fluctuation of the motor gear 30 shown in part (b) of FIG. 3.

A rotational speed fluctuation difference of the center 12*a*1 of the intermediary transfer belt 12*a* with respect to the thickness direction at the primary transfer position 27K for the black K when only the motor gear 30 is eccentric is indicated by ΔV30. The motor gear 30 rotates an integral number of times, and therefore, the rotational speed fluctuation difference Δ30=0 holds.

Part (c) of FIG. 3 is an illustration of a relationship between rotation non-uniformity of entirety of the drive transmission device 29 and each primary transfer position in this embodiment. A graph shown in part (c) of FIG. 3 shows a rotational speed fluctuation of the center 12*a*1 of the intermediary transfer belt 12*a* with respect to the thickness direction when the graphs of parts (a) and (b) of FIG. 3 are combined with each other. A rotational speed fluctuation ΔV29 of the center 12*a*1 of the intermediary transfer belt 12*a* with respect to the thickness direction at the primary transfer position 27K for the black K in the entirety of the drive transmission device 29 providing the graph obtained by combining the graphs of parts (a) and (b) with each other satisfies ΔV28=ΔV29+&V&V30. In this embodiment ΔV30=0 and therefore ΔV28=ΔV29 holds.

In general, as regards the gear, rotation non-uniformity occurs in one rotational cycle (cyclic period) of the gear due to a deviation (eccentricity) between a center of a reference (pitch) circle of the gear and an actual rotation shaft of the gear. Accordingly, different degrees of the rotation non-uniformity of the driving roller gear 29 and the motor gear 30 occur. Here, the rotation non-uniformity is each of the rotational speed fluctuation amounts (peak-to-peak values) in the ordinate of sine waves shown in parts (a) to (c) of FIG. 3.

Gear accuracy is determined by JIS. The motor gear 30 and the driving roller gear 29 are prepared by subjecting a resin material to injection molding. For this reason, the motor gear 30 and the driving roller gear 29 are manufactured on the basis of JIS-N-10 class standards. In the JIS, the eccentric amount of the gear is standardized depending on a module and a reference circle diameter of the gear. Here, the eccentric amount refers to entire engagement error of both tooth surfaces.

For example, when the predetermined position on the intermediary transfer belt 12*a* reaches the primary transfer position 27K for the black K, it would be also considered that a waveform of the rotational speed fluctuation of the driving roller gear 29 shown in part (a) of FIG. 3 is aligned with a phase of an ideal predetermined speed Vs on the ordinate. However, in actuality, a rotation phase of the gear fluctuates during manufacturing. In a manufacturing process of a product, there arises a problem such that it takes excessive time to measure and adjust the rotation phase of the gear and thus-mass productivity lowers.

<Rotation Non-Uniformity of Gears at Primary Transfer Positions for Yellow, Magenta and Cyan>

<Rotation Non-Uniformity of Driving Roller Gear Alone>

The driving roller gear 29 rotates integrally with the driving roller gear 12*b* through one-full circumference during movement of the predetermined position on the intermediary transfer belt 12*a* in each of the inter-transfer-position distances $L_{YM}$ and $L_{MC}$. For that reason, as shown in part (a) of FIG. 3, the driving roller gear 29 is capable of rotating at the same phase and with fluctuation in the same amplitude at the primary transfer positions 27Y, 27M and 27K for the yellow Y, the magenta M and the cyan C. As a result, the rotation speed fluctuation of the driving roller gear 29 can be made the same among the yellow Y, the magenta M and the cyan C.

<Rotation Non-Uniformity of Motor Gear Alone>

As described above, the motor gear 30 rotates through 10-full circumferences during movement of the predetermined position on the intermediary transfer belt 12*a* in each of the inter-transfer-position distances $L_{YM}$ and $L_{MC}$. At this time, as shown in part (b) of FIG. 3, the driving roller gear 29 is capable of rotating at the same phase and with fluctuation in the same amplitude at the primary transfer positions 27Y, 27M and 27K for the yellow Y, the magenta M and the cyan C. As a result, the rotation speed fluctuation of the motor gear 30 can be made the same among the yellow Y, the magenta M and the cyan C.

The rotation speed fluctuation of the entirety of the drive transmission device 28 shown in part (c) of FIG. 3 is obtained by combining the rotation speed fluctuation of the driving roller gear 29 shown in part (a) of FIG. 3 and the rotation speed fluctuation of the motor gear 30 shown in part (b) of FIG. 3 with each other. As a result, the rotation speed fluctuation of the entirety of the drive transmission device 28 shown in part (c) of FIG. 3 can be made the same at the primary transfer positions 27Y, 27M and 27C for the yellow Y, the magenta M and the cyan C, respectively. For this reason, there is no occurrence of the color misregistration among the yellow Y, the magenta M and the cyan Y.

<Rotation Non-Uniformity of Each Gear at Primary Transfer Position for Black>

<Rotation Non-Uniformity of Driving Roller Gear Alone>

As described above, the inter-transfer-position distance $L_{CK}$ is 99 mm. The inter-transfer-position distances $L_{YM}$ and $L_{MC}$ are each of 90 mm. For that reason, as shown in part (a) of FIG. 3, the driving roller gear 29 rotates through 1.1-full circumference during movement of the predetermined position on the intermediary transfer belt 12*a* in the inter-transfer-position distance $L_{CK}$, and therefore, the driving roller gear 29 does not rotate the integral number of times.

For this reason, as regards the driving roller gear 29, a rotation speed fluctuation difference ΔV29 occurs between the primary transfer position 27K for the black K and each of other primary transfer positions 27Y, 27M and 27C for the yellow Y, the magenta M and the cyan C. Here, the rotation speed fluctuation difference 429 is a rotation speed fluctuation difference of the center 12*a*1 of the intermediary transfer belt 12*a* with respect to the thickness direction at the primary transfer position 27K for the black K when only the driving roller gear 29 is eccentric. For this reason, as regards the driving roller gear 29, between the primary transfer position 27K for the black K and each of other primary transfer positions 27Y, 27M and 27C for the yellow Y, the magenta M and the cyan C, degrees of the rotation non-uniformity cannot be adjusted to a fluctuation with the same phase and the same amplitude.

As a result, due to the rotation non-uniformity of the driving roller gear 29, the rotation speed fluctuation cannot be made the same between the black K and each of other colors of the yellow Y, the magenta M and the cyan C. As a result, the color misregistration occurs between the black K and each of other colors of the yellow Y, the magenta M and the cyan C.

<Rotation Non-Uniformity of Motor Gear Alone>

The motor gear 30 rotates through 11-full circumferences during movement of the predetermined position on the intermediary transfer belt 12*a* in the inter-transfer-position distance $L_{CK}$. For this reason, the color misregistration due to the rotation non-uniformity of the motor gear 30 does not occur between the black K and each of other colors of the yellow Y, the magenta M and the cyan C. That is, during movement of the predetermined position on the intermediary transfer belt 12*a* in the inter-transfer-position distance $L_{OK}$, the color misregistration due to the rotation non-uniformity of the driving roller gear 29 shown in part (a) of FIG. 3 occurs, but the color misregistration due to the rotation non-uniformity of the motor gear 30 shown in part (b) of FIG. 3 does not occur.

The driving roller gear 29 rotates through 1.1-full circumference during movement of the predetermined position on the intermediary transfer belt 12*a* in the inter-transfer-position distance $L_{CK}$ as the second inter-transfer-position distance. On the other hand, the driving roller gear 29 rotates through one-full circumference during movement of the predetermined position on the intermediary transfer belt 12*a* in each of the inter-transfer-position distances $L_{YM}$ and $L_{MC}$ as the first inter-transfer-position distances. A deviation therebetween is 0.1 circumference rotation (=1.1 circumference rotation−1 circumference rotation).

Here, it is assumed that the gear accuracy of the driving roller gear 29 is set at accuracy of about JIS-N-10-class. At that time, when a color misregistration amount due to the rotation non-uniformity of the driving roller gear 29 is calculated from a standardized value of a cumulative pitch error of the gear, the resultant color misregistration amount is about 8 μm or less. The rotation speed fluctuation of the intermediary transfer belt 12*a* occurs due to accumulation of various error factors in addition to the gear accuracy. With the factors of the color misregistration in the entirety of the image forming apparatus 100, various factors such as a positional tolerance occurring due to mass-production, positional deviations of constituent component parts due to a fluctuation in use environment, a durability factor and the like are complicatedly associated.

For example, the photosensitive drum 1 and the intermediary transfer belt 12*a* are rotationally driven by separate driving sources. For this reason, when a speed difference generates between the photosensitive drum 1 and the intermediary transfer belt 12*a*, a slip occurs between the photosensitive drum 1 and the intermediary transfer belt 12*a*, so that the rotational speed of the intermediary transfer belt 12*a* changes. Further, a state in which the toner image is carried on the photosensitive drum 1 and the intermediary transfer belt 12*a* and a state in which the toner image is not carried on the photosensitive drum 1 and the intermediary transfer belt 12*a* are considered. Between these states, a frictional force between the photosensitive drum 1 and the intermediary transfer belt 12*a* changes, so that the rotational speed of the intermediary transfer belt 12*a* changes.

Further, at the secondary transfer portion 15, a slip occurs between the intermediary transfer belt 12*a* and the recording material S nipped and fed by the registration roller pair 17 rotationally driven by separate driving sources, so that the rotational speed of the intermediary transfer belt 12*a* changes. Due to these various factors, the color misregistration amount in the entirety of the image forming apparatus 100 exceeds 100 μm, a user can recognize the color misregistration, and therefore, regards the color misregistration as an image defect. Of the color misregistration amount of 100 μm, in the entirety of the image forming apparatus 100, regarded as the image defect, the color misregistration amount due to only the drive transmission device 28 in this embodiment is 20 μm. Therefore, when the color misregistration amount due to only the drive transmission device 28 of the intermediary transfer unit 12 is less than 20 μm, even when accumulation of the error factors other than the gear accuracy is taken into consideration, the resultant color misregistration amount is smaller than the color misregistration amount of 100 μm, in the entirety of the image forming apparatus 100, which is regarded as the image defect. For this reason, it is possible to provide the image forming apparatus 100 with less color misregistration to the extent that the user cannot recognize the color misregistration.

For this reason, the rotation speed fluctuation difference Δ28 of the entirety of the drive transmission device 28 shown in part (c) of FIG. 3 can be permitted to less than 20 μm when the rotation speed fluctuation difference Δ28 is converted into the color misregistration amount. In this embodiment, the rotation speed fluctuation difference Δ28 is 8 μm when converted into the color misregistration amount. That is, by causing the color misregistration amount to fall within a range from 0 μm to less than 20 μm, it becomes possible to provide the image forming apparatus 100 with less color misregistration.

Thus, the case where the inter-transfer-position distances L each between the primary transfer positions for the colors provided according to each other along the intermediary transfer belt 12*a* are different from each other will be considered. By setting these inter-transfer-position distances L and the transmission ratio i of the drive transmission device 28 at the above-described relationships, it becomes possible to minimize the rotation speed fluctuation of the drive transmission device 28. As a result, the color misregistration in the entirety of the image forming apparatus 100 due to the rotation non-uniformity of the drive transmission device 28 can be suppressed.

<Drive Transmission Device of Intermediary Transfer Belt in Comparison Example>

Next, by using FIGS. 4 and 5, a structure of a drive transmission device 28 of an intermediary transfer belt 12*a* in a comparison example will be described. FIG. 4 is an illustration showing a difference in structure between the first embodiment and the comparison example. Part (a) of FIG. 5 is an illustration of a relationship between rotation non-uniformity of a driving roller gear 29 alone and each primary transfer position 27 in the comparison example, part (b) of FIG. 5 is an illustration of a relationship between rotation non-uniformity of a motor gear 30 alone and each primary transfer position 27 in the comparison example, and part (c) of FIG. 5 is an illustration of a relationship between rotation non-uniformity of entirety of the drive transmission device 28 and each primary transfer position 27 in the comparison example.

As shown in FIG. 4, structures of an intermediary transfer unit 12, the primary transfer positions 27 for the respective colors, and the driving roller gear 29 of the drive transmission device 28 in the comparison example are the same as those of the first embodiment. The number of teeth Z2 of the motor gear 30 in the first embodiment was "15", but the number of teeth Z2 of the motor gear 30 in the comparison example is "25", different from the number of teeth Z2 in the first embodiment. The transmission ratio i (=Z1/Z2) between the driving roller gear 29 and the motor gear 30 in the first embodiment was 10 (=150/15). The transmission ratio i (=Z1/Z2) between the driving roller gear 29 and the motor gear 30 in the comparison example is 6 (=150/25).

The structure of the intermediary transfer unit 12 in the comparison example is similar to the structure of the intermediary transfer unit 12 in the first embodiment shown in FIG. 2, and only the number of teeth of the motor gear 30 in the comparison example is different from that in the first embodiment. In the comparison example, compared with the first embodiment, the number of teeth Z2 of the motor gear 30 and the transmission ratio i (=Z1/Z2) between the driving roller gear 29 and the motor gear 30 are different.

The inter-transfer-position distance $L_{YM}$ and the inter-transfer-position distance $L_{MC}$ are set at 90 mm. The distance A in which the predetermined position of the center 12*a*1 of the intermediary transfer belt 12*a* with respect to the thickness direction moves when the driving roller 12*b* as the rotatable driving member rotates through one-full circumference is also set at 90 mm For this reason, the driving roller gear 29 rotating integrally with the driving roller 12*b* during movement of the predetermined position on the intermediary transfer belt 12*a* in each of the inter-transfer-position distance $L_{YM}$ and the inter-transfer-position distance $L_{MC}$ is set so as to rotate through one-full circumference. For this reason, the driving roller gear 29 is capable of rotating with a fluctuation of the same phase and the same amplitude at the primary transfer positions 27Y, 27M, 27C and 27K for the yellow Y, the magenta M, the cyan C and the black K.

On the other hand, the inter-transfer-position distance $L_{CK}$ is set at 99 mm. For this reason, the driving roller gear 29 rotating integrally with the driving roller 12*b* during movement of the predetermined position on the intermediary transfer belt 12*a* in the inter-transfer-position distance $L_{CK}$ rotates through 1.1-full circumference (=99 mm/90 mm).

For this reason, the driving roller gear 29 causes the rotation speed fluctuation difference ΔV 29 between the primary transfer position 27K for the black K and each of other primary transfer positions 27Y, 27M and 27C for the yellow Y, the magenta M and the cyan C. For this reason, the driving roller gear 29 cannot adjust the rotation non-uniformity to the fluctuation of the same phase and the same amplitude at the primary transfer position 27K for the black K and at other primary transfer positions 27Y, 27M and 27C for the yellow Y, the magenta M and the cyan C.

Further, when attention is paid to the rotation non-uniformity of the motor gear 30, the transmission ratio i (=Z1/Z2) between the driving roller gear 29 and the motor gear 30 is set at "6". For this reason, as shown in part (a) of FIG. 5, the motor gear 30 rotates through 6-full circumferences during movement of the predetermined position on the intermediary transfer belt 12*a* in each of the inter-transfer-position distance $L_{YM}$ and the inter-transfer-position distance $L_{MC}$. At this time, the motor gear 30 rotates the integral number of times. For this reason, the motor gear 30 is capable of rotating with a fluctuation of the same phase and the same amplitude at the primary transfer positions 27Y, 27M, 27C and 27K for the yellow Y, the magenta M, the cyan C and the black K.

However, the motor gear 30 rotates through 6.6-full circumferences (=1.1-full circumference×6) during movement of the predetermined position on the intermediary transfer belt 12*a* in the inter-transfer-position distance $L_{CK}$. At this time, the motor gear 30 does not rotate the integral number of times.

For this reason, the rotation speed fluctuation difference ΔV 30 between the primary transfer position 27K for the black K and each of other primary transfer positions 27Y, 27M and 27C for the yellow Y, the magenta M and the cyan C occurs. For this reason, the motor gear 30 cannot adjust the rotation non-uniformity to the fluctuation of the same phase and the same amplitude at the primary transfer position 27K for the black K and at other primary transfer positions 27Y, 27M and 27C for the yellow Y, the magenta M and the cyan C.

The rotation speed fluctuation of the entirety of the drive transmission device 28 shown in part (c) of FIG. 5 is obtained by combining the rotation speed fluctuation of the driving roller gear 29 shown in part (a) of FIG. 5 and the rotation speed fluctuation of the motor gear 30 shown in part (b) of FIG. 5. For this reason, the rotation speed fluctuation of the drive transmission device 28 cannot be made the same between at the primary transfer position 27K and at each of other primary transfer positions 27Y, 27M and 27C due to the rotation non-uniformity of the driving roller gear 29 and the rotation non-uniformity of the motor gear 30. As a result, as shown in part (c) of FIG. 5, the entirety of the drive transmission device 28 causes a very large rotation speed fluctuation difference ΔV28.

At this time, it is assumed that gear accuracy of each of the driving roller gear 29 and the motor gear 30 is set at accuracy of about JIS-N-10 class. At that time, when calculation is made from a standardized value of a cumulative pitch error of the gear, the color misregistration amount due to the rotation non-uniformity of the driving roller gear 29 and the rotation non-uniformity of the motor gear 30 exceeds 30 μm. The color misregistration amount in the comparison example occupies a large proportion to 100 μm which is regarded as the image defect in the entirety of the image forming apparatus 100. As a result, in the image forming apparatus 100 of the comparison example, a good image cannot be obtained.

An inter-transfer-position distance difference ΔL between each of the inter-transfer-position distances $L_Y$ and $L_{MC}$ as the first inter-transfer-position distance and the inter-transfer-position distance $L_{CK}$ as the second inter-transfer-position distance will be considered. This inter-transfer-position distance difference ΔL is set so that the motor gear 30 as the second drive transmission member rotates the integral number of times during movement of the predetermined position on the intermediary transfer belt 12*a*.

This setting is made by setting the transmission ratio i (=Z1/Z2) between the driving roller gear 29 as the first drive transmission member of the drive transmission device 28 and the motor gear 30 as the second drive transmission member of the drive transmission device 28. By this, the rotation speed fluctuation of the drive transmission device 28 can be minimized. As a result, a positional deviation of the transferred images on the intermediary transfer belt 12*a* at the above-described first transfer position, second transfer position and third transfer position can be prevented, so that the color misregistration in the entirety of the image forming apparatus 100 can be suppressed.

In this embodiment, an example of the case where the image forming apparatus 100 forms the image with the toners of the four colors of the yellow Y, the magenta M, the cyan c and the black K was described. In addition, the case where the image forming apparatus 100 forms the image with the toners of the three colors may also be employed. In this case, there are three primary transfer positions for the three colors disposed adjacent to each other, and the inter-transfer-position distance L is set between adjacent primary transfer positions.

Here, one inter-transfer-position distance L1 is set at "N×A" by using the distance A in which the predetermined position on the intermediary transfer belt 12*a* moves when the driving roller 12*b* as the rotatable driving member rotates through one-full circumference and using the number of rotations N (N: integer) of the driving roller 12*b*. Further, the other inter-transfer-position distance L2 is set at "N×A+N×A/i" by using the transmission ratio i (=Z1/Z2) between the driving roller gear 29 and the motor gear 30, which is a ratio between the number of teeth Z1 of the driving roller gear 29 and the number of teeth Z2 of the motor gear 30.

The inter-transfer-position distance $L_{MC}$ as the first inter-transfer-position distance between the primary transfer position 27M for the magenta M and the primary transfer position 27C for the cyan C, which are disposed adjacent to each other along the intermediary transfer belt 12*a*, is "N×A". Here, "N (N: integer)" is the number of rotations at which the driving roller 12*b* rotates during movement of the predetermined position of the center 12*a*1 of the intermediary transfer belt 12*a* with respect to the thickness direction in the inter-transfer-position distance $L_{MC}$, and is "1". "A" is the distance in which the predetermined position of the center 12*a*1 of the intermediary transfer belt 12*a* with respect to the thickness direction when the driving roller 12*b* rotates through one-full circumference, and is 90 mm.

Accordingly, the inter-transfer-position distance $L_{MC}$ is "N×A"=90 mm (=1×90 mm). On the other hand, the inter-transfer-position distance $L_{CK}$ between the primary transfer position 27C for the cyan C and the primary transfer position 27K for the black K, which are disposed adjacent to each other along the intermediary transfer belt 12*a* is "N×A+N×A/i". Here, "i" is "10". Accordingly, the inter-transfer-position distance $L_{CK}$ is "N×A+N×A/i"="1×90 mm+1×90 mm/10"="90 mm+9 mm"=99 mm.

By this, the image forming apparatus 100 in which the color misregistration is suppressed can be obtained. By employing such a constitution, rotation non-uniformity of both the driving roller gear 29 and the motor gear 30 can be made coincident with each other between certain two colors, and rotation non-uniformity of the motor gear 30 can be made coincident with each other between other two colors. By this, the color misregistration in the entirety of the image forming apparatus 100 can be suppressed.

In an image forming apparatus 100 using four or more colors, even in a constitution in which inter-transfer-position distances L for two or more colors are different from each other, one inter-transfer-position distance L1 is set at "N×A", and the other inter-transfer-position distance L2 is set at "N×A+N×A/i". By this, the color misregistration in the entirety of the image forming apparatus 100 can be suppressed.

For example, the case where in an image forming apparatus 100 using 5 colors, of four inter-transfer-position distances L, two inter-transfer-position distances L are different from each other will be considered. In that case, one inter-transfer-position distance L1 between two colors is set at "N×A", and the other inter-transfer-position distance L2 for two colors is set at "N×A+N×A/i". By this, the color misregistration in the entirety of the image forming apparatus 100 can be suppressed.

In this embodiment, one inter-transfer-position distance L1 was set at "N×A", and the other inter-transfer-position distance L2 was set at "N×A+N×A/i". The inter-transfer-position distance L fluctuates during manufacturing in some instances. The case where the gear accuracy of the drive transmission device 28 is about JIS-N-10 class will be considered. Even when this ratio is deviated from "N×A": "N×A±A/i" by about ±2%, the color misregistration in the entirety of the image forming apparatus 100 can be sufficiently suppressed.

Accordingly, in manufacturing, it is effective that the ratio of "first inter-transfer-position distance":"second inter-transfer-position distance" falls within a range of about ±2% of "N×A":"N×A±A/i". That is, the range in which the ratio of "first inter-transfer-position distance":"second inter-transfer-position distance" is ±2% of "N×A":"N×A±N×A/i" can be used as an effective range.

The transmission ratio i (=Z1/Z2) between the driving roller gear 29 and the motor gear 30 of the drive transmission device 28 will be considered. In this embodiment, an example in which for the transmission ratio i=10, the number of teeth Z1 is "150" and the number of teeth Z2 is "15" is employed.

Modified Embodiment

The transmission ratio i (=10) in this embodiment is a large transmission ratio i. For this reason, for example, even when the number of teeth Z1 of the driving roller gear 29 is 149 (=150-1), and the number of teeth Z2 of the motor gear 30 is 15, the transmission ratio i (=Z1/Z2=149/15=9.93) is not changed remarkably. For this reason, the color misregistration in the entirety of the image forming apparatus 100 can be suppressed.

Also in this case, the inter-transfer-position distance $L_{MC}$ as the first inter-transfer-position distance between the primary transfer position 27M for the magenta M and the primary transfer position 27C for the cyan C which are disposed adjacent to each other along the intermediary transfer belt 12*a* is "N×A". Here, N (N: integer) is the number of rotations at which the driving roller 12*b* rotates during movement of the predetermined position of the center 12*a*1 of the intermediary transfer belt 12*a* with respect to the thickness direction, and is "1". "A" is a distance in which the predetermined position of the center 12*a*1 of the intermediary transfer belt 12*a* with respect to the thickness direction moves when the driving roller 12*b* rotates through one-full circumference, and is 90 mm.

Accordingly, the inter-transfer-position distance $L_{MC}$ is "N×A"="1×90 mm"=90 mm. On the other hand, the inter-transfer-position distance $L_{CK}$ between the primary transfer position 27C for the cyan C and the primary transfer position 27K for the black K which are disposed adjacent to each other along the intermediary transfer belt 12*a* is as follows. Here, "i" is "9.93". Accordingly, the inter-transfer-position distance $L_{CK}$ is "N×A+N×A/i"="1×90 mm+1×90 mm/9.93"="90 mm+9.06 mm"≈99 mm.

In this modified embodiment, the transmission ratio i (=Z1/Z2=9.93) between the driving roller gear 29 as the first drive transmission member of the drive transmission device 28 and the motor gear 30 as the second drive transmission member of the drive transmission device 28 is the numeric number having one decimal place or less. This modified embodiment is an example of to the case where at that time, a value (=10) obtained by rounding off the one decimal place or less is set at the transmission ratio i.

In this embodiment, even when the transmission ratio i becomes 10 by rounding off the one decimal place or less, the resultant value falls within a good range for the color misregistration. For this reason, the effective range of the transmission ratio i can be a range in which the transmission ratio i obtained by rounding off the one decimal place or less is 10. That is, the case where the transmission ratio between the driving roller gear 29 as the first drive transmission member and the motor gear 30 as the second drive transmission member is the numerical number having the one decimal place or less will be considered.

The second inter-transfer-position distance "N×A+N×A/i" can be set by using, as the transmission ratio i, the value obtained by rounding off the one decimal place or less.

Here, a range of (first inter-transfer-position distance): (second inter-transfer-position distance) is ±2% of "N×A": "N×A+N×A/i" is used as an effective range. At this time, in the case where N=1 full circumference rotation and A=90 mm are used, when the transmission ratio i=10 holds, the inter-transfer-position distance $L_{CK}$ as the second inter-transfer-position distance is "N×A+N×A/i"="1×90 mm+1×

90 mm/10"=99 mm. On the other hand, when the transmission ratio i=9.93 holds, the inter-transfer-position distance $L_{CK}$ as the second inter-transfer-position distance is "N×A+N×A/i"="1×90 mm+1×90 mm/9.93"="90 mm+9.06 mm"=99.06 mm.

At that time, the case where the inter-transfer-position distance $L_{CK}$ in the modified embodiment is 99.06 mm compared with 99 mm which is the inter-transfer-position distance $L_{CK}$ as an ideal second inter-transfer-position distance will be considered. In this case, an ideal ratio of (first inter-transfer-position distance):(second inter-transfer-position distance) is "N×A":"N×A+N×A/i"=90 mm:99 mm, so that 99 mm/90 mm=1.1 holds. On the other hand, in the modified embodiment, "N+A":"N×A+N×A/i"=90 mm:99.06 mm, so that 99.06 mm/90 mm 1.1006 holds. "1.1±2%" is a range of 1.078 to 1.122, and therefore, "1.1006" falls within the effective range.

<When First Inter-Transfer-Position Distance is Fixed at 90 mm>

In the case where the first inter-transfer-position distance "N×A" is fixed at 90 mm, when the second inter-transfer-position distance "N×A+N×A/i" of 99 mm is deviated by ±2%, a range from 97.02 mm to 100.98 mm is an effective range of the second inter-transfer-position distance "N×A+N×A/i".

<When Second Inter-Transfer-Position Distance is Fixed at 99 mm>

In the case where the first inter-transfer-position distance "N×A+N×A/i" is fixed at 99 mm, when the first inter-transfer-position distance "N×A" of 90 mm is deviated by ±2%, a range from 88.2 mm to 91.8 mm is an effective range of the second inter-transfer-position distance "N×A".

In FIGS. 2 and 4, the number of teeth Z1 of the driving roller gear 29 having a larger diameter is set at "150", and the number of teeth Z2 of the motor gear 30 having a smaller diameter is set at "15". As a result, the driving roller 12*b* as the rotatable driving member rotates the integral number of times (150/15=10) during movement of the predetermined position of the center 12*a*1 of the intermediary transfer belt 12*a* with respect to the thickness direction. By this, the rotation speed fluctuation at the predetermined position of the center 12*a*1 of the intermediary transfer belt 12*a* with respect to the thickness direction is the same at all the primary transfer positions 27, so that the color misregistration among the respective colors is eliminated.

Here, reversely, the case where the number of teeth Z1 of the driving roller gear 29 having a smaller diameter is set at "15" and the number of teeth Z2 of the motor gear 30 having a larger diameter is set at "150" will be assumed. Such a constitution in which the relationship of the numbers of teeth is reversed will be considered. At this time, the case where the predetermined position of the center 12*a*1 of the intermediary transfer belt 12*a* with respect to the thickness direction moves in the inter-transfer-position distances $L_{YM}$ and $L_{MC}$ as the first inter-transfer-position distance will be considered. During the movement, the driving roller gear 29 having the smaller diameter rotates through one-full circumference integrally with the driving roller 12*b* as the rotatable driving member. For that reason, the driving roller gear 29 having the smaller diameter rotates the integral number of times.

Each of the inter-transfer-position distances $L_{YM}$ and $L_{MC}$ is set at 90 mm similarly as the case shown in FIG. 2. The distance A in which the predetermined position of the center 12*a*1 of the intermediary transfer belt 12*a* with respect to the thickness direction moves when the driving roller 12*b* as the rotatable driving member rotates through one-full circumference is also set at 90 mm. By this, the driving roller gear 29 is capable of rotating with a fluctuation of the same phase and the same amplitude at each of the primary transfer positions 27Y, 27M and 27C for the yellow Y, the magenta M and the cyan C. As a result, the rotation speed fluctuation of the driving roller gear 28 having the smaller diameter can be made the same among the yellow Y, the magenta M and the cyan C.

The transmission ratio i between the driving roller gear 29 having the smaller diameter and the motor gear having the larger diameter is set at 0.1 (=15/150). The driving roller gear 29 having the smaller diameter rotates through one-full circumference during movement of the predetermined position on the intermediary transfer belt 12*a* in each of the inter-transfer-position distances $L_{YM}$ and $L_{MC}$. During the movement, the motor gear 30 having the larger diameter rotates through 0.1-full circumference (=1×0.1). For this reason, the motor gear 30 having the larger diameter does not rotate the integral number of times during movement of the predetermined position on the intermediary transfer belt 12*a* in each of the inter-transfer-position distances $L_{YM}$ and $L_{MC}$.

On the other hand, the inter-transfer-position distance $L_K$ is set at 99 mm similarly as the case shown in FIG. 2. For this reason, the driving roller gear 29 having the smaller diameter rotates through 1.1-full circumference (=99 mm/90 mm) integrally with the driving roller 12*b* during movement of the predetermined position on the intermediary transfer belt 12*a* in the inter-transfer-position distance $L_{CK}$.

For that reason, as regards the driving roller gear 29, a rotation speed fluctuation difference ΔV29 occurs between the primary transfer position 27K for the black K and each of other primary transfer positions 27Y, 27M and 27C for the yellow Y, the magenta M and the cyan C.

For this reason, as regards the driving roller gear 29, between the primary transfer position 27K for the black K and each of other primary transfer positions 27Y, 27M and 27C for the yellow Y, the magenta M and the cyan C, degrees of the rotation non-uniformity cannot be adjusted to a fluctuation with the same phase and the same amplitude. Further, the motor gear 30 having the larger diameter rotates through 0.11-full circumference (=1.1×0.1) during rotation of the driving roller gear 29 through 1.1-full circumference. For this reason, the rotation speed fluctuation difference ΔV 30 between the primary transfer position 27K for the black K and each of other primary transfer positions 27Y, 27M and 27C for the yellow Y, the magenta M and the cyan C occurs. For this reason, the motor gear 30 cannot adjust the rotation non-uniformity to the fluctuation of the same phase and the same amplitude at the primary transfer position 27K for the black K and at other primary transfer positions 27Y, 27M and 27C for the yellow Y, the magenta M and the cyan C. For this reason, the rotation speed fluctuation of the predetermined position of the center 12*a*1 of the intermediary transfer belt 12*a* with respect to the thickness direction is different at each of the primary transfer positions 27, so that the color misregistration among the respective colors occurs.

Second Embodiment

Next, by using FIGS. 6 to 9, a structure of an image forming apparatus 100 according to the present invention in a second embodiment will be described. Incidentally, constituent elements similar to those in the first embodiment described above are represented by the same reference numerals or symbols or by different reference numerals or symbols in some instances, and will be omitted from description. Part (a) of FIG. 6 is a sectional view showing a structure of a drive transmission device 28 for the intermediary transfer belt 12*a* in this embodiment, and part (b) of FIG. 6 is an enlarged view of a portion G shown in part (a) of FIG. 6. Part (a) of FIG. 7 is an illustration of a relationship between rotation non-uniformity of a driving roller gear 29 alone and each primary transfer position 27 in this embodiment, and part (b) of FIG. 7 is an illustration of a relationship between rotation non-uniformity of a driving roller pre-stage gear alone and each primary transfer position 27 in this embodiment. Part (a) of FIG. 8 is an illustration of a relationship between rotation non-uniformity of a motor gear 30 alone and each primary transfer position 27 in this embodiment, and part (b) of FIG. 8 is an illustration of a relationship between rotation non-uniformity of an entire drive transmission device 28 and each primary transfer position in this embodiment.

FIG. 9 shows the inter-transfer-position distances L each between adjacent colors in this embodiment. FIG. 9 also shows the distance A in which the predetermined position of the center 12*c*1 of the intermediary transfer belt 12*a* with respect to the thickness direction when the driving roller 12*b* as the rotatable driving member rotates through one-full circumference. FIG. 9 further shows the number of teeth Z1 of the driving roller gear 29, the number of teeth Z3 of the driving roller pre-stage gear 31, and the number of teeth Z1 of the motor gear 30. Further, FIG. 9 shows a transmission ratio it (Z1/Z3) between the driving roller gear 29 and the driving roller pre-stage gear 31 and a transmission ratio i2 (Z3/Z2) between the driving roller pre-stage gear 31 and the motor gear 30. Further, FIG. 9 shows the number of rotations N (times) in which the driving roller 12*b* rotates during movement of the intermediary transfer belt 12*a* in each of the inter-transfer-position distances $L_{YM}$ and $L_{MC}$.

<Drive Transmission Device for Intermediary Transfer Unit>

As shown in FIGS. 6 and 9, the inter-transfer-position distances $L_{YM}$ and $L_{MC}$ are set at 90 mm. Further, the inter-transfer-position distance $L_{CK}$ is set at 99 mm. Further, the diameter of the driving roller 12*b* is 14.2239 mm, and the thickness of the intermediary transfer belt 12*a* is set at 0.1 mm. A state in which the intermediary transfer belt 12*a* is stretched on the outer peripheral surface of the driving roller 12*b* will be considered. In that state, the diameter D, including the diameter of the driving roller 12*b*, ranging between opposite centers 12*a*1 and 12*a*1 through the rotation center 12*b*1 of the driving roller 12*b* shown in part (b) of FIG. 6 is 14.2239 mm+(0.1 mm/2)×2=14.3239 mm.

The distance A in which the predetermined position of the center 12*a*1 of the intermediary transfer belt 12*a* with respect to the thickness direction is moved by rotation of the driving roller 12*b* through one-full circumference is 14.3239 mm×π×1 (full circumference rotation)≈45 mm. A constitution in which the driving roller 12*b* rotates through 2-full circumferences (=90 mm/45 mm) during movement of the predetermined position on the intermediary transfer belt 12*a* in each of the inter-transfer-position distances $L_{YM}$ and $L_{MC}$ (each 90 mm) is employed. On the other hand, the inter-transfer-position distance $L_{CK}$ is set at 99 mm. For this reason, the driving roller 12*b* rotates through 2,2-full circumferences (99 mm/45 mm) during movement of the predetermined position on the intermediary transfer belt 12*a* in the inter-transfer-position distance $L_{CK}$ (99 mm).

<Drive Transmission Device>

Next, by using FIG. 6, a structure of the drive transmission device 28 in this embodiment will be described. In the drive transmission device 28 in this embodiment, the driving roller gear 29 is provided coaxially and integrally with the driving roller 12*b* as shown in part (a) of FIG. 6. With the motor gear 30 provided integrally with a driving shaft of an unshown motor as a driving source, the driving roller pre-stage gear 31 is engaged, and the driving roller gear 29 is engaged with the driving roller pre-stage gear 31.

The driving roller pre-stage gear 31 as a third drive transmission member transmits a rotational driving force from the unshown motor as the driving source to the driving roller gear 29 as the first drive transmission member. For that reason, the driving roller pre-stage gear 31 is provided upstream (on the motor side) of the driving roller gear 29 with respect to the drive transmission direction. Further, the driving roller pre-stage gear 31 is provided downstream (on a side opposite from the motor) of the motor gear 30 as the second drive transmission member with respect to the drive transmission direction.

Each of the driving roller gear 29 as the first drive transmission member, the motor gear 30 as the second drive transmission member and the driving roller pre-stage gear 31 as the third drive transmission member is constituted by a gear. As shown in FIG. 9, the number of teeth Z1 of the driving roller gear 29 is set at 150 teeth. The number of teeth Z3 of the driving roller pre-stage gear 31 is set at 30 teeth. For this reason, the transmission ratio it (=Z1/Z3) between the driving roller gear 29 and the driving roller pre-stage gear 31 is 5 (=150/30).

During movement of the predetermined position on the intermediary transfer belt 12*a* in each of the inter-transfer-position distances $L_{YM}$ and $L_{MC}$, the driving roller 12*b* rotates through 2-full circumferences. At this time, the driving roller pre-stage gear 31 is constituted so as to rotate through 10-full circumferences (=2-full circumferences×5).

During movement of the predetermined position on the intermediary transfer belt 12*a* in the inter-transfer-position distance $L_{CK}$, the driving roller pre-stage gear 31 rotates through 11-full circumferences (=2.2-full circumferences×5). At this time, the driving roller pre-stage gear 31 rotates the integral number. The transmission ratio i2 is calculated as 2 (=Z3/Z2=30/15) by using the number of teeth Z3 of the driving roller pre-stage gear 31 and the number of teeth Z2 of the motor gear 30. For this reason, a constitution in which the motor gear 30 rotates through 2-full circumferences during rotation of the driving roller pre-stage gear 31 through 1-full circumference is employed.

In this embodiment, the driving roller 29 rotates through 2-full circumferences during movement of the predetermined position on the intermediary transfer belt 12*a* in each of the inter-transfer-position distances $L_{YM}$ and $L_{MC}$. Further driving roller 29 rotates through 2.2-full circumferences during movement of the predetermined position on the intermediary transfer belt 12*a* in the inter-transfer-position distance $L_{CK}$.

The transmission ratio i1 (=Z1/Z3=150/30) between the driving roller gear 29 and the driving roller pre-stage gear 31 is set at "5". Further, the motor gear 30 is provided upstream (on the motor side) of the driving roller pre-stage gear 31 with respect to the drive transmission direction. The motor gear 30 rotates through 2-full circumferences during rotation of the driving roller pre-stage gear 31 through 1-full circumference.

<Rotation Non-Uniformity of Gears at Primary Transfer Positions for Yellow, Magenta and Cyan>

<Rotation Non-Uniformity of Driving Roller Gear Alone>

As described above, the driving roller gear 29 rotates through 2-full circumferences during movement of the predetermined position on the intermediary transfer belt 12*a* in each of the inter-transfer-position distances $L_{YM}$ and $L_{MC}$. At this time, the driving roller 29 rotates the integral number (of times). For that reason, as shown in part (a) of FIG. 7, the driving roller gear 29 is capable of rotating at the same phase and with fluctuation in the same amplitude at the primary transfer positions 27Y, 27M and 27K for the yellow Y, the magenta M and the cyan C. As a result, the rotation speed fluctuation of the driving roller gear 29 can be made the same among the yellow Y, the magenta M and the cyan C.

<Rotation Non-Uniformity of Driving Roller Pre-Stage Gear Alone>

The transmission ratio i1 (=Z1/Z3) between the driving roller gear 29 and the driving roller gear pre-stage gear 31 is set at "5". During movement of the predetermined position on the intermediary transfer belt 12*a* in each of the inter-transfer-position distances $L_{YM}$ and $L_{MC}$, the driving roller gear 29 rotates through 2-full circumferences. During the movement, the driving roller pre-stage gear 31 rotates through 10-full circumferences.

During the movement of the predetermined position on the intermediary transfer belt 12*a* in each of the inter-transfer-position distances $L_{YM}$ and $L_{MC}$, the driving roller pre-stage gear 31 rotates the integral number (of times). By this, the driving roller pre-stage gear 31 is capable of rotating at the same sheet and with fluctuation in the same amplitude at the primary transfer positions 27Y, 27M and 27C for the yellow Y, the magenta M and the cyan C. As a result, the rotation non-uniformity of the driving roller pre-stage gear 31 can be made the same among the yellow Y, the magenta M and the cyan C.

<Rotation Non-Uniformity of Motor Gear Alone>

The driving roller gear 29 rotates through 2-full circumferences (=90 mm/45 mm) during movement of the predetermined position on the intermediary transfer belt 12 in each of the inter-transfer-position distances $L_{YM}$ and $L_{MC}$. The transmission ratio i1 (=Z1/Z3) between the driving roller gear 29 and the driving roller gear pre-stage gear 31 is set at "5". Further, the transmission ratio i2 (=Z3/Z2) between the driving roller gear pre-stage gear 31 and the motor gear 30 is set at "2". For this reason, the motor gear 30 rotates through 2-full circumferences during rotation of the driving roller gear 29 through 2-full circumferences. At this time, the motor gear 30 rotates the integral number (of times).

By this, the motor gear 30 is capable of rotating at the same sheet and with fluctuation in the same amplitude at the primary transfer positions 27Y, 27M and 27C for the yellow Y, the magenta M and the cyan C. As a result, the rotation non-uniformity of the motor gear 30 can be made the same among the yellow Y, the magenta M and the cyan C.

<Rotation Non-Uniformity of Entirety of Drive Transmission Device>

The rotation non-uniformity of the drive transmission device 28 including the motor gear 30, the driving roller pre-stage gear 31 and the driving roller gear 29 will be considered. The rotation speed fluctuation of the entirety of the drive transmission device 28 can be made the same at the primary transfer positions 27Y, 27M and 27C for the yellow Y, the magenta M and the cyan C as shown in part (b) of FIG. 8. By this, the color misregistration is prevented from occurring among the yellow Y, the magenta M and the cyan C.

<Rotation Non-Uniformity of Gears at Primary Transfer Position for Black>

The rotation non-uniformity of each of the driving roller gear 29, the driving roller pre-stage gear 31 and the motor gear 30 at the primary transfer position 27K for the black K will be described. Also in this embodiment, similarly as in the first embodiment, the inter-transfer-position distance $L_{CK}$ (99 mm) and the inter-transfer-position distances $L_{YM}$ and $L_{MC}$ (90 mm) are different from each other.

<Rotation Non-Uniformity of Driving Roller Gear Alone>

During movement of the predetermined position on the intermediary transfer belt 12*a* in the inter-transfer-position distance $L_{CK}$, the driving roller gear 29 rotates through 2.2-full circumferences (=99 mm/45 mm). At this time, the driving roller gear 29 does not rotate the integral number (of times). For this reason, the driving roller gear 29 causes the rotation speed fluctuation difference ΔV29 between at the primary transfer position 27K for the black K and at each of other primary transfer positions 27Y, 27M and 27C for the yellow Y, the magenta M and the cyan C, as shown in part (a) of FIG. 7.

For this reason, the driving roller gear 29 cannot adjust the rotation non-uniformity to the fluctuation of the same phase and the same amplitude between the primary transfer position 27K for the black K and each of other primary transfer positions 27Y, 27M and 27C for the yellow Y, the magenta M and the cyan C. As a result, due to the rotation non-uniformity of the driving roller gear 29, the rotation speed fluctuation of the driving roller gear 29 cannot be made the same between the black K and each of other colors of the yellow Y, the magenta M and the cyan C. As a result, the color misregistration occurs between the black K and each of other colors of the yellow Y, the magenta M and the cyan C.

<Rotation Non-Uniformity of Driving Roller Pre-Stage Gear Alone>

During movement of the predetermined position on the intermediary transfer belt 12*a* in the inter-transfer-position distance $L_{CK}$, the driving roller pre-stage gear 31 rotates through 11-full circumferences (=2.2-full circumferences×5). At this time, the driving roller pre-stage gear 31 rotates the integral number (of times). For this reason, as shown in part (b) of FIG. 7, the rotation speed fluctuation difference ΔV31 of the driving roller pre-stage gear 31 at the primary transfer position 27K for the black K is 0 (ΔV31=0).

For this reason, the driving roller pre-stage gear 31 is capable of rotating with fluctuation of the same phase and the same amplitude between at the primary transfer position 27K for the black K and at each of other primary transfer positions 27Y, 27M and 27K for the yellow Y, the magenta M and the cyan C. For that reason, the color misregistration due to the rotation non-uniformity of the driving roller pre-stage gear 31 does not occur between the black K and each of other colors of the yellow Y, the magenta M and the cyan C.

<Rotation Non-Uniformity of Motor Gear Alone>

During movement of the predetermined position on the intermediary transfer belt 12*a* in the inter-transfer-position distance $L_{CK}$, the motor gear 30 rotates through 22-full circumferences (=2.2-full circumferences×5×2). At this time, the motor gear 30 rotates the integral number (of times). For this reason, as shown in part (b) of FIG. 8, the rotation speed fluctuation difference ΔV30 of the motor gear 30 at the primary transfer position 27K for the black K is 0 (ΔV30=0). For this reason, the motor gear 30 is capable of rotating with fluctuation of the same phase and the same amplitude between at the primary transfer position 27K for the black K and at each of other primary transfer positions 27Y, 27M and 27K for the yellow Y, the magenta M and the cyan C. For that reason, the color misregistration due to the rotation non-uniformity of the motor gear 30 does not occur between the black K and each of other colors of the yellow Y, the magenta M and the cyan C.

<Rotation Non-Uniformity of Entirety of Drive Transmission Device>

As shown in part (b) of FIG. 8, during movement of the predetermined position on the intermediary transfer belt 12*a* in the inter-transfer-position distance $L_{CK}$, the color misregistration due to the rotation non-uniformity of the driving roller gear 29 as shown in part (a) of FIG. 7 occurs. However, the color misregistration due to the rotation non-uniformity of each of the driving roller pre-stage gear 31 and the motor gear 30 which are provided upstream (on the motor side) of the driving roller gear 29 does not occur.

For example, it is assumed that the gear accuracy of the driving roller gear 29 is set at accuracy of about JIS-N-10 class. When calculation is made from a normalized value of a cumulative pitch error of the gear, the color misregistration amount due to the rotation non-uniformity of the driving roller gear 29 is about 8 μm or less in this embodiment. Here, the color misregistration amount (8 μm) due to the rotation non-uniformity of the driving roller gear 29 of the drive transmission device 28 of the intermediary transfer unit 12 is sufficiently small relative to 100 μm which is the color misregistration amount, causing the image defect, in the entirety of the image forming apparatus 100. For this reason, the color misregistration amount can be set at not more than a color misregistration amount to the extent that the user cannot recognize the image defect.

Of the plurality of primary transfer positions 27, the inter-transfer-position distances $L_{YM}$ and $L_{MC}$ as the first inter-transfer-position distances between adjacent primary transfer positions 27Y and 27M and between adjacent primary transfer positions 27M and 27C will be considered. Further, the inter-transfer-position distance $L_{CK}$ as the second inter-transfer-position distance which is different from each of the inter-transfer-position distances $L_{YM}$ and $L_{MC}$ and which is an inter-transfer-position distance between adjacent primary transfer positions 27C and 27K will be considered.

Further, the inter-transfer-position distance difference ΔL between each of the inter-transfer-position distances $L_{YM}$ and $L_{MC}$ as the first inter-transfer-position distance and the inter-transfer-position distance $L_{CK}$ as the second inter-transfer-position distance will be considered. This inter-transfer-position distance difference ΔL is set so that during movement of the predetermined position on the intermediary transfer belt 12*a*, each of the motor gear 30 as the second drive transmission member and the driving roller pre-stage gear 31 as the third drive transmission member rotates the integral number (of times).

This setting is carried out by making setting of the transmission ratio it (=Z1/Z3) between the driving roller gear 29 as the first drive transmission member and the driving roller pre-stage gear 31 as the third drive transmission member and by making setting of the transmission ratio i2 (=Z3/Z2) between the driving roller pre-stage gear 31 as the third drive transmission member and the motor gear 30 as the second drive transmission member.

In this embodiment, the distance in which the predetermined position of the center 12*a*1 of the intermediary transfer belt 12*a* with respect to the thickness direction moves when the driving roller 12*b* as the rotatable driving member rotates through one-full circumference is A. Further, the inter-transfer-position distances $L_{YM}$ and $L_{MC}$ as the first inter-transfer-position distances will be considered. The number of rotations in which the driving roller 12*b* as the rotatable driving member rotates during movement of the predetermined position of the center 12*a*1 of the intermediary transfer belt 12*a* with respect to the thickness direction is N (N: integer).

Further, the transmission ratio between the driving roller gear 29 as the first drive transmission member and the driving roller pre-stage gear 31 as the third drive transmission member is i1 (=Z1/Z3). Further, the transmission ratio between the driving roller pre-stage gear 31 as the third drive transmission member and the motor gear 30 as the second drive transmission member is i2 (=Z3/Z2). At that time, each of the inter-transfer-position distances $L_{YM}$ and $L_{MC}$ as the first inter-transfer-position distance is set at "N×A". Further, the inter-transfer-position distance $L_{CK}$ as the second inter-transfer-position distance is set at "N×A+N×A/(i1+i2).

The inter-transfer-position distance $L_{MC}$ as the first inter-transfer-position distance between the primary transfer position 27M for the magenta M and the primary transfer position 27C for the cyan C, which are disposed adjacent to each other along the intermediary transfer belt 12*a*, is "N×A". Here, "N (N: integer)" is the number of rotations at which the driving roller 12*b* rotates during movement of the predetermined position of the center 12*a*1 of the intermediary transfer belt 12*a* with respect to the thickness direction in the inter-transfer-position distance $L_{MC}$, and is "2". "A" is the distance in which the predetermined position of the center 12*a*1 of the intermediary transfer belt 12*a* with respect to the thickness direction moves when the driving roller 12*b* rotates through one-full circumference, and is "45 mm".

Accordingly, the inter-transfer-position distance $L_{MC}$ is "N×A"=90 mm (=2×45 mm). On the other hand, the inter-transfer-position distance $L_{CK}$ between the primary transfer position 27C for the cyan C and the primary transfer position 27K for the black K, which are disposed adjacent to each other along the intermediary transfer belt 12*a* is "N×A+N×A/(i1×i2)". Here, "i1×i2" is "5×2=10". Accordingly, the inter-transfer-position distance $L_{CK}$ is "N×A+N×A/(i1+i2)"="2×45 mm+2×45 mm/10"="90 mm+9 mm"=99 mm.

By this, the rotation speed fluctuation of the entirety of the drive transmission device 28 can be minimized. As a result, it is possible to suppress the color misregistration in the entire image forming apparatus 100 caused due to the rotation non-uniformity of the drive transmission device 28. The "N×A" of each of the inter-transfer-position distances $L_{YM}$ and $L_{MC}$ as the first inter-transfer-position distance will be considered. Further, the "N×A+N×A/(i1×i2)" of the inter-transfer-position distance $L_{CK}$ as the second inter-transfer-position distance will be considered. As regards these inter-transfer-position distances, a range at a ratio of (first inter-transfer-position distance):(second inter-transfer-position distance) which is ±2% of "N×A":"N×A+N×A/(i1×i2)" can be used as an effective range.

Further, the case where the transmission ratio (=Z1/Z3) between the driving roller gear 29 as the first drive transmission member and the driving roller gear pre-stage gear 31 as the third drive transmission member is a number having one decimal place or more will be considered. At this time, a value obtained by rounding off the one decimal place of the transmission ratio (=Z1/Z3) is set as the transmission ratio i1.

Further, the case where the second transmission ratio (=Z3/Z2) between the driving roller pre-stage gear 31 as the third drive transmission member and the motor gear 30 as the second drive transmission member is a number having one decimal place or more will be considered. At this time, a value obtained by rounding off the one decimal place of the second transmission ratio (Z3/Z2) is set as the second transmission ratio i2. By using these transmission ratios i1 and i2, the inter-transfer-position distance $L_K$ as the second inter-transfer-position distance is set at "N×A+N×A/(i1×i2)". Other constitutions are similar to the constitutions of the first embodiment, and an effect similar to the effect of the first embodiment can be obtained.

Third Embodiment

Next, by using FIGS. 10 to 12, a structure of an image forming apparatus 100 according to the present invention in a third embodiment will be described. Incidentally, constituent elements similar to those in the respective embodiments described above are represented by the same reference numerals or symbols or by different reference numerals or symbols in some instances, and will be omitted from description.

Part (a) of FIG. 10 is a sectional view showing a structure of a drive transmission device 28 for the intermediary transfer belt 12*a* in this embodiment, and part (b) of FIG. 10 is an enlarged view of a portion G shown in part (a) of FIG. 10. Part (a) of FIG. 11 is an illustration of a relationship between rotation non-uniformity of a driving roller gear 29 alone and each primary transfer position 27 in this embodiment. Part (b) of FIG. 11 is an illustration of a relationship between rotation non-uniformity of a motor gear 30 alone and each primary transfer position 27 in this embodiment, and part (c) of FIG. 11 is an illustration of a relationship between rotation non-uniformity of an entire drive transmission device 28 and each primary transfer position 27 in this embodiment.

FIG. 12 shows the inter-transfer-position distances L between adjacent colors in this embodiment. FIG. 12 also shows the distance A in which the predetermined position of the center 12*c*1 of the intermediary transfer belt 12*a* with respect to the thickness direction moves when the driving roller 12*b* as the rotatable driving member rotates through one-full circumference. FIG. 12 further shows the number of teeth Z1 of the driving roller gear 29, the number of teeth Z1 of the motor gear 30, and a transmission ratio i (=Z1/Z2) between the driving roller gear 29 and the motor gear 30. Further, FIG. 12 shows the number of rotations N (times) in which the driving roller 12*b* rotates during movement of the intermediary transfer belt 12*a* in each of the inter-transfer-position distances $L_{YM}$ and $L_{MC}$.

As shown in FIGS. 10 and 12, this embodiment is different from the first and second embodiments in that the inter-transfer-position distance $L_{CK}$ different from the inter-transfer-position distances $L_{YM}$ and $L_{MC}$ is 81 mm. The inter-transfer-position distance $L_{CK}$ (99 mm) in the first and second embodiments is an example in which the inter-transfer-position distance $L_{CK}$ is larger than the inter-transfer-position distances $L_{YM}$ (90 mm) and $L_{MC}$ (90 mm). The inter-transfer-position distance $L_{CK}$ (81 mm) in this embodiment is an example in which the inter-transfer-position distance $L_{CK}$ is smaller than the inter-transfer-position distances $L_{YM}$ (90 mm) and $L_{MC}$ (90 mm).

Here, the inter-transfer-position distances $L_{YM}$ (90 mm) and $L_{MC}$ (90 mm) will be considered. Further, the distance A (90 mm) in which the predetermined position of the center 12*a*1 of the intermediary transfer belt 12*a* with respect to the thickness direction moves when the driving roller 12*b* as the rotatable driving member rotates through one-full circumference will be considered. In this embodiment, the inter-transfer-position distances $L_{YM}$ and $L_{MC}$ and the distance A are the same (90 mm).

For this reason, the driving roller gear 29 rotates through 1-full circumference during movement of the predetermined position of the center 12*a*1 of the intermediary transfer belt 12*a* with respect to the thickness direction in each of the inter-transfer-position distance $L_{YM}$ and $L_{MC}$. On the other hand, the driving roller gear 20 rotates through 0.9-full circumference (=81 mm/90 mm) during movement of the center 12*a*1 of the intermediary transfer belt 12*a* with respect to the thickness direction in the inter-transfer-position distance $L_{CK}$ (81 mm).

Further, the number of teeth Z1 of the driving roller gear 29 is "150", and the number of teeth Z2 of the motor gear 30 is "15". By this, the transmission ratio i (=Z1/Z2=150/15) between the driving roller gear 29 and the to motor gear 30 provided in the drive transmission device 28 is set at "10". For this reason, the motor gear 30 rotates through 10-full circumferences during rotation of the driving roller gear 29 through one-full circumference.

In this embodiment, the inter-transfer-position distance $L_{CK}$ (81 mm) is set so as to be smaller than each of the inter-transfer-position distances $L_{YM}$ (90 mm) and $L_{MC}$ (90 mm). Here, the inter-transfer-position distance difference ΔL (=90 mm−81 mm=9 mm) between each of the inter-transfer-position distances $L_{YM}$ (90 mm) and $L_{MC}$ (90 mm) and the inter-transfer-position distance $L_{CK}$ (81 mm) will be considered.

During movement of the predetermined position on the intermediary transfer belt 12*a* in the inter-transfer-position distance difference ΔL, the driving roller gear 29 rotates through 0.1-full circumference (=9 mm/90 mm). During the movement, the motor gear 30 rotates through 1-full circumference (=0.1-full circumference×10). At this time, the motor gear 30 rotates the integral number (of times). By this, this constitution is effective in reducing the degree of the color misregistration similarly as described above.

Also in this embodiment, similarly as in the above-described first embodiment, the thickness of the intermediary transfer belt 12*a* is set at 0.1 mm. Further, in the state in which the intermediary transfer belt 12*a* is stretched around the outer peripheral surface of the driving roller 12*b*, the diameter D between the opposite centers 12*a*1 and 12*a*1 of the intermediary transfer belt 12*a* with respect to the thickness direction shown in part (b) of FIG. 10 is set at 28.5479 mm. The distance A in which the predetermined position of the center 12*a*1 of the intermediary transfer belt 12*a* with respect to the thickness direction moves when the driving roller 12*b* rotates through one-full circumference will be considered. At this time, the distance A in which the predetermined position of the center 12*a*1 of the intermediary transfer belt 12*a* moves with respect to the thickness direction is set at 90 mm <Rotation Non-Uniformity of Gears at Primary Transfer Positions for Yellow, Magenta and Cyan>

The rotation non-uniformity of each of the driving roller 29 alone and the motor gear 30 alone at the primary transfer positions 27Y, 27M and 27C for the yellow, the magenta M1 and the cyan C, and the rotation non-uniformity of the entirety of the drive transmission device 28 will be described.

<Rotation Non-Uniformity of Driving Roller Gear Alone>

Setting is made so that the driving roller gear 29 rotates through one-full circumference during movement of the predetermined position on the intermediary transfer belt 12*a* in each of the inter-transfer-position distances $L_{YM}$ and $L_{MC}$. By this, as shown in part (a) of FIG. 11, the driving roller gear 29 is capable of rotating at the same phase and with fluctuation in the same amplitude at the primary transfer positions 27Y, 27M and 27K for the yellow Y, the magenta M and the cyan C. As a result, the rotation speed fluctuation of the driving roller gear 29 can be made the same among the yellow Y, the magenta M and the cyan C.

<Rotation Non-Uniformity of Motor Gear Alone>

The motor gear 30 rotates through 10-full circumferences (=1-full circumference×10) during movement of the predetermined position on the intermediary transfer belt 12 in each of the inter-transfer-position distances $L_{YM}$ and $L_{MC}$. During the movement, the motor gear 30 rotates the integral number (of times).

By this, as shown in part (b) of FIG. 11, the motor gear 30 is capable of rotating at the same sheet and with fluctuation in the same amplitude at the primary transfer positions 27Y, 27M and 27C for the yellow Y, the magenta M and the cyan C. As a result, the rotation non-uniformity of the motor gear 30 can be made the same among the yellow Y, the magenta M and the cyan C.

<Rotation Non-Uniformity of Entirety of Drive Transmission Device>

As a result, as shown in part (c) of FIG. 11, the rotation non-uniformity of the entirety of the drive transmission device 28 including the motor gear 30 and the driving roller gear 29 can be made the same at the primary transfer positions 27Y, 27M and 27C for the yellow Y, the magenta M and the cyan C as shown in part (b) of FIG. 8. By this, the color misregistration is prevented from occurring among the yellow Y, the magenta M and the cyan C.

<Rotation Non-Uniformity of Gears at Primary Transfer Position for Black>

The rotation non-uniformity of each of the driving roller gear 29 alone and the motor gear 30 alone and the rotation non-uniformity of the entirety of the drive transmission device 28 at the primary transfer position 27K for the black K will be described.

<Rotation Non-Uniformity of Driving Roller Gear Alone>

Also in this embodiment, similarly as in the first embodiment, the inter-transfer-position distance $L_K$ and the inter-transfer-position distances $L_{YM}$ and $L_{MC}$ (90 mm) are different from each other. For that reason, during movement of the predetermined position on the intermediary transfer belt 12*a* in the inter-transfer-position distance $L_{CK}$, the driving roller gear 29 rotates through only 0.9-full circumference (=81 mm/90 mm).

The primary transfer position 27K for the black K and each of other primary transfer positions 27Y, 27M and 27C for the yellow Y, the magenta M and the cyan C will be considered. As shown in part (a) of FIG. 11, the driving roller gear 29 cannot adjust the rotation non-uniformity to the fluctuation of the same phase an the same amplitude between the primary transfer position 27K for the black K and each of other primary transfer positions 27Y, 27M and 27C for the yellow Y, the magenta M and the cyan C.

For that reason, the rotation speed fluctuation difference generates due to the rotation non-uniformity of the driving roller gear 29, so that the rotation speed fluctuation of the driving roller gear 29 cannot be made the same between the black K and each of other colors of the yellow Y, the magenta M and the cyan C. As a result, the color misregistration occurs between the black K and each of other colors of the yellow Y, the magenta M and the cyan C.

<Rotation Non-Uniformity of Motor Gear Alone>

During movement of the predetermined position on the intermediary transfer belt 12*a* in the inter-transfer-position distance $L_{CK}$, the motor gear 30 rotates through 9-full circumferences (=0.9-full circumference×10). That is, the motor gear 30 rotates the integral number (of times). By this, the rotation speed fluctuation difference ΔV30 of the motor gear 30 at the primary transfer position 27K for the black K is 0 (ΔV30=0). For this reason, the motor gear 30 is capable of rotating with fluctuation of the same phase and the same amplitude between at the primary transfer position 27K for the black K and at each of other primary transfer positions 27Y, 27M and 27K for the yellow Y, the magenta M and the cyan C. For that reason, the color misregistration due to the rotation non-uniformity of the motor gear 30 does not occur between the black K and each of other colors of the yellow Y, the magenta M and the cyan C.

<Rotation Non-Uniformity of Entirety of Drive Transmission Device>

The color misregistration due to the rotation non-uniformity of the driving roller gear 29 occurs between the primary transfer position 27K for the black K and at each of the primary transfer positions 27Y, 27M and 27C for the yellow Y, the magenta M and the cyan C. However, the color misregistration due to the rotation non-uniformity of the motor gear 30 does not occur. The rotation speed fluctuation difference ΔV28 is obtained by combining the rotation speed fluctuation difference ΔV29 shown in part (a) of FIG. 11 with the rotation speed fluctuation difference ΔV30 (=0) shown in part (b) of FIG. 11. For this reason, ΔV28=&V&V29 holds.

Here, it is assumed that the gear accuracy of the driving roller gear 29 is set at accuracy of about JIS-N-10 class. When calculation is made from a normalized value of a cumulative pitch error of the gear, the color misregistration amount due to the rotation non-uniformity of the driving roller gear 29 is about 8 μm or less in this embodiment. For this reason, also in this embodiment, the color misregistration amount (8 μm) due to only the drive transmission device 28 of the intermediary transfer unit 12 is sufficiently small relative to 100 μm which is the color misregistration amount resulting in the image defect caused by accumulation of various error factors in the entirety of the image forming apparatus 100. By this, the color misregistration amount can be suppressed to a color misregistration amount to the extent that the user cannot recognize the image defect.

Thus, the case where a plurality of primary transfer positions are provided on the intermediary transfer belt 12*a* which is rotatably stretched and of a plurality of adjacent inter-transfer-position distances L, the first inter-transfer-position distance and the second inter-transfer-position distance are different from each other will be considered. In this case, the predetermined position on the intermediary transfer belt 12*a* moves in the inter-transfer-position distance difference ΔL between the first inter-transfer-position distance L1 and the second inter-transfer-position distance L2. Setting is made so that a second rotatable member provided upstream with respect to the drive transmission direction, of a first rotatable member which is rotationally driven while stretching the intermediary transfer belt 12*a* during the movement of the predetermined position of the intermediary transfer belt 12*a*.

This setting is made by setting a transmission ratio i between the first rotatable member and the second rotatable member. By this, it becomes possible to minimize the rotation speed fluctuation of the drive transmission device 28, with the result that the color misregistration amount due to the rotation non-uniformity of the drive transmission device 28 can be minimized.

In the image forming apparatus 100 using more than four colors, a larger inter-transfer-position distance L is set at "N×A" and a smaller inter-transfer-position distance L is set at "N×A−N×A/i". By this, the color misregistration of the entirety of the image forming apparatus 100 can be suppressed. For example, in the image forming apparatus 100 using five colors, of the four inter-transfer-position distances L, three inter-transfer-position distances L are set at "N×A" and the remaining one inter-transfer-position distance L is set at "N×A-N×A/i".

The inter-transfer-position distance $L_{MC}$ as the first inter-transfer-position distance between the primary transfer position 27M for the magenta M and the primary transfer position 27C for the cyan C, which are disposed adjacent to each other along the intermediary transfer belt 12*a*, is "N×A". Here, "N (N: integer)" is the number of rotations at which the driving roller 12*b* rotates during movement of the predetermined position of the center 12*a*1 of the intermediary transfer belt 12*a* with respect to the thickness direction in the inter-transfer-position distance $L_{MC}$, and is "1". "A" is the distance in which the predetermined position of the center 12*a*1 of the intermediary transfer belt 12*a* with respect to the thickness direction moves when the driving roller 12*b* rotates through one-full circumference, and is "90 mm".

Accordingly, the inter-transfer-position distance $L_{MC}$ is "N×A"=90 mm (=1×90 mm). On the other hand, the inter-transfer-position distance $L_{CK}$ between the primary transfer position 27C for the cyan C and the primary transfer position 27K for the black K, which are disposed adjacent to each other along the intermediary transfer belt 12*a* is "N×A−N×A/i". Here, "i" is "10". Accordingly, the inter-transfer-position distance $L_{CK}$ is "N×A−N×A/i"="1×90 mm−1×90 mm/10"="90 mm−9 mm"=81 mm. By this, it is possible to suppress color misregistration of the entirety of the image forming apparatus 100. Other constitutions are similar to the constitutions of the above-described embodiments, and an effect similar to the effect of the embodiments can be obtained.

Fourth Embodiment

Next, by using FIGS. 13 to 16, a structure of an image forming apparatus 100 according to the present invention in a fourth embodiment will be described. Incidentally, constituent elements similar to those in the respective embodiments described above are represented by the same reference numerals or symbols or by different reference numerals or symbols in some instances, and will be omitted from description. FIG. 13 is a sectional view showing a structure of an image forming apparatus including an electrostatic attraction belt for feeding the recording material S such as paper.

This embodiment is different from the embodiments described above in that the intermediary transfer belt 12*b* shown in FIG. 1 is not used and the recording material S is electrostatically attracted to an electrostatic attraction belt 40 shown in FIG. 13 and is fed to transfer positions 127Y, 127M, 127C and 127K where photosensitive drums 1 for respective colors oppose the electrostatic attraction belt 40, and then, respective color toner images carried on the surfaces of the photosensitive drums 1 are directly transferred onto the recording material S.

<Image Forming Apparatus>

By using FIG. 13, a structure of the image forming apparatus 100 in which the recording material S is fed by being electrostatically attracted to the electrostatic attraction belt 40 as a feeding belt and the color toner images carried on the surfaces of the photosensitive drums 1 are directly transferred onto the recording material S will be described. In the image forming apparatus 100 shown in FIG. 13, process cartridges 7, for the respective colors, for forming an image on the recording material S are provided along an up-down direction of FIG. 13. As the process cartridges 7 for the colors, four process cartridges are disposed for forming toner images of the respective colors of yellow Y, magenta M, cyan C and black K from below toward above in FIG. 13.

Each of the process cartridge 7 is constituted so as to be mountable in and dismountable from an apparatus main assembly 100*a* of the image forming apparatus 100, and the process cartridges 7 have substantially the same constitution except that colors of toners as developers accommodated in toner containers 6 of developing units 4. The process cartridge 7K for the black K has many opportunities for printing a text image. For this reason, the process cartridge 7K includes a large-volume toner container 6K for accommodating the toner with a volume larger than each of those of the toners contained in other process cartridges. The toner accommodated in each toner container 6 is applied onto the surface of each developing roller 24 by an associated developer application roller 25.

In each process cartridge 7, an associated photosensitive drum 1 is provided rotatably in the counterclockwise direction of FIG. 13. Each photosensitive drum 1 is rotationally driven by transmission of a rotational driving force from an unshown driving motor by a drive transmission means. The surface of each photosensitive drum 1 is electrically charged uniformly by application of a charging bias to an associated charging roller 2. Then, the surface of the photosensitive drum 1 is selectively exposed to laser light 3*a* emitted from a laser scanner 3 as an exposure means, so that an electrostatic latent image is formed on the surface of the photosensitive drum 1. This electrostatic latent image is developed into a toner image by a deposition of the toner of the associated color on the photosensitive drum surface by a developing roller 24 as a developer carrying member provided in the associated developing unit 4.

On the other hand, in a feeding cassette 1, the recording material S such as paper is stacked and accommodated. The recording material S is fed by a feeding roller 9 driven at predetermined timing through transmission of a rotational driving force from an unshown driving motor. The recording material S fed by the feeding roller 9 is separated one by one and fed by a separation pad 23.

Thereafter, the recording material S nipped and fed by a feeding roller pair 10 is abutted at a leading end portion thereof against a nip of a registration roller pair 17 which is at rest, so that oblique movement of the recording material S is corrected. Thereafter, the recording material S is nipped and fed by the registration roller pair 17 and then is electrostatically attracted by the electrostatic attraction belt 40 and is fed. The electrostatic attraction belt 40 is a feeding belt for feeding the recording material S to the transfer positions 127Y, 127M, 127C and 127K for the respective colors while carrying the recording material S. The electrostatic attraction belt 40 is rotatably stretched by a driving roller 41 and a tension roller 42 in the clockwise direction of FIG. 13. On an inner peripheral surface side of the electrostatic attraction belt 40, transfer rollers 126 as a transfer means are provided opposed to the photosensitive drums 1, respectively.

The electrostatic attraction belt 40 is rotationally driven while contacting the photosensitive drums 1 at an outer peripheral surface thereof. When the recording material S electrostatically attracted by the electrostatic attraction belt 40 is fed in contact with the surface of each of the photosensitive drums 1, a transfer bias is applied to the associated transfer roller 126, so that the toner images on the surfaces of the photosensitive drums 1 are successively transferred superposedly onto the recording material S.

Residual toner remaining on the surface of each photosensitive drum 1 after the transfer is scraped off and removed by a cleaning blade as a cleaning means provided in an associated cleaning unit 5.

The recording material S on which the four color toner images are transferred is fed into a fixing device 14, and then is heated and pressed during feeding thereof through a fixing nip 19 formed by a heating unit 14*a* and a pressing roller 14*b*, so that the toner images are melted and fixed on the recording material S. Thereafter, the recording material S is discharged onto a discharge tray 21 provided outside the apparatus main assembly 100*a* by a discharging roller pair 20.

<Drive Transmission Device>

Next, by using FIGS. 14 to 16, a structure of the drive transmission device 28 in this embodiment will be described. Part (a) of FIG. 14 is a sectional view showing a structure of a drive transmission device 28 for the electrostatic attraction belt 40 in this embodiment, and part (b) of FIG. 14 is an enlarged view of a portion G shown in part (a) of FIG. 14. Part (a) of FIG. 15 is an illustration of a relationship between rotation non-uniformity of a driving roller gear 29 alone and each transfer position 127 in this embodiment. Part (b) of FIG. 15 is an illustration of a relationship between rotation non-uniformity of a motor gear 30 alone and each primary transfer position 127 in this embodiment, and part (c) of FIG. 15 is an illustration of a relationship between rotation non-uniformity of an entire drive transmission device 28 and each transfer position 127 in this embodiment.

FIG. 16 shows the inter-transfer-position distances $L_{YM}$, $L_{MC}$ and $L_{CK}$ between adjacent colors in this embodiment. FIG. 16 also shows the distance A in which the predetermined position of a center 40*a* of the electrostatic attraction belt 40 with respect to the thickness direction moves when the driving roller 41 rotates through one-full circumference. FIG. 16 further shows the number of teeth Z1 of the driving roller gear 29, the number of teeth Z1 of the motor gear 30, and a transmission ratio i1 (=Z1/Z2). Further, FIG. 16 shows the number of rotations N (times) in which the driving roller 41 rotates during movement of the electrostatic attraction belt 40 in each of the inter-transfer-position distances $L_{YM}$ and $L_{MC}$.

Part (a) of FIG. 15 shows rotation non-uniformity of the driving roller gear 29 alone at the transfer positions 127Y, 127M, 127C and 127K for the respective colors, where the photosensitive drums oppose the associated transfer rollers 126, respectively, through the electrostatic attraction belt 40. Part (b) of FIG. 15 shows rotation non-uniformity of the motor gear 30 alone at the transfer positions 127Y, 127M, 127C and 127K for the respective colors. Part (c) of FIG. 15 shows rotation non-uniformity of entirety of the drive transmission device 28 at the transfer positions 127Y, 127M, 127C and 127K.

In the first embodiment described above, the drive transmission device 28 for the intermediary transfer belt 12*a* during the secondary transfer of the toner images from the intermediary transfer belt 12*a* onto the recording material S after the primary transfer of the toner images from the photosensitive drums 1 onto the intermediary transfer belt 12*a* was described. In this embodiment, the drive transmission device 28 for the electrostatic attraction belt 40 during direct transfer of the toner images from the photosensitive drums 1 onto the recording material S electrostatically attracted to the electrostatic attraction belt 40 is used and is only different from the drive transmission device 28 in the first embodiment in constitution in which the toner images are directly transferred onto the recording material S fed by the electrostatic attraction belt 40. For this reason, description overlapping with that of the first embodiment will be omitted.

As shown in parts (a) to (c) of FIG. 15, the rotation non-uniformity of each of the driving roller gear 29 and the motor gear 30 when the recording material S reaches the transfer positions 127Y, 127M, 127C and 127K for the respective colors will be considered. Further, the rotation non-uniformity of the entirety of the drive transmission device 28 for the electrostatic attraction belt 40 will be considered. These are similar to those of the rotation non-uniformity of each of the driving roller gear 29, the motor gear 30 and the entirety of the drive transmission device 28 when the intermediary transfer belt 12*a* in the first embodiment shown in parts (a) to (c) of FIG. 3 reaches the primary transfer positions 27Y, 27M, 27C and 27K for the respective colors, and therefore redundant description will be omitted.

Also in this embodiment, the inter-transfer-position distance $L_K$ (99 mm) between the transfer position 127C for the cyan C and the transfer position 127K for the black K along the electrostatic attraction belt 40 will be considered. Further, the inter-transfer-position distance $L_{YM}$ (90 mm) between the transfer position 127Y for the yellow Y and the transfer position 127M for the magenta M along the electrostatic attraction belt 40 will be considered.

Further, the inter-transfer-position distance $L_{MC}$ (90 mm) between the transfer position 127M for the magenta M and the transfer position 127C for the cyan C will be considered. The inter-transfer-position distance $L_{CK}$ (99 mm) is different from the inter-transfer-position distance $L_{YM}$ (90 mm) and the inter-transfer-position distance $L_{MC}$ (90 mm).

At this time, from a relationship shown in FIG. 16, the driving roller 41 rotates through N-full circumference(s) (N: integer) during movement of the predetermined position on the electrostatic attraction belt 40 in each of the inter-transfer-position distances $L_{YM}$ and $L_{MC}$. At this time, N is 1. On the other hand, during movement of the predetermined position on the electrostatic attraction belt 40, rotating in the arrow F direction of part (a) of FIG. 14, from the transfer position 127C for the cyan C to the transfer position 127K for the black K, the driving roller 41 rotates through 1.1 full circumference (=99 mm/90 mm).

Here, as shown in FIG. 16, the number of teeth Z1 of the driving roller gear 29 provided in the drive transmission device 28 is set at 150 teeth, and the number of teeth Z2 of the motor gear 30 is set at 15 teeth. For this reason, the transmission ratio i (=Z1/Z2) of the drive transmission device 28 is 10 (=150 teeth/15 teeth). The motor gear 30 engaging with the driving roller gear 29 is set at "10" in terms of the transmission ratio i. For this reason, when the driving roller gear 29 rotates through 1-full circumference, the motor gear 30 rotates through 10-full circumferences.

Further, during movement of the predetermined position on the electrostatic attraction belt 40 in the inter-transfer-position distance $L_{CK}$ (99 mm), each of the driving roller 41 and the driving roller gear 29 rotates through 1.1-full circumferences, and the motor gear 30 rotates through 11-full circumferences (1.1-full circumferences×10). At this time, the motor gear 30 rotates the integral number of times.

Here, an inter-transfer-position distance difference ΔL between each of the inter-transfer-position distances $L_Y$ and $L_{MC}$ as the first inter-transfer-position distance and the inter-transfer-position distance $L_{CK}$ as the second inter-transfer-position distance will be considered. This inter-transfer-position distance difference ΔL is set so that the motor gear 30 as the second drive transmission member rotates the integral number of times during movement of the predetermined position on the electrostatic attraction belt 40.

This setting can be made by setting the transmission ratio i (=Z1/Z2) between the driving roller gear 29 as the first drive transmission member of the drive transmission device 28 and the motor gear 30 as the second drive transmission member of the drive transmission device 28. By this, the rotation speed fluctuation of the drive transmission device 28 can be minimized. As a result, a positional deviation of the transferred images on the intermediary transfer belt 12*a* the recording material S carried on the electrostatic attraction belt 40 as the transfer belt at the first transfer position, the second transfer position and the third transfer position can be prevented similarly as in the first embodiment. For this reason, the color misregistration in the entirety of the image forming apparatus 100 can be suppressed even in a constitution in which the inter-transfer-position distance L between adjacent transfer positions 127 for colors along the electrostatic attraction belt 40 and the inter-transfer-position distance L between adjacent other transfer positions 127 for other colors along the electrostatic attraction belt 40 are different from each other.

The inter-transfer-position distance $L_{MC}$ as the first inter-transfer-position distance between the transfer position 127M for the magenta M and the transfer position 127C for the cyan C, which are disposed adjacent to each other along the electrostatic attraction belt 40, is "N×A". Here, "N (N: integer)" is the number of rotations at which the driving roller 41 rotates during movement of the predetermined position of the center 40*a* of the electrostatic attraction belt 40 with respect to the thickness direction in the inter-transfer-position distance $L_{MC}$, and is "1". "A" is the distance in which the predetermined position of the center 40*a* of the electrostatic attraction belt 40 with respect to the thickness direction moves when the driving roller 41 rotates through one-full circumference, and is "90 mm".

Accordingly, the inter-transfer-position distance $L_{MC}$ is "N×A"=90 mm (=1×90 mm). On the other hand, the inter-transfer-position distance $L_{CK}$ between the transfer position 127C for the cyan C and the transfer position 127K for the black K, which are disposed adjacent to each other along the electrostatic attraction belt 40 is "N×A+N×A/i". Here, "i" is "10". Accordingly, the inter-transfer-position distance $L_{CK}$ is "N×A+N×A/i"="1×90 mm+1×90 mm/10"="90 mm+9 mm"=99 mm. Other constitutions are similar to the constitutions of the above-described embodiments, and an effect similar to the effect of the embodiments can be obtained.

Fifth Embodiment

Next, by using FIGS. 17 to 19, a structure of an image forming apparatus 100 according to the present invention in a fifth embodiment will be described. Incidentally, constituent elements similar to those in the respective embodiments described above are represented by the same reference numerals or symbols or by different reference numerals or symbols in some instances, and will be omitted from description. Part (a) of FIG. 17 is a sectional view showing a structure of a drive transmission device 28 for the intermediary transfer belt 12*a* in this embodiment, and part (b) of FIG. 17 is an enlarged view of a portion G shown in part (a) of FIG. 17.

Part (a) of FIG. 18 is an illustration of a relationship between rotation non-uniformity of a driving roller pulley 43 alone and each primary transfer position 27 for each color in this embodiment. Part (b) of FIG. 18 is an illustration of a relationship between rotation non-uniformity of a motor pulley 44 alone and each primary transfer position 27 for each color in this embodiment, and part (c) of FIG. 15 is an illustration of a relationship between rotation non-uniformity of an entire drive transmission device 28 and each primary transfer position 27 for each color in this embodiment. FIG. 19 shows the inter-transfer-position distances $L_{YM}$, $L_{MC}$ and $L_{CK}$ between adjacent colors in this embodiment. FIG. 19 also shows the distance A in which the predetermined position of a center 12*a*1 of the intermediary transfer belt 12*a* with respect to the thickness direction moves when the driving roller 12*b* rotates through one-full circumference. FIG. 19 further shows the number of teeth Z4 of the driving roller pulley 43, the number of teeth Z5 of the motor pulley 44, and a transmission ratio i3 (=Z4/Z5). Further, FIG. 19 shows the number of rotations N (times) in which the driving roller 12*b* rotates during movement of the intermediary transfer belt 12*a* in each of the inter-transfer-position distances $L_{YM}$ and $L_{MC}$.

In this embodiment, as the drive transmission device 28 for the intermediary transfer belt 12*a*, a constitution in place of the above-described motor gear 30 and the driving roller gear 29 engaging with the motor gear 30 shown in part (a) of FIG. 2 will be considered. These gears can be replaced with a constitution for performing drive transmission by stretching a timing belt 45 around the motor pulley 44 and the driving roller pulley 43 shown in part (a) of FIG. 17.

The driving roller pulley 43 as a first drive transmission member is constituted as a first pulley provided coaxially with the driving roller 12*b* as the rotatable driving member. The motor pulley 44 as a second drive transmission member is constituted as a second pulley for transmitting a rotational driving force from an unshown motor as a driving source to the driving roller pulley 43 as the first pulley through the timing belt 45 as a second belt.

The driving roller pulley 43 is constituted so as to be rotatable coaxially and integrally with the driving roller 12*b* around which the intermediary transfer belt 12*a* is stretched. The motor pulley 44 is provided integrally with a driving shaft of the unshown motor as the driving source. The timing belt 45 is constituted by a toothed belt provided with teeth on an inner peripheral surface thereof. An outer peripheral surface of each of the motor pulley 44 and the driving roller pulley 43 is provided with teeth engaging with the teeth provided on the inner peripheral surface of the timing belt 45.

FIG. 19 shows the inter-transfer-position distances $L_{YM}$, $L_{MC}$ and $L_{CK}$ between adjacent primary transfer positions for colors disposed along the intermediary transfer belt 12*a*. FIG. 19 also shows the distance A in which the predetermined position of a center 12*a*1 of the intermediary transfer belt 12*a* moves with respect to the thickness direction when the driving roller 12*b* shown in part (b) of FIG. 17 rotates through one-full circumference. FIG. 19 further shows the number of teeth Z4 of the driving roller pulley 43, the number of teeth Z5 of the motor pulley 44, and a transmission ratio i3 (=Z4/Z5). Further, FIG. 16 shows the number of rotations N (times) in which the driving roller 12*b* rotates during movement of the intermediary transfer belt 12*a* in each of the inter-transfer-position distances $L_{YM}$ and $L_{MC}$.

That is, in this embodiment, the driving roller gear 29 and the motor gear 30 in the first embodiment are replaced with the driving roller pulley 43 and the motor pulley 44, respectively, and the driving roller pulley 43 and the motor pulley 44 are connected by using the timing belt 45. This is only different from the first embodiment.

As shown in parts (a) to (c) of FIG. 18, the rotation non-uniformity of each of the driving roller pulley 43 and the motor pulley 44 when the predetermined position of the intermediary transfer belt 12*a* reaches the primary transfer positions 27Y, 27M, 27C and 27K for the respective colors will be considered. Further, the rotation non-uniformity of the entirety of the drive transmission device 28 will be considered. These are similar to those of the rotation non-uniformity of each of the driving roller gear 29, the motor gear 30, and the rotation non-uniformity of the entirety of the drive transmission device 28, and therefore redundant description will be omitted. Incidentally, as shown in part (a) of FIG. 18, due to the rotation non-uniformity of the driving roller pulley 43, a rotation speed fluctuation difference ΔV43 generates between at the primary transfer position 27K for the black K and at each of other primary transfer positions 27Y, 27M and 27C for the yellow Y, the magenta M and the cyan C.

Also in this embodiment, the inter-transfer-position distance $L_{CK}$ (99 mm) between the primary transfer position 27C for the cyan C and the primary transfer position 27K for the black K which are provided adjacent to each other along the intermediary transfer belt 12*a* will be considered. Further, the inter-transfer-position distance $L_{YM}$ (90 mm) between the transfer position 27Y for the yellow Y and the primary transfer position 27M for the magenta M which are provided adjacent to each other along the intermediary transfer belt 12*a* will be considered.

Further, the inter-transfer-position distance $L_{MC}$ (90 mm) between the primary transfer position 27M for the magenta M and the primary transfer position 27C for the cyan C will be considered. The inter-transfer-position distance $L_{CK}$ (99 mm) is different from the inter-transfer-position distance $L_{YM}$ (90 mm) and the inter-transfer-position distance $L_{MC}$ (90 mm).

At this time, from a relationship shown in FIG. 19, the driving roller 12*b* rotates through N-full circumference(s) (N: integer) during movement of the predetermined position on the intermediary transfer belt 12*a* in each of the inter-transfer-position distances $L_{YM}$ and $L_{MC}$. Here, N is 1. On the other hand, during movement of the predetermined position on the intermediary transfer belt 12*a*, rotating in the arrow F direction of part (a) of FIG. 17, from the primary transfer position 27C for the cyan C to the primary transfer position 27K for the black K, the driving roller 41 rotates through 1.1 full circumference (=99 mm/90 mm).

Here, the number of teeth Z4 of teeth provided on the outer peripheral surface of the driving roller pulley 43 provided in the drive transmission device 28 is set at 150 teeth, and the number of teeth Z5 of teeth provided on the outer peripheral surface of the motor pulley 44 is set at 15 teeth. For this reason, the transmission ratio i3 (=Z4/Z5) of the drive transmission device 28 is 10 (=150 teeth/15 teeth). The motor pulley 44 engaging with the driving roller pulley 43 via the timing belt 45 is set at "10" in terms of the transmission ratio i3. For this reason, when the driving roller pulley 43 rotates through 1-full circumference, the motor pulley 44 rotates through 10-full circumferences.

Further, during movement of the predetermined position on the intermediary transfer belt 12*a* in the inter-transfer-position distance $L_{CK}$ (99 mm), each of the driving roller 12*b* and the driving roller pulley 43 rotates through 1.1-full circumferences, and the motor pulley 44 rotates through 11-full circumferences (1.1-full circumferences×10). At this time, the motor pulley 44 rotates the integral number of times.

Here, an inter-transfer-position distance difference ΔL between each of the inter-transfer-position distances $L_Y$ and $L_{MC}$ as the first inter-transfer-position distance and the inter-transfer-position distance $L_{CK}$ as the second inter-transfer-position distance will be considered. This inter-transfer-position distance difference ΔL is set so that the motor pulley 44 as the second drive transmission member rotates the integral number of times during movement of the predetermined position on the intermediary transfer belt 12*a*.

This setting can be made by setting the transmission ratio i3 (=Z4/Z5) between the driving roller pulley 43 as the first drive transmission member of the drive transmission device 28 and the motor pulley 44 as the second drive transmission member of the drive transmission device 28. By this, the rotation speed fluctuation of the drive transmission device 28 can be minimized. As a result, the color misregistration in the entirety of the image forming apparatus 100 can be suppressed even in a constitution in which the inter-transfer-position distance L between adjacent primary transfer positions 27 for colors along the intermediary transfer belt 12*a* and the inter-transfer-position distance L between adjacent other primary transfer positions 27 for other colors along the intermediary transfer belt 12*a* are different from each other.

The inter-transfer-position distance $L_{MC}$ as the first inter-transfer-position distance between the transfer position 27M for the magenta M and the primary transfer position 27C for the cyan C, which are disposed adjacent to each other along the intermediary transfer belt 12*a*, is "N×A". Here, "N (N: integer)" is the number of rotations at which the driving roller 12*b* rotates during movement of the predetermined position of the center 12*a*1 of the intermediary transfer belt 12*a* with respect to the thickness direction in the inter-transfer-position distance $L_{MC}$, and is "1". "A" is the distance in which the predetermined position of the center 12*a*1 of the intermediary transfer belt 12*a* with respect to the thickness direction moves when the driving roller 12*b* rotates through one-full circumference, and is "90 mm".

Accordingly, the inter-transfer-position distance $L_{MC}$ is "N×A"=90 mm (=1×90 mm). On the other hand, the inter-transfer-position distance $L_{CK}$ between the primary transfer position 27C for the cyan C and the primary transfer position 27K for the black K, which are disposed adjacent to each other along the intermediary transfer belt 12*a* is "N×A+N×A/i3". Here, "i3" is "10". Accordingly, the inter-transfer-position distance $L_{CK}$ is "N×A+N×A/i3"="1×90 mm+1×90 mm/10"="90 mm+9 mm"=99 mm. Other constitutions are similar to the constitutions of the above-described embodiments, and an effect similar to the effect of the embodiments can be obtained.

Sixth Embodiment

Next, by using FIGS. 20 to 22, a structure of an image forming apparatus 100 according to the present invention in a sixth embodiment will be described. Incidentally, constituent elements similar to those in the respective embodiments described above are represented by the same reference numerals or symbols or by different reference numerals or symbols in some instances, and will be omitted from description. Part (a) of FIG. 20 is a sectional view showing a structure of a drive transmission device 28 for the intermediary transfer belt 12*a* in this embodiment, and part (b) of FIG. 20 is an enlarged view of a portion G shown in part (a) of FIG. 20.

Part (a) of FIG. 21 is an illustration of a relationship between rotation non-uniformity of a driving roller-rotating roller 46 alone and each primary transfer position 27 in this embodiment. Part (b) of FIG. 18 is an illustration of a relationship between rotation non-uniformity of a motor roller 47 alone and each primary transfer position 27 in this embodiment, and part (c) of FIG. 15 is an illustration of a relationship between rotation non-uniformity of an entire drive transmission device 28 and each primary transfer position 27 for each color in this embodiment. FIG. 22 shows the inter-transfer-position distances $L_{YM}$, $L_{MC}$ and $L_K$ between adjacent colors in this embodiment. FIG. 22 also shows the distance A in which the predetermined position of a center 12*a*1 of the intermediary transfer belt 12*a* with respect to the thickness direction moves when the driving roller 12*b* rotates through one-full circumference. FIG. 22 further shows an outer diameter D46 of the driving roller-rotating roller 46, an outer diameter D47 of the motor roller 47, and a transmission ratio i6 (=D46/D47). Further, FIG. 22 shows the number of rotations N (times) in which the driving roller 12*b* rotates during movement of the intermediary transfer belt 12*a* in each of the inter-transfer-position distances $L_{YM}$ and $L_{MC}$.

In this embodiment, as the drive transmission device 28 for the intermediary transfer belt 12*a*, a constitution in place of the above-described constitution of the first embodiment in which the driving roller gear 29 and the motor gear 30 are engaged and connected at shown in FIG. 2 will be considered. These gears can be replaced with a constitution for performing drive transmission by a frictional force through press-contact between the driving roller-rotating roller 46 and the motor roller 47 which are capable of being rotated.

The driving roller-rotating roller 46 as a first drive transmission member for rotating the driving roller 12*b* as the first drive transmission member will be considered. Further, the motor roller 47 as a second drive transmission member provided upstream (on the motor side) of the driving roller-rotating roller 46 with respect to the drive transmission direction will be considered. The motor roller 47 transmits a rotational driving force from an unshown motor as a driving source to the driving roller-rotating roller 46 as the first drive transmission member.

The driving roller-rotating roller 46 and the motor roller 47 are constituted by rollers contacting each other and being capable of being rotated.

The driving roller-rotating roller 46 is constituted so as to be rotatable coaxially and integrally with the driving roller 12*b* around which the intermediary transfer belt 12*a* is stretched. The motor roller 47 is provided integrally with a driving shaft of the unshown motor as the driving source.

FIG. 22 shows the inter-transfer-position distances $L_{YM}$, $L_{MC}$ and $L_{CK}$ between adjacent colors in this embodiment. FIG. 19 also shows the distance A in which the predetermined position of a center 12*a*1 of the intermediary transfer belt 12*a* with respect to the thickness direction moves when the driving roller 12*b* rotates through one-full circumference. FIG. 22 further shows the outer diameter D46 of the driving roller-rotating roller 46, the outer diameter D47 of the motor roller 47, and a transmission ratio i6 (=D46/D47). Further, FIG. 22 shows the number of rotations N (times) in which the driving roller 12*b* rotates during movement of the intermediary transfer belt 12*a* in each of the inter-transfer-position distances $L_{YM}$ and $L_{MC}$.

That is, this embodiment is only different from the first embodiment in that in place of the driving roller gear 29 and the motor gear 30, the driving roller-rotating roller 46 and the motor roller 47 are used. Here, the transmission ratio i6 between the driving roller-rotating roller 46 and the motor roller 47 in this embodiment can be acquired by the following formula 6 using an outer peripheral length P46 of the driving roller-rotating roller 46 and an outer peripheral length P47 of the motor roller 47.

$$i6 = P46/P47 \quad \text{(formula 6)}$$

Further, the outer peripheral length P46 of the driving roller-rotating roller 46 and the outer peripheral length P47 of the motor roller 47 can be acquired by the following formula 7 using the outer diameter D46 of the driving roller-rotating roller 46 and the outer diameter D47 of the motor roller 47.

$$P46 = D46 \times \pi$$

$$P47 = D47 \times \pi \quad \text{(formula 7)}$$

By substituting the formula 7 into the formula 6, the transmission ratio i6 between the driving roller-rotating roller 46 and the motor roller 47 can be acquired by the following formula 8 using the outer diameter D46 of the driving roller-rotating roller 46 and the outer diameter D47 of the motor roller 47.

$$i6 = D46/D47$$

The outer diameter D46=75 mm of the driving roller-rotating roller 46 and the outer diameter D47=7.5 mm of the motor roller 47 which are shown in FIG. 22 are substituted in the above formula 8. By this, the transmission ratio i6 between the driving roller-rotating roller 46 and the motor roller 47 can be acquired by the following formula 9.

$$\begin{aligned} i6 &= D46/D47 \quad \text{(formula 9)} \\ &= 75\ (\text{mm})/7.5\ (\text{mm}) \\ &= 10 \end{aligned}$$

The rotation non-uniformity of each of the driving roller-rotating roller 46 and the motor roller 47 when the predetermined position of the intermediary transfer belt 12*a* reaches the primary transfer positions 27 for the respective colors will be considered. Further, the rotation non-uniformity of the entirety of the drive transmission device 28 will be considered. These are similar to those of the rotation non-uniformity of each of the driving roller gear 29, the motor gear 30, and the rotation non-uniformity of the entirety of the drive transmission device 28, and therefore redundant description will be omitted.

Incidentally, as shown in part (a) of FIG. 21, due to the rotation non-uniformity of the driving roller-rotating roller 46, a rotation speed fluctuation difference ΔV46 generates between at the primary transfer position 27K for the black K and at each of other primary transfer positions 27Y, 27M and 27C for the yellow Y, the magenta M and the cyan C.

Also in this embodiment, the inter-transfer-position distance $L_{CK}$ (99 mm) between the primary transfer position 27C for the cyan C and the primary transfer position 27K for the black K which are provided adjacent to each other along the intermediary transfer belt 12*a* will be considered. Further, the inter-transfer-position distance $L_{YM}$ (90 mm) between the transfer position 27Y for the yellow Y and the primary transfer position 27M for the magenta M which are provided adjacent to each other along the intermediary transfer belt 12*a* will be considered.

Further, the inter-transfer-position distance $L_{MC}$ (90 mm) between the primary transfer position 27M for the magenta M and the primary transfer position 27C for the cyan C will be considered. The inter-transfer-position distance $L_{CK}$ (99 mm) is different from the inter-transfer-position distance $L_{YM}$ (90 mm) and the inter-transfer-position distance $L_{MC}$ (90 mm).

At this time, from a relationship shown in FIG. 22, the driving roller 12*b* rotates through N-full circumference(s) (N: integer) during movement of the predetermined position on the intermediary transfer belt 12*a* in each of the inter-transfer-position distances $L_{YM}$ and $L_{MC}$. Here, N is 1. On the other hand, during movement of the predetermined position on the intermediary transfer belt 12*a*, rotating in the arrow F direction of part (a) of FIG. 20, from the primary transfer position 27C for the cyan C to the primary transfer position 27K for the black K, the driving roller 41 rotates through 1.1 full circumference (=99 mm/90 mm).

Here, the outer diameter D46 of the driving roller-rotating roller 46 provided in the drive transmission device 26 is set at 75 mm, and the outer diameter D47 of the motor roller 47 is set at 7.5 mm. For this reason, the transmission ratio i6 (=D46/D47) is 10 (=75 mm/7.5 mm). The motor roller 47 connected with the outer peripheral surface of the driving roller-rotating roller 46 at its outer peripheral surface so as to be rotatable in a press-contact state is set at "10" in terms of the transmission ratio i6. For this reason, when the driving roller-rotating roller 46 rotates through 1-full circumference, the motor roller 47 rotates through 10-full circumferences. Further, during movement of the predetermined position on the intermediary transfer belt 12*a* in the inter-transfer-position distance $L_{CK}$ (99 mm), each of the driving roller 12*b* and the driving roller-rotating roller 46 rotates through 1.1-full circumferences, and the motor roller 47 rotates through 11-full circumferences (1.1-full circumferences×10). At this time, the motor roller 47 rotates the integral number of times.

Here, an inter-transfer-position distance difference ΔL between each of the inter-transfer-position distances $L_Y$ and $L_{MC}$ as the first inter-transfer-position distance and the inter-transfer-position distance $L_{CK}$ as the second inter-transfer-position distance will be considered. This inter-transfer-position distance difference ΔL is set so that the motor roller 47 as the second drive transmission member rotates the integral number of times during movement of the predetermined position on the intermediary transfer belt 12*a*.

This setting can be made by setting the transmission ratio i6 (=D46/D47) between the driving roller-rotating roller 46 as the first drive transmission member of the drive transmission device 28 and the motor roller 47 as the second drive transmission member of the drive transmission device 28. By this, the rotation speed fluctuation of the drive transmission device 28 can be minimized. As a result, the color misregistration in the entirety of the image forming apparatus 100 can be suppressed even in a constitution in which the inter-transfer-position distance L between adjacent primary transfer positions 27 for colors along the intermediary transfer belt 12*a* and the inter-transfer-position distance L between adjacent other primary transfer positions 27 for other colors along the intermediary transfer belt 12*a* are different from each other.

The inter-transfer-position distance $L_{MC}$ as the first inter-transfer-position distance between the transfer position 27M for the magenta M and the primary transfer position 27C for the cyan C, which are disposed adjacent to each other along the intermediary transfer belt 12*a*, is "N×A". Here, "N (N: integer)" is the number of rotations at which the driving roller 12*b* rotates during movement of the predetermined position of the center 12*a*1 of the intermediary transfer belt 12*a* with respect to the thickness direction in the inter-transfer-position distance $L_{MC}$, and is "1". "A" is the distance in which the predetermined position of the center 12*a*1 of the intermediary transfer belt 12*a* with respect to the thickness direction moves when the driving roller 12*b* rotates through one-full circumference, and is "90 mm".

Accordingly, the inter-transfer-position distance $L_{MC}$ is "N×A"=90 mm (=1×90 mm). On the other hand, the inter-transfer-position distance $L_{CK}$ between the primary transfer position 27C for the cyan C and the primary transfer position 27K for the black K, which are disposed adjacent to each other along the intermediary transfer belt 12*a* is "N×A+N×A/i6". Here, "i6" is "10". Accordingly, the inter-transfer-position distance $L_{CK}$ is "N×A+N×A/i6"="1×90 mm+1×90 mm/10"="90 mm+9 mm"=99 mm. Other constitutions are similar to the constitutions of the above-described embodiments, and an effect similar to the effect of the embodiments can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-041859 filed on Mar. 7, 2019, which is hereby incorporated by reference herein in its entirety.

What is claimed is:

1. An image forming apparatus comprising:

an intermediary transfer belt;

a first image bearing member provided opposed to said intermediary transfer belt;

a second image bearing member provided opposed to said intermediary transfer belt;

a third image bearing member provided opposed to said intermediary transfer belt;

a rotatable driving member configured to rotationally drive said intermediary transfer belt;

a first drive transmission member configured to rotate said rotatable driving member; and a second drive transmission member provided upstream of said first drive transmission member with respect to a drive transmission direction and configured to transmit a rotational driving force from a driving source to said first drive transmission member, wherein said image forming apparatus includes:

a first transfer position where said first image bearing member opposes said intermediary transfer belt, a second transfer position where said second image bearing member opposes said intermediary transfer belt, and a third transfer position where said third image bearing member opposes said intermediary transfer belt, wherein a first inter-transfer-position distance between the first transfer position and the second transfer position which are adjacent to each other along said intermediary transfer belt and a second inter-transfer-position distance between the second transfer position and the third transfer position which are adjacent to each other along said intermediary transfer belt are different from each other, and wherein a positional deviation between transfer images transferred onto said intermediary transfer belt at the first transfer position, the second transfer position and the third transfer position is prevented by setting the first inter-transfer-position distance to "N×A" and setting the second inter-transfer-position distance to "N×A±N×A/i", where N is an integer of rotations of said rotatable driving member during movement of a predetermined position of said intermediary transfer belt in the first inter-transfer-position distance, A is a distance of movement of the predetermined position of said intermediary transfer belt when said rotatable driving member rotates through one full circumference, and i is a transmission ratio between said first drive transmission member and said second drive transmission member.

2. An image forming apparatus according to claim 1, wherein the first transfer position is a position where a developer image carried on said first image bearing member is transferred onto said intermediary transfer belt, wherein the second transfer position is a position where a developer image carried on said second image bearing member is transferred onto said intermediary transfer belt, and wherein the third transfer position is a position where a developer image carried on said third image bearing member is transferred onto said intermediary transfer belt.

3. An image forming apparatus according to claim 1, wherein said intermediary transfer belt is rotatably stretched by at least said rotatable driving member configured to transmit a rotational driving force to said intermediary transfer belt and a rotatable tension member configured to generate tension in said intermediary transfer belt for generating a frictional force between said rotatable driving member and said intermediary transfer belt, and wherein the distance A in which said intermediary transfer belt moves when said rotatable driving member rotates through one full circumference is a peripheral length of a circle which has a center coinciding with a rotation center of said rotatable driving member and which passes through a center of thickness of said intermediary transfer belt wound around said rotatable driving member.

4. An image forming apparatus according to claim 1, wherein each of said first drive transmission member and said second drive transmission member is a gear.

5. An image forming apparatus according to claim 1, wherein said first drive transmission member is a first pulley provided coaxially with said rotatable driving member, and wherein said second drive transmission member is a second pulley configured to transmit a rotational driving force from the driving source to said first pulley through a second belt.

6. An image forming apparatus according to claim 1, wherein a ratio of (first inter-transfer-position distance): (second inter-transfer-position distance) falls within an effective range which is ±2% of "N×A":"N×A±N×A/i".

7. An image forming apparatus according to claim 1, wherein when the transmission ratio between said first drive transmission member and said second drive transmission member is a number to one decimal place or more, the second inter-transfer-position distance is set at "N×A±N×A/i" where the transmission ratio i is a value obtained by rounding off the number to one decimal place.

8. An image forming apparatus according to claim 1, wherein said first drive transmission member is provided coaxially with said rotatable driving member.

9. An image forming apparatus comprising:

a feeding belt configured to feed a recording material;

a first image bearing member provided opposed to said feeding belt;

a second image bearing member provided opposed to said feeding belt;

a third image bearing member provided opposed to said feeding belt;

a rotatable driving member configured to rotationally drive said feeding belt;

a first drive transmission member configured to rotate said rotatable driving member; and a second drive transmission member provided upstream of said first drive transmission member with respect to a drive transmission direction and configured to transmit a rotational driving force from a driving source to said first drive transmission member, wherein said image forming apparatus includes:

a first transfer position where said first image bearing member opposes the recording material carried on said feeding belt, a second transfer position where said second image bearing member opposes the recording material carried on said feeding belt, and a third transfer position where said third image bearing member opposes the recording material carried on said feeding belt, wherein a first inter-transfer-position distance between the first transfer position and the second transfer position which are adjacent to each other along said feeding belt and a second inter-transfer-position distance between the second transfer position and the third transfer position which are adjacent to each other along said feeding belt are different from each other, and wherein a positional deviation between transfer images transferred onto the recording material carried on said feeding belt at the first transfer position, the second transfer position and the third transfer position is prevented by setting the first inter-transfer-position distance to "N×A" and setting the second inter-transfer-position distance to "N×A±N×A/i", where N is an integer of rotations of said rotatable driving member during movement of a predetermined position of said feeding belt in the first inter-transfer-position distance, A is a distance of movement of the predetermined position of said feeding belt when said rotatable driving member rotates through one full circumference, and i is a transmission ratio between said first drive transmission member and said second drive transmission member.

10. An image forming apparatus according to claim 9, wherein the first transfer position is a position where a developer image carried on said first image bearing member is transferred onto the recording material carried on said feeding belt, wherein the second transfer position is a position where a developer image carried on said second image bearing member is transferred onto the recording material carried on said feeding belt, and wherein the third transfer position is a position where a developer image carried on said third image bearing member is transferred onto the recording material carried on said feeding belt.

11. An image forming apparatus according to claim 9, wherein said feeding belt is rotatably stretched by at least said rotatable driving member configured to transmit a rotational driving force to said feeding belt and a rotatable tension member configured to generate tension in said feeding belt for generating a frictional force between said rotatable driving member and said feeding belt, and wherein the distance A in which said feeding belt moves when said rotatable driving member rotates through one full circumference is a peripheral length of a circle which has a center coinciding with a rotation center of said rotatable driving member and which passes through a center of thickness of said feeding belt wound around said rotatable driving member.

12. An image forming apparatus according to claim 9, wherein each of said first drive transmission member and said second drive transmission member is a gear.

13. An image forming apparatus according to claim 9, wherein said first drive transmission member is a first pulley provided coaxially with said rotatable driving member, and wherein said second drive transmission member is a second pulley configured to transmit a rotational driving force from the driving source to said first pulley through a second belt.

14. An image forming apparatus according to claim 9, wherein a ratio of (first inter-transfer-position distance): (second inter-transfer-position distance) falls within an effective range which is ±2% of "N×A":"N×A±N×A/i".

15. An image forming apparatus according to claim 9, wherein when the transmission ratio between said first drive transmission member and said second drive transmission member is a number to one decimal place or more, the second inter-transfer-position distance is set at "N×A±N×A/i" where the transmission ratio i is a value obtained by rounding off the number to one decimal place.

16. An image forming apparatus according to claim 9, wherein said first drive transmission member is provided coaxially with said rotatable driving member.

17. An image forming apparatus comprising:

an intermediary transfer belt;

a first image bearing member provided opposed to said intermediary transfer belt;

a second image bearing member provided opposed to said intermediary transfer belt;

a third image bearing member provided opposed to said intermediary transfer belt;

a rotatable driving member configured to rotationally drive said intermediary transfer belt;

a first drive transmission member configured to rotate said rotatable driving member;

a second drive transmission member provided upstream of said first drive transmission member with respect to a drive transmission direction and configured to transmit a rotational driving force from a driving source to said first drive transmission member; and a third drive transmission member provided upstream of said first drive transmission member with respect to the drive transmission direction and downstream of said second drive transmission member with respect to the drive transmission direction and configured to transmit the rotational driving force from the driving source to said first drive transmission member, wherein said image forming apparatus includes:

a first transfer position where said first image bearing member opposes said intermediary transfer belt, a second transfer position where said second image bearing member opposes said intermediary transfer belt, and a third transfer position where said third image bearing member opposes said intermediary transfer belt, wherein a first inter-transfer-position distance between the first transfer position and the second transfer position which are adjacent to each other along said intermediary transfer belt and a second inter-transfer-position distance between the second transfer position and the third transfer position which are adjacent to each other along said intermediary transfer belt are different from each other, and wherein a positional deviation between transfer images transferred onto said intermediary transfer belt at the first transfer position, the second transfer position and the third transfer position is prevented by setting the first inter-transfer-position distance to "N×A" and setting the second inter-transfer-position distance to "N×A±N×A/(i1×i2)", where N is an integer of rotations of said rotatable driving member during movement of a predetermined position of said intermediary transfer belt in the first inter-transfer-position distance, A is a distance of movement of the predetermined position of said intermediary transfer belt when said rotatable driving member rotates through one full circumference, i1 is a first transmission ratio between said first drive transmission member and said third drive transmission member, and i2 is a second transmission ratio between said third drive transmission member and said second drive transmission member.

18. An image forming apparatus according to claim 17, wherein the first transfer position is a position where a developer image carried on said first image bearing member is transferred onto said intermediary transfer belt, wherein the second transfer position is a position where a developer image carried on said second image bearing member is transferred onto said intermediary transfer belt, and wherein the third transfer position is a position where a developer image carried on said third image bearing member is transferred onto said intermediary transfer belt.

19. An image forming apparatus according to claim 17, wherein said intermediary transfer belt is rotatably stretched by at least said rotatable driving member configured to transmit a rotational driving force to said intermediary transfer belt and a rotatable tension member configured to generate tension in said intermediary transfer belt for generating a frictional force between said rotatable driving member and said intermediary transfer belt, and wherein the distance A in which said intermediary transfer belt moves when said rotatable driving member rotates through one full circumference is a peripheral length of a circle which has a center coinciding with a rotation center of said rotatable driving member and which passes through a center of thickness of said intermediary transfer belt wound around said rotatable driving member.

20. An image forming apparatus according to claim 17, wherein each of said first drive transmission member, said second drive transmission member and said third drive transmission member is a gear.

21. An image forming apparatus according to claim 17, wherein a ratio of (first inter-transfer-position distance): (second inter-transfer-position distance) falls within an effective range which is ±2% of "N×A":"N×A±N×A/(i1×i2)".

22. An image forming apparatus according to claim 17, wherein when each of the first transmission ratio and second transmission ratio is a number to one decimal place or more, the second inter-transfer-position distance is set at "N×A±N×A/(i1×i2)" where each of the first transmission ratio i1 and the second transmission ratio i2 is a value obtained by rounding off the number to one decimal place.

23. An image forming apparatus according to claim 17, wherein said first drive transmission member is provided coaxially with said rotatable driving member.

24. An image forming apparatus comprising:

a feeding belt configured to feed a recording material;

a first image bearing member provided opposed to said feeding belt;

a second image bearing member provided opposed to said feeding belt;

a third image bearing member provided opposed to said feeding belt;

a rotatable driving member configured to rotationally drive said feeding belt;

a first drive transmission member configured to rotate said rotatable driving member;

a second drive transmission member provided upstream of said first drive transmission member with respect to a drive transmission direction and configured to transmit a rotational driving force from a driving source to said first drive transmission member; and a third drive transmission member provided upstream of said first drive transmission member with respect to the drive transmission direction and downstream of said second drive transmission member with respect to the drive transmission direction and configured to transmit the rotational driving force from the driving source to said first drive transmission member, wherein said image forming apparatus includes:

a first transfer position where said first image bearing member opposes the recording material carried on said feeding belt, a second transfer position where said second image bearing member opposes the recording material carried on said feeding belt, and a third transfer position where said third image bearing member opposes the recording material carried on said feeding belt, wherein a first inter-transfer-position distance between the first transfer position and the second transfer position which are adjacent to each other along said feeding belt and a second inter-transfer-position distance between the second transfer position and the third transfer position which are adjacent to each other along said feeding belt are different from each other, and wherein a positional deviation between transfer images transferred onto the recording material carried on said feeding belt at the first transfer position, the second transfer position and the third transfer position is prevented by setting the first inter-transfer-position distance to "N×A" and setting the second inter-transfer-position distance to "N×A±N×A/(i1×i2)", where N is an integer of rotations of said rotatable driving member during movement of a predetermined position of said feeding belt in the first inter-transfer-position distance, A is a distance of movement of the predetermined position of said feeding belt when said rotatable driving member rotates through one full circumference, i1 is a first transmission ratio between said first drive transmission member and said third drive transmission member, and i2 is a second transmission ratio between said third drive transmission member and said second drive transmission member.

25. An image forming apparatus according to claim 24, wherein the first transfer position is a position where a developer image carried on said first image bearing member is transferred onto the recording material carried on said feeding belt, wherein the second transfer position is a position where a developer image carried on said second image bearing member is transferred onto the recording material carried on said feeding belt, and wherein the third transfer position is a position where a developer image carried on said third image bearing member is transferred onto the recording material carried on said feeding belt.

26. An image forming apparatus according to claim 24, wherein said feeding belt is rotatably stretched by at least said rotatable driving member configured to transmit a rotational driving force to said feeding belt and a rotatable tension member configured to generate tension in said feeding belt for generating a frictional force between said rotatable driving member and said feeding belt, and wherein the distance A in which said feeding belt moves when said rotatable driving member rotates through one full circumference is a peripheral length of a circle which has a center coinciding with a rotation center of said rotatable driving member and which passes through a center of thickness of said feeding belt wound around said rotatable driving member.

27. An image forming apparatus according to claim 24, wherein each of said first drive transmission member, said second drive transmission member and said third drive transmission member is a gear.

28. An image forming apparatus according to claim 24, wherein a ratio of (first inter-transfer-position distance): (second inter-transfer-position distance) falls within an effective range which is ±2% of "N×A":"N×A±N×A/(i1×i2)".

29. An image forming apparatus according to claim 24, wherein when each of the first transmission ratio and second transmission ratio is a number to one decimal place or more, the second inter-transfer-position distance is set at "N×A±N×A/(i1×i2)" where each of the first transmission ratio i1 and the second transmission ratio is a value obtained by rounding off the number to one decimal place.

30. An image forming apparatus according to claim 24, wherein said first drive transmission member is provided coaxially with said rotatable driving member.

* * * * *